US010427012B2

(12) United States Patent
Cole et al.

(10) Patent No.: US 10,427,012 B2
(45) Date of Patent: Oct. 1, 2019

(54) GOLF CLUB HEADS WITH RIBS AND RELATED METHODS

(71) Applicant: Karsten Manufacturing Corporation, Phoenix, AZ (US)

(72) Inventors: Eric V. Cole, Phoenix, AZ (US); Martin R. Jertson, Phoenix, AZ (US); Ryan M. Stokke, Anthem, AZ (US); Sina Ghods, Scottsdale, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 15/660,853

(22) Filed: Jul. 26, 2017

(65) Prior Publication Data

US 2017/0333767 A1 Nov. 23, 2017

Related U.S. Application Data

(63) Continuation-in-part of application No. 15/631,483, filed on Jun. 23, 2017, which is a continuation of application No. 15/076,511, filed on Mar. 21, 2016, now Pat. No. 9,700,768, which is a continuation of application No. 14/044,459, filed on Oct. 2, 2013, now Pat. No. 9,314,676, application No. 15/660,853, filed on Jul. 26, 2017, which is a continuation-in-part of application No. 14/974,354, filed on Dec. 18, 2015, now Pat. No. 9,814,948, which is a continuation of application No. 14/044,447, filed on Oct. 2, 2013, now Pat. No. 9,242,152, which is a continuation-in-part of application No. 13/766,624, filed on Feb. 15, 2013, now Pat. No. 9,126,084, and a continuation-in-part of application No. 13/196,488, filed on Aug. 2, 2011, now Pat. No. 8,523,704, which is a continuation-in-part of application No.

(Continued)

(51) Int. Cl.
*A63B 53/04* (2015.01)
*A63B 60/00* (2015.01)

(52) U.S. Cl.
CPC .... *A63B 53/0466* (2013.01); *A63B 2053/045* (2013.01); *A63B 2053/0408* (2013.01); *A63B 2053/0433* (2013.01); *A63B 2053/0437* (2013.01); *A63B 2060/002* (2015.10)

(58) Field of Classification Search
CPC ..... A63B 2053/045; A63B 53/0466
See application file for complete search history.

(56) References Cited

U.S. PATENT DOCUMENTS 4,214,754 A 7/1980 Zebelean
4,432,549 A 2/1984 Zebelean (Continued)

FOREIGN PATENT DOCUMENTS

CA 2471397 12/2005
CN 2636914 9/2004

(Continued)

OTHER PUBLICATIONS

Written Opinion of the International Searching Authority, for PCT/US2017/044006, filed Jul. 26, 2017; the Written Opinion was dated Sep. 26, 2017.

*Primary Examiner* — John E Simms, Jr.

(57) ABSTRACT

Golf club heads with ribs are described herein. Other embodiments and related methods are also disclosed herein.

15 Claims, 36 Drawing Sheets

Related U.S. Application Data

12/541,817, filed on Aug. 14, 2009, now Pat. No. 8,206,242, which is a continuation-in-part of application No. 12/430,821, filed on Apr. 27, 2009, now Pat. No. 7,874,935, which is a continuation of application No. 12/047,957, filed on Mar. 13, 2008, now Pat. No. 7,563,177, which is a continuation of application No. 11/496,216, filed on Jul. 31, 2006, now Pat. No. 7,396,298.

(60) Provisional application No. 62/366,710, filed on Jul. 26, 2016, provisional application No. 61/737,716, filed on Dec. 14, 2012.

(56) References Cited

U.S. PATENT DOCUMENTS

| | | | | |
|---|---|---|---|---|
| 4,681,321 | A | 7/1987 | Chen et al. | |
| 5,067,715 | A | 11/1991 | Schmidt et al. | |
| 5,180,166 | A | 1/1993 | Schmidt et al. | |
| 5,213,328 | A | 5/1993 | Long et al. | |
| 5,351,958 | A | 10/1994 | Helmstetter | |
| 5,419,559 | A | 5/1995 | Melanson et al. | |
| 5,839,975 | A * | 11/1998 | Lundberg | A63B 53/04 473/346 |
| 5,941,782 | A | 8/1999 | Cook | |
| 6,059,669 | A | 5/2000 | Pearce | |
| 6,354,961 | B1 | 3/2002 | Allen | |
| 6,595,871 | B2 | 7/2003 | Sano | |
| 6,645,087 | B2 | 11/2003 | Yabu | |
| 6,783,465 | B2 | 8/2004 | Matsunaga | |
| 6,852,038 | B2 | 2/2005 | Yabu | |
| 7,059,973 | B2 | 6/2006 | Erickson et al. | |
| 7,250,007 | B2 | 7/2007 | Lu | |
| 7,273,423 | B2 | 9/2007 | Imamoto | |
| 7,396,298 | B2 | 7/2008 | Jertson et al. | |
| 7,507,168 | B2 | 3/2009 | Chou et al. | |
| 7,563,177 | B2 | 7/2009 | Jertson et al. | |
| 7,578,755 | B2 | 8/2009 | Oyama | |
| 7,621,824 | B2 | 11/2009 | Sano | |
| 7,641,568 | B2 | 1/2010 | Hoffman et al. | |
| 7,651,412 | B2 | 1/2010 | Meyer et al. | |
| 7,749,104 | B2 | 7/2010 | Brekke et al. | |
| 7,806,781 | B2 | 10/2010 | Imamoto | |
| 7,828,676 | B2 | 11/2010 | Wada et al. | |
| 7,850,545 | B2 * | 12/2010 | Wada | A63B 53/0466 473/332 |
| 7,874,935 | B2 | 1/2011 | Jertson et al. | |
| 7,887,433 | B2 | 2/2011 | Hoffman et al. | |
| 7,988,565 | B2 | 8/2011 | Abe | |
| 8,206,242 | B2 | 6/2012 | Jertson et al. | |
| 8,246,489 | B2 | 8/2012 | Yamamoto | |
| 8,414,421 | B2 | 4/2013 | Jertson et al. | |
| 8,425,347 | B2 | 4/2013 | Jertson et al. | |
| 8,523,704 | B2 | 9/2013 | Jertson et al. | |
| 8,747,251 | B2 | 6/2014 | Hayase et al. | |
| 8,864,604 | B2 | 10/2014 | Matsunaga | |
| 9,126,084 | B2 | 9/2015 | Stokke | |
| 9,174,103 | B2 | 11/2015 | Curtis et al. | |
| 9,314,676 | B2 * | 4/2016 | Cole | A63B 53/0466 |
| 9,393,465 | B2 | 7/2016 | Stokke et al. | |
| 9,700,768 | B2 | 7/2017 | Cole et al. | |
| 9,814,948 | B2 * | 11/2017 | Cole | A63B 53/0466 |
| 9,937,391 | B2 | 4/2018 | Takechi | |
| 2002/0072434 | A1 | 6/2002 | Yabu | |
| 2003/0104878 | A1 | 6/2003 | Yabu | |
| 2003/0114244 | A1 * | 6/2003 | Matsunaga | A63B 53/0466 473/345 |
| 2004/0266551 | A1 | 12/2004 | Noguchi et al. | |
| 2005/0049081 | A1 | 3/2005 | Boone | |
| 2005/0221913 | A1 | 10/2005 | Kusumoto | |
| 2006/0052181 | A1 | 3/2006 | Serrano et al. | |
| 2008/0045356 | A1 | 2/2008 | Lin et al. | |
| 2008/0070721 | A1 | 3/2008 | Chen et al. | |
| 2009/0247320 | A1 * | 10/2009 | Wada | A63B 53/0466 473/345 |
| 2010/0022327 | A1 * | 1/2010 | Nakano | A63B 53/0466 473/346 |
| 2010/0029408 | A1 | 2/2010 | Abe | |
| 2011/0287859 | A1 * | 11/2011 | Jertson | A63B 53/0466 473/346 |
| 2012/0322580 | A1 | 12/2012 | Wada et al. | |

FOREIGN PATENT DOCUMENTS

| | | |
|---|---|---|
| EP | 1757335 | 2/2007 |
| GB | 2417909 | 3/2006 |
| GB | 2440511 | 2/2008 |
| JP | 04327864 | 11/1992 |
| JP | 09154984 | 6/1997 |
| JP | 2001095957 | 4/2001 |
| JP | 2001353240 | 12/2001 |
| JP | 2002126136 | 5/2002 |
| JP | 2002239641 | 8/2002 |
| JP | 2003159354 | 6/2003 |
| JP | 2005073736 | 3/2005 |
| JP | 2005137788 | 6/2005 |
| JP | 2005237948 | 9/2005 |
| JP | 2005287529 | 10/2005 |
| JP | 2005312942 | 11/2005 |

* cited by examiner

1600

33000

34000

36000

38000

GOLF CLUB HEADS WITH RIBS AND RELATED METHODS

CLAIM OF PRIORITY

This claims the benefit of U.S. Provisional Application No. 62/366,710, filed Jul. 26, 2016, and is also a continuation-in-part of U.S. patent application Ser. No. 15/631,483, filed Jun. 23, 2017, which is a continuation of U.S. patent application Ser. No. 15/076,511, filed on Mar. 21, 2016, now U.S. Pat. No. 9,700,768, which is a continuation of U.S. patent application Ser. No. 14/044,459, filed on Oct. 2, 2013, now U.S. Pat. No. 9,314,676. This is also a continuation-in-part to U.S. patent application Ser. No. 14/974,354, filed Dec. 18, 2015, which is a continuation of U.S. patent application Ser. No. 14/044,447, filed on Oct. 2, 2013, now U.S. Pat. No. 9,242,152, which is a continuation-in-part of U.S. patent application Ser. No. 13/768,624, filed on Feb. 15, 2013, now U.S. Pat. No. 9,126,084, which claims the benefit of U.S. Provisional Patent Application No. 61/737,716, filed on Dec. 14, 2012. U.S. patent application Ser. No. 13/768,624 is also a continuation-in-part of U.S. patent application Ser. No. 13/196,488, filed on Aug. 2, 2011, now U.S. Pat. No. 8,523,704, which is a continuation-in-part of U.S. patent application Ser. No. 12/541,817, filed on Aug. 14, 2009, now U.S. Pat. No. 8,206,242, which is a continuation-in-part of U.S. patent application Ser. No. 12/430,821, filed on Apr. 27, 2009, now U.S. Pat. No. 7,874,935, which is a continuation of U.S. patent application Ser. No. 12/047,957, filed on Mar. 13, 2008, now U.S. Pat. No. 7,563,177, which is a continuation of U.S. patent application Ser. No. 11/496,216, filed on Jul. 31, 2006, now U.S. Pat. No. 7,396,298. The contents of the disclosures listed above are incorporated herein by reference.

TECHNICAL FIELD

The present invention generally relates to golf equipment and, more particularly, to golf club heads.

BACKGROUND

Modern wood-type golf club heads are now almost exclusively made of metal rather than the persimmon wood that gave the clubs their name. These club heads are generally constructed as a hollow metal shell with a relatively thick face to withstand the ball impact and a relatively thick sole to withstand grazing impact with the ground as well as lowering the center of gravity of the club head. The remainder of the club head is manufactured as thin as possible so as to allow the maximum amount of material to be dedicated to the face and sole portions. Although the crown and skirt of a modern club head are quite thin, they still must be sufficiently rigid in the direction of the maximum stress in order to provide support for the face of the club head.

Ribs have commonly been employed in the crowns of club heads to enable the crowns to be as lightweight as possible while still providing sufficient stiffness in the fore and aft direction. U.S. Pat. No. 4,214,754 to Zebelean discloses a hollow club head with a crown that includes parallel ribs running perpendicular to the face of the club head that extend internally and bridge the thin transition with the crown. Similarly, U.S. Pat. No. 6,595,871 to Sano discloses a hollow club head with a separately attached face and a crown that includes a plurality of parallel ribs extending perpendicular to the face. U.S. Pat. No. 5,067,715 to Schmidt et al discloses a hollow club head that includes a crown with a plurality of parallel ribs that merge into and run perpendicularly to the club head face as well as a plurality of ribs that merge into and run perpendicularly to a rear wall of the club head.

The prior art fails to recognize that a club head having a crown with parallel ribs that uniformly reinforce the face of the club head is not an efficient structure since the club head face is not uniformly loaded but is subjected to essentially a point impact near its center.

Figure 1:
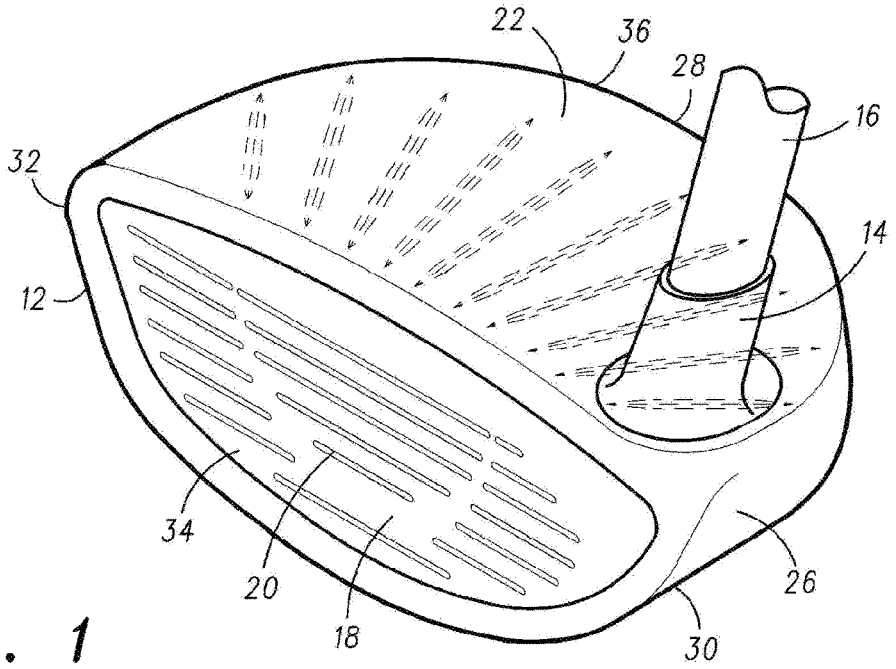
FIG. 1 is a front perspective view of a golf club head incorporating features of the present invention.

For simplicity and clarity of illustration, the drawing figures illustrate the general manner of construction, and descriptions and details of well-known features and techniques may be omitted to avoid unnecessarily obscuring the invention. Additionally, elements in the drawing figures are not necessarily drawn to scale. For example, the dimensions of some of the elements in the figures may be exaggerated relative to other elements to help improve understanding of embodiments of the present invention. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein.

The terms "couple," "coupled," "couples," "coupling," and the like should be broadly understood and refer to connecting two or more elements or signals, electrically, mechanically or otherwise. Two or more electrical elements may be electrically coupled, but not mechanically or otherwise coupled; two or more mechanical elements may be mechanically coupled, but not electrically or otherwise coupled; two or more electrical elements may be mechanically coupled, but not electrically or otherwise coupled. Coupling (whether mechanical, electrical, or otherwise) may be for any length of time, e.g., permanent or semi-permanent or only for an instant.

As defined herein, two or more elements are "integral" if they are comprised of the same piece of material. As defined herein, two or more elements are "non-integral" if each is comprised of a different piece of material.

DESCRIPTION

In a first example, a golf club head can comprise a body and a plurality of ribs protruded from a rib surface of the body. The body can comprise having a heel end, a toe end, a sole, a front surface, and a rear surface. The plurality of ribs can comprise a first rib with a first longitudinal axis, a second rib with a second longitudinal axis, a third rib with a third longitudinal axis. The first, second, and third longitudinal axes can intersect at a common point external to the body.

In a second example, a golf club head can comprise a body and a plurality of ribs protruded from a rib surface of the body. The body can comprise a heel end, a toe end, a crown, a sole, a front surface, and a rear surface. The plurality of ribs can be generally straight and non-intersecting, and/or may comprise a first rib closest to the heel end of the body and a second rib closest to the toe end of the body. The plurality of ribs also may be arranged in a substantially radial pattern to form a fan-like shape between the first and second ribs.

In a third example, a method can comprise (a) providing a body of a golf club head with a heel end, a toe end, a sole, a front surface, and a rear surface, and (b) providing a plurality of ribs protruded from a rib surface of the body. The plurality of ribs can comprise a first rib with a first longitudinal axis extending through a common point, a second rib with a second longitudinal axis extending through the common point, and a third rib with a third longitudinal axis extending through the common point, wherein the common point can be external to the body.

In one embodiment, a golf club head comprises a body having a heel end, a toe end, a sole, and a front surface, and a plurality of ribs protruded from a rib surface of the body. The plurality of ribs comprise (a) a first rib comprising a first-first rib end, a first-second rib end opposite the first-first rib end, and a first axis extending through the first-first rib end and the first-second rib end; (b) a second rib comprising a second-first rib end, a second-second rib end opposite the second-first rib end and a second axis extending through the second-first rib end and the second-second rib end, and (c) a third rib comprising a third-first rib end, a third-second rib end opposite the third-first rib end, and a third axis extending through the third-first rib end and the third-second rib end. The front surface comprises a strikeface with a strikeface centerpoint, and a loft plane tangent to the strikeface centerpoint defines a front plane of the golf club head. The first rib can be located between the second and third ribs. The first axis can comprise a first distance between the front plane and the first-first rib end. The second axis can comprise a second distance between the front plane and the second-first rib end. The third axis can comprise a third distance between the front plane and the third-first rib end. At least one of the first, second, or third distances can be greater than at least another one of the first, second, or third distances.

In one embodiment, a golf club head can comprise a body having a heel end, a toe end, a sole, and a front surface, and a plurality of ribs protruded from a rib surface of the body. The plurality of ribs can comprise (a) a first rib comprising a first-first rib end, a first-second rib end opposite the first-first rib end, and a first axis extending through the first-first rib end and the first-second rib end; (b) a second rib comprising a second-first rib end, a second-second rib end opposite the second-first rib end, and a second axis extending through the second-first rib end and the second-second rib end; and (c) a third rib comprising a third-first rib end, a third-second rib end opposite the third-first rib end, and a third axis extending through the third-first rib end and the third-second rib end. The first rib can be located between the second and third ribs. The first axis can comprise a first distance between the front surface and the first-first rib end. The second axis can comprise a second distance between the front surface and the second-first rib end. The third axis can comprise a third distance between the front surface and the third-first rib end. At least one of the first, second, or third distances can be greater than at least another one of the first, second, or third distances.

In one example, a method for providing a golf club head can comprise providing a body having a heel end, a toe end, a sole, and a front surface, and providing a plurality of ribs protruded from a rib surface of the body. Providing the plurality of ribs can comprise (a) providing a first rib comprising a first-first rib end, a first-second rib end opposite the first-first rib end, and a first axis extending through the first-first rib end and the first-second rib end; (b) providing a second rib comprising a second-first rib end, a second-second rib end opposite the second-first rib end, and a second axis extending through the second-first rib end and the second-second rib end; and (c) providing a third rib comprising a third-first rib end, a third-second rib end opposite the third-first rib end, and a third axis extending through the third-first rib end and the third-second rib end. Providing the body can comprise coupling a strikeface at the front surface, the strikeface comprising a strikeface centerpoint. A loft plane of the golf club head can be tangent to the strikeface centerpoint. When the golf club head is at address over a ground flat surface, the loft plane intersects the ground flat surface along a front intersection line, and a front plane extends orthogonal to the ground flat surface from the front intersection line. The first rib can be located between the second and third ribs. The first axis can comprise a first distance between the first-first rib end and a front reference comprising one of the loft plane, the front plane, or the front surface. The second axis can comprise a second distance between the second-first rib end and the front reference. The third axis can comprise a third distance between the third-first rib end and the front reference. The plurality of ribs are staggered relative to the front reference such that at least one of the first, second, or third distances can be greater than at least another one of the first, second, or third distances.

In one embodiment, a golf club head can comprise a body and a first rib. The body can comprise a heel end, a toe end, a crown, a sole, a front end, and a rear end, and at least one of a skirt or a hosel. The first rib can protrude from a rib surface of the body and can comprise first and second first-rib ends opposite each other, and first, second, and third first-rib portions protruded from the rib surface of the body. The first first-rib portion can be located between the first first-rib end and the third first-rib portion. The second first-rib portion can be located between the second first-rib end and the third first-rib portion. The first first-rib portion can comprise a first first-rib dimension comprising one of a first first-rib height substantially orthogonal to the rib surface when the first first-rib dimension comprises the first first-rib height, or a first first-rib thickness substantially orthogonal to the first first-rib height. The second first-rib portion can comprise a second first-rib dimension comprising one of a second first-rib height substantially orthogonal to the rib surface when the first first-rib dimension comprises the first first-rib height, or a second first-rib thickness substantially orthogonal to the second first-rib height when the first first-rib dimension comprises the first first-rib thicknesses. The third first-rib portion can comprise a third first-rib dimension comprising one of a third first-rib height substantially orthogonal to the rib surface when the first first-rib dimension comprises the first first-rib height, or a third first-rib thickness substantially orthogonal to the third first-rib height when the first first-rib dimension comprises the first first-rib thicknesses. The first and second first-rib dimensions can be greater than the third first-rib dimension.

In one embodiment, a golf club head can comprise a body and a first rib. The body can comprise a heel end, a toe end, a crown, a sole, a front end, a rear end. The first rib can protrude from a rib surface of the body. The first rib can comprise first and second first-rib ends opposite each other, and first, and second first-rib portions protruded from the rib surface of the body. The first first-rib end can be located at a first one of the crown or the sole. The second first-rib end is located at a second one of the crown or the sole. The first first-rib portion can be located between the first first-rib end and the second first-rib portion, and/or along the first one of the crown or the sole. The second first-rib portion can be located between the second first-rib end and the first first-rib portion, and/or along the second one of the crown or the sole.

In one implementation, a method can comprise providing a body and providing a first rib protruding from a rib surface of the body. The body can comprise a heel end, a toe end, a crown, a sole, a front end, and a rear end. The first rib can comprise first and second first-rib ends opposite each other, and first, second, and third first-rib portions protruded from the rib surface of the body. The first first-rib portion can be located between the first first-rib end and the third first-rib portion. The second first-rib portion can be located between the second first-rib end and the third first-rib portion. The first first-rib portion can comprise a first first-rib dimension comprising one of: a first first-rib height substantially orthogonal to the rib surface, or a first first-rib thickness substantially orthogonal to the first first-rib height. The second first-rib portion can comprise a second first-rib dimension comprising a second first-rib height substantially orthogonal to the rib surface when the first first-rib dimension comprises the first first-rib height, or a second first-rib thickness substantially orthogonal to the second first-rib height when the first first-rib dimension comprises the first first-rib thickness. The third first-rib portion can comprise a third first-rib dimension comprising a third first-rib height substantially orthogonal to the rib surface when the first first-rib dimension comprises the first first-rib height, or a third first-rib thickness substantially orthogonal to the third first-rib height when the first first-rib dimension comprises the first first-rib thickness. The first and second first-rib dimensions can be greater than the third first-rib dimension.

In one embodiment, a golf club head can comprise a body, an interior surface, and an interior cavity bounded by the interior surface. The body can comprise a heel end, a toe end, a crown, a sole, a front wall comprising a strikeface, and a rear side. The interior surface can be defined by the heel end, the toe end, the crown, the sole, the front wall, and/or the rear side. The golf club head can also comprise ribs protruded from a rib surface of the body, where the ribs can comprise first, second, and third ribs. The first rib can comprise a first first-rib endpoint, a second first-rib endpoint, and a first rib axis intersecting the first and second first-rib endpoints. The second rib can comprise a first second-rib endpoint, a second second-rib endpoint, and a second rib axis intersecting the first and second second-rib endpoints. The third rib can comprise a first third-rib endpoint, a second third-rib endpoint, and a third rib axis intersecting the first and second third-rib endpoints. With respect to a top view of the golf club head, the first, second, and third rib axes intersect each other and are tangent to a locus defined by a conic section perimeter.

In one implementation, a method for providing a golf club head can comprise providing a body and providing ribs protruded from a rib surface of the body. The body can comprise a heel end, a toe end, a crown, a sole, a front wall comprising a strikeface, a rear side, an interior surface defined by the heel end, the toe end, the crown, the sole, the front wall, and/or the rear side, and an interior cavity bounded by the interior surface. The ribs can comprise first, second, and third ribs. The first rib can comprise a first first-rib endpoint, a second first-rib endpoint, and a first rib axis intersecting the first and second first-rib endpoints. The second rib can comprise a first second-rib endpoint, a second second-rib endpoint, and a second rib axis intersecting the first and second second-rib endpoints. The third rib can comprise a first third-rib endpoint, a second third-rib endpoint, and a third rib axis intersecting the first and second third-rib endpoints. With respect to a top view of the golf club head, the first, second, and third rib axes intersect each other and are tangent to a locus defined by a conic section perimeter.

In one embodiment, a golf club head can comprise a body and a plurality of ribs protruded from a rib surface of the body. The body can comprise a heel end, a toe end, a crown, a sole, a front wall comprising a strikeface, and a rear side. The plurality of ribs can comprise a first rib with a first longitudinal axis, a second rib with a second longitudinal axis; and a third rib with a third longitudinal axis. The first, second, and third longitudinal axes can intersect at a common point external to the body. The plurality of ribs can be non-convex relative to the crown of the golf club head.

Other examples and embodiments are further disclosed herein. Such examples and embodiments may be found in the figures, in the claims, and/or in the present description.

Figure 3:
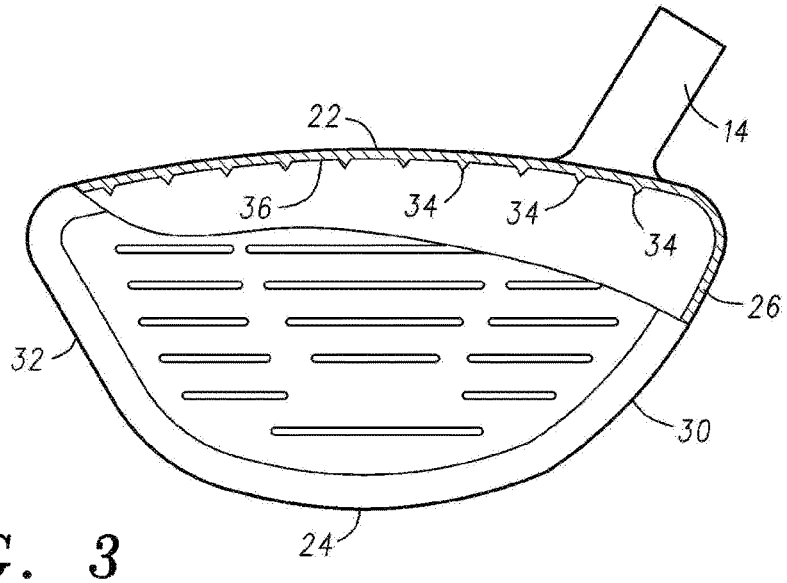
FIG. 3 is a partial cross-sectional view of the club head of FIG. 1 viewed from the front.
Figure 2:
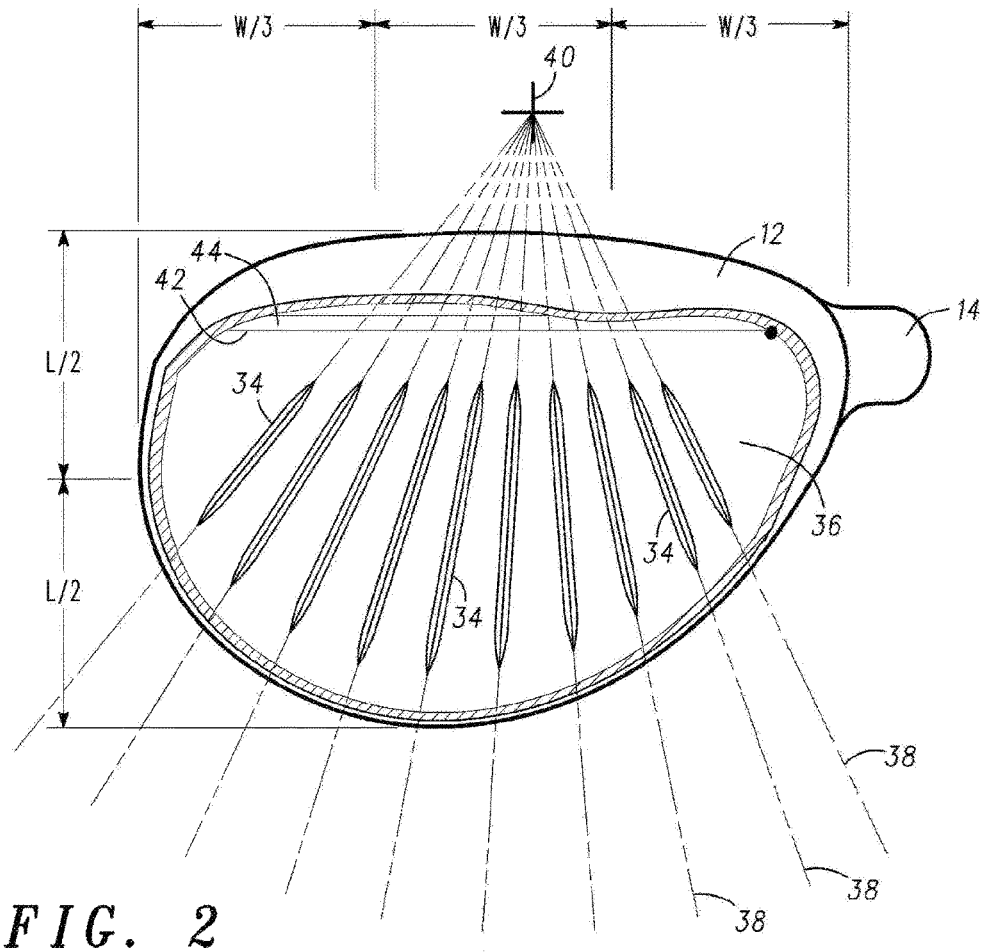
FIG. 2 is a cross-sectional view of the club head of FIG. 1 viewed from below.

With reference to FIGS. 1-3, golf club 10 comprises a club head 12, a hosel 14 and a shaft 16. Club head 12 is composed of a hollow body 18, typically made of stainless steel, titanium or other material having a high shear modulus of elasticity and high strength-to-weight ratio. Hollow body 18 comprises a front wall or face 20 adapted for impacting a golf ball. Hollow body 18 further comprises a top wall or crown 22, a bottom wall or sole 24, and a side wall or skirt 26 that connects the face 20 to crown 22 and sole 24. Club head 12 further includes a heel end 30 and a toe end 32. Skirt 26 wraps around the club head 12 between the heel and toe ends 30, 32 to form a rear wall 28. Golf club head 12 can be a golf club head for a driver type club, a fairway wood, or a hybrid club.

Crown 22 comprises a thin walled structure preferably cast as part of hollow body 18. Crown 22 is preferably titanium having a relatively thin thickness dimension of 0.076 centimeters (cm)±0.013 cm. Crown 22 is reinforced with a plurality of ribs 34 extending downward from lower surface 36 of crown 22. Each rib 34 extends from a first end proximal, but spaced from, the front wall 20 to a second end proximal, but spaced from, the rear wall 28. The ribs 34 are spaced apart by a greater amount, preferably 20 percent greater, at their second ends than at their first ends. Adjacent ribs 34 diverge from their first ends toward their second ends by an angle of at least 5 degrees. Ribs 34 comprise narrow, elongate, generally straight, metallic, shock wave distributing elements with a height dimension of 0.051 cm.±0.013 cm and width dimension of 0.178 cm±0.013 cm. Ribs 34 are generally convex downward when viewed in cross-section and blend smoothly into lower surface 36 of crown 22. It will be understood that crown 22 is free of ribs extending transversely between the ribs 34.

The lower surface 36 of the crown 22 has a forward portion and a rearward portion as defined by a midline lying generally parallel to the front wall 20 one-half the distance between a forwardmost point on the front wall 20 and a rearwardmost point on the rear wall 28. The first ends of the ribs 34 terminate in the forward portion of the crown 22 and the second ends of the ribs 34 terminate in the rearward portion of the crown 22.

As shown most clearly in FIG. 2, ribs 34 are arrayed in a pattern such that the longitudinal axes 38 of the ribs 34 radiate from and intersect at a point 40 in space located forward of front wall 20. Point 40 is preferably located within the middle one third (W/3) of the width of front wall 20 and is preferably located substantially in front of the center line of front wall 20. Note that because club head 12 is a three dimensional body, as used herein, point 40 refers to a single point when viewed in plan view as in FIG. 2. Alternatively, point 40 can be thought of as a vertical line consisting of the locus of intersections of vertical planes passing through the center lines of the ribs 34.

Ribs 34 originate at a first location proximal the intersection 42 of the rear surface 44 of front wall 20 and lower surface 36 of crown 22 and extend to a second location proximal rear wall 28. In the illustrative embodiment, at least half, and preferably all of the ribs 34 extend from front wall 20 past the mid-point (L/2) of club head 12 and are not interconnected by any transverse ribs. Accordingly, each rib 34 acts independently of the other ribs 34 interconnected only by the intervening thin section of crown 22 therebetween. Preferably, point 40 is also no more than L/2 forward of front wall 20. This results in a pattern of ten ribs 34 subtending an angle of approximately 60 degrees or an angular divergence of from 4 to 8 degrees, preferably about 6 degrees of divergence between adjacent ribs 34.

The surprising result of this arrangement of ribs 34 is that although an array of perpendicular ribs 0.051 cm high by 0.178 cm wide results in only a 9% reduction in maximum stress as compared with unreinforced crown region, ribs 34 arranged in a radial fan pattern in accordance with the present invention reduce maximum stress in the crown region by almost 36%. Although not wishing to be held to any particular theory of operation, it is believed that because the face 20 itself deforms non-uniformly extending outward from the point of impact, the loads are transferred to the crown region in a similar non-uniform manner radiating outward from the point of impact. Therefore, arranging the ribs 34 in a radial pattern extending out from near the point of impact yields a crown 22 that more efficiently supports the face 20 during impact.

In addition to straight linear ribs with substantially constant widths and heights as demonstrated in the example of FIGS. 1-3, it is possible to have alternate embodiments of a golf club head with ribs. For example, the ribs can be curved or the heights and/or widths of the ribs can be varied.

Figure 4:
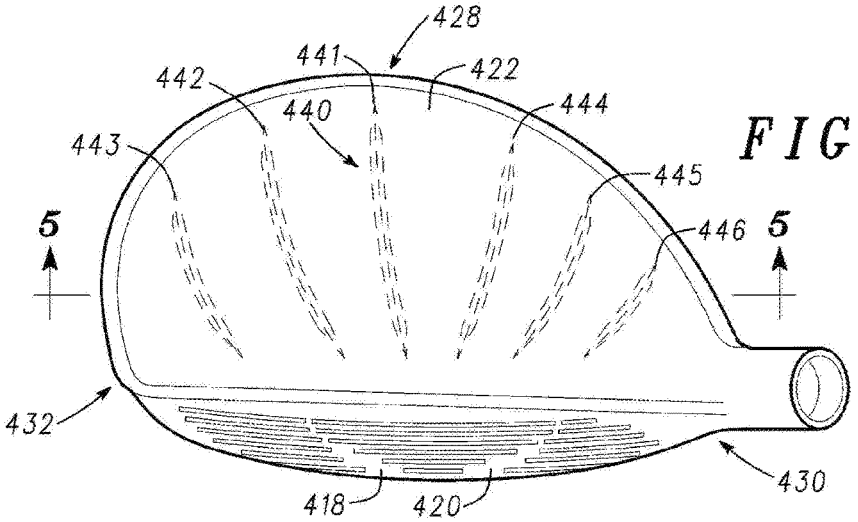
FIG. 4 is a top view of a golf club head, according to a second embodiment.
Figure 5:
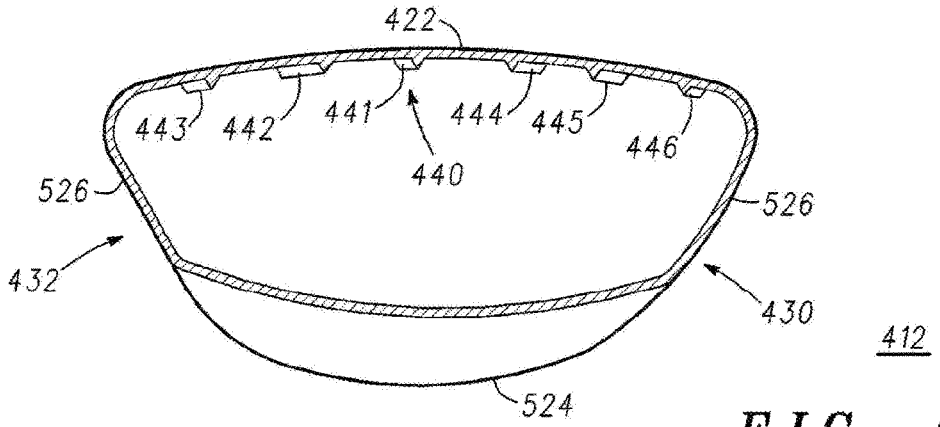
FIG. 5 is a full cross-sectional view of the club head of FIG. 4 viewed from the front.

As an example, FIG. 4 illustrates another embodiment of a golf club head. FIG. 5 illustrates a cross-sectional view of the embodiment of FIG. 4 taken at the lines labeled "5." Golf club head 412 (FIG. 4) includes a hollow body 418 (FIG. 4) with a front wall 420 (FIG. 4), a crown 422 (FIG. 4), a sole 524 (FIG. 5), a side wall 526 (FIG. 5) connecting crown 422 and sole 524, a heel end 430 (FIG. 4), a toe end 432 (FIG. 4), and a rear side 428 (FIG. 4) that is opposite of front wall 420. In addition, golf club head 412 can also include ribs 440 (FIG. 4) that extend downwardly from the lower surface of crown 422. In the example of the embodiment illustrated in FIG. 4, ribs 440 comprise ribs 441, 442, 443, 444, 445, and 446 that have a first end that is proximal to front wall 420 and a second end that is proximal to rear side 428.

In some examples, one or more of ribs 440 can be curved. As an example, each of ribs 441, 442, 443, 444, 445, and 446 are curved in the example of FIG. 4. In other examples, however, some of ribs 440 may not be curved. For example, rib 441 can be linear. When ribs 440 are curved, the length of ribs 440 can be increased. A longer rib allows for more of the rib to absorb the vibration.

Each of ribs 440 of FIG. 4 are curved. In some examples, ribs 440 can be curved in different directions. For example, ribs 441, 442, and 443 can be curved in one direction, while ribs 444, 445, and 446 can be curved in the opposite direction. Ribs 441, 442, and 443 are curved convexly with respect to toe end 432. Therefore, the first end and second end of ribs 441, 442, and 443 are curved away from toe 432 end towards heel end 430. On the other hand, ribs 444, 445, and 446 are curved convexly with respect to heel end 430. Therefore, the first end and second end of ribs 444, 445, and 446 are curved away from heel end 430 towards toe end 432. In one example, at least two of ribs 440 would intersect if extended forwardly in a linear or curved fashion toward front wall 420. For example, the linear extension of rib 442 would intersect with the linear extension of rib 444 near front wall 420 or, in a different embodiment, in front of front wall 420. It should be noted that there may be alternate curve arrangements for ribs 440. For example, more ribs of ribs 440 may curve towards one direction than the other, or all the ribs may curve in the same direction. In addition, there may be less or more than six ribs 440.

Each of ribs 440 can have a radius of curvature. A radius of curvature is the radius of the circle that is created by an extrapolation of the rib. In some examples, each of ribs 440 has a different radius of curvature. In other examples, some of the radii can be approximately equal to each other.

In the example of golf club head 412 illustrated in FIG. 4, rib 441 has the largest radius of curvature. The radius of curvature of the subsequent ribs decreases the closer the rib is to heel end 430 or toe end 432 relative to rib 441. For example, the radius of curvature of rib 442 is less than that of rib 441, and the radius of curvature of rib 443 is less than that of rib 442. Furthermore, the radius of curvature of rib 444 is less than that of rib 441; the radius of curvature of rib 445 is less than that of rib 444; and the radius of curvature of rib 446 is less than that of rib 445. In other examples the radii of curvature of ribs 440 can increase the closer the rib is to heel end 430 or toe end 432 relative to rib 441. In yet other examples, the radii of curvature of ribs 440 can have no relation to the rib's position relative to rib 441.

In the same or other examples, the radii of curvature for the ribs can be symmetric with each other according to their position relative to rib 441. For example, the radius of curvature of rib 442 can be approximately equal to the radius of curvature of rib 444, and the radius of curvature of rib 443 can be approximately equal to the radius of curvature of rib 445. In other examples, the radii of curvature for ribs 440 are asymmetric with each other.

Each of ribs 440 has a width dimension. In the example of FIG. 4, each of ribs 440 has a width that is approximately equal to the other ribs. In other examples, ribs 440 can have widths that are not equal to every other rib. In some examples, each of ribs 440 has a tapering first end and a tapering second end. In other examples, there is no tapering of the first end and/or the second end.

In addition, each of ribs 440 has a height dimension. The height dimension is a measure of the distance that a rib extends from crown 422 into hollow body 418. In the example of FIG. 5, each of ribs 440 has a height that is approximately equal to the heights of each of the other ribs. In other examples, ribs 440 can have heights that are not equal to the other ribs.

Each of ribs 440 has a length dimension also. The length dimension is a measure of the (curved) distance between a rib's first end and its second end. In the example of FIG. 4, the ribs towards the midpoint between toe end 432 and heel end 430 have the greatest length. In addition, the length of a rib decreases the closer the rib is to toe end 432 or heel end 430. As an example, rib 441 has the greatest length; the length of rib 442 is greater than that of rib 443; the length of rib 444 is greater than that of rib 445; and the length of rib 445 is greater than that of rib 446. In other examples, all of ribs 440 have an approximately equal length.

Figure 6:
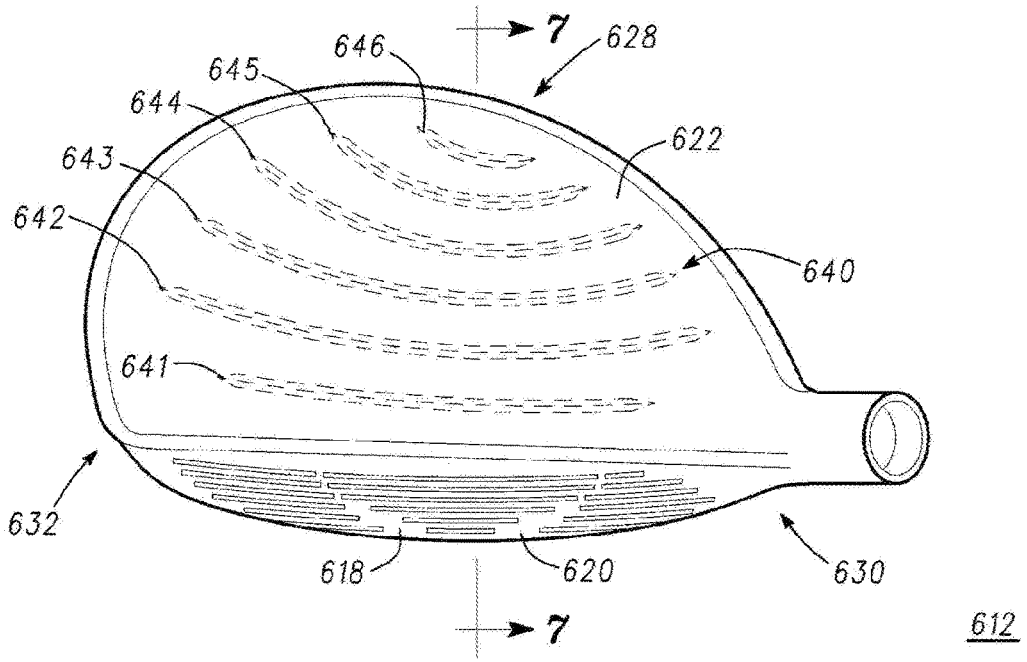
FIG. 6. is a top view of a golf club head, according to a third embodiment.
Figure 7:
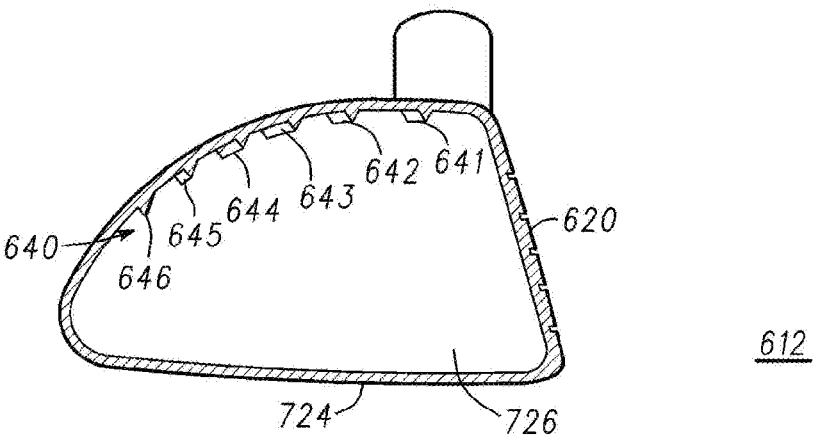
FIG. 7 is a full cross-sectional view of the club head of FIG. 6 viewed from the side.

FIG. 6 illustrates another embodiment of a golf club head. FIG. 7 illustrates a cross-sectional view of the embodiment of FIG. 6 taken at the lines labeled "7." Golf club head 612 (FIG. 6) includes a hollow body 618 (FIG. 6) with a front wall 620 (FIG. 6), a crown 622 (FIG. 6), a sole 724 (FIG. 7), a side wall 726 (FIG. 7) connecting crown 622 and sole 624, a heel end 630 (FIG. 6), a toe end 632 (FIG. 6), and a rear side 628 (FIG. 6). In addition, golf club head 612 can also include ribs 640 (FIG. 6) that extend downwardly from the lower surface of crown 622. In the example of the embodiment illustrated in FIG. 6, ribs 640 comprise ribs 641, 642, 643, 644, 645, and 646 that have a first end that is proximal to toe end 632 and a second end that is proximal to heel end 630.

In some examples, one or more of ribs 640 can be curved. As an example, each of ribs 641, 642, 643, 644, 645, and 646 are curved in the example of FIG. 6. In other examples, however, some of ribs 640 may not be curved. For example, rib 641 can be linear.

Each of ribs 640 of FIG. 6 are curved. In some examples, ribs 640 are all curved in the same direction. For example, ribs 641, 642, 643, 644, 645, and 646 are curved convexly with respect to front wall 620. Therefore, the first end and second end of ribs 640 are curved away from front wall 620. It should be noted that there may be alternate curve arrangements for ribs 640. For example, if the dimensions of golf club head 612 decrease significantly at rear side 628 relative to front wall 620, some of ribs 640 may be curved concavely with respect to front wall 602. In other embodiments, some of ribs 640 may have a first end that is proximal to front wall 620 and a second end that is proximal to rear side 628. In addition, there may be less or more than six ribs 440.

Each of ribs 640 can have a radius of curvature. In some examples, each of ribs 640 has a different radius of curvature. In other examples, some of the radii of curvature can be approximately equal to each other.

In the example of golf club head 612 illustrated in FIG. 6, rib 641 has the largest radius of curvature. The radius of curvature of the subsequent ribs decreases the closer the rib is to rear end 628. For example, the radius of curvature of rib 642 is less than that of rib 641; the radius of curvature of rib 643 is less than that of rib 642; the radius of curvature of rib 644 is less than that of rib 643; the radius of curvature of rib 645 is less than that of rib 644; and the radius of curvature of rib 646 is less than that of rib 645. In other examples, the radii of curvature of ribs 640 can increase for each rib that is closer to rear 628. In yet other examples, the radii of curvature of ribs 640 have no relation to the rib's position relative to rear end 628.

Each of ribs 640 has a width dimension. In the example of FIG. 6, each of ribs 640 has a width that is approximately equal to the other ribs. In other examples, ribs 640 can have widths that are not equal to the other ribs. In some examples, each of ribs 640 has a tapering first end and a tapering second end. In other examples, there is no tapering of the first end and/or the second end.

In addition, each of ribs 640 has a height dimension. The height dimension is a measure of the distance that a rib extends from crown 622 into hollow body 618. In the example of FIG. 7, each of ribs 640 have a height that is approximately equal to the heights of each of the other ribs. In other examples, ribs 640 can have heights that are not equal to the other ribs.

Each of ribs 640 has a length dimension also. The length dimension is a measure of the (curved) distance between a rib's first end and its second end. In the example of FIG. 6, the ribs closer to front wall 620 generally have a greater length than the ribs closer to rear side 628. As an example, the length of rib 642 is greater than that of rib 643; the length of rib 643 is greater than that of rib 644; the length of rib 644 is greater than that of rib 645; and the length of rib 645 is greater than that of rib 646. The length of rib 642, however, is greater than that of rib 641. In other examples, all of ribs 640 have an approximately equal length.

Figure 8:
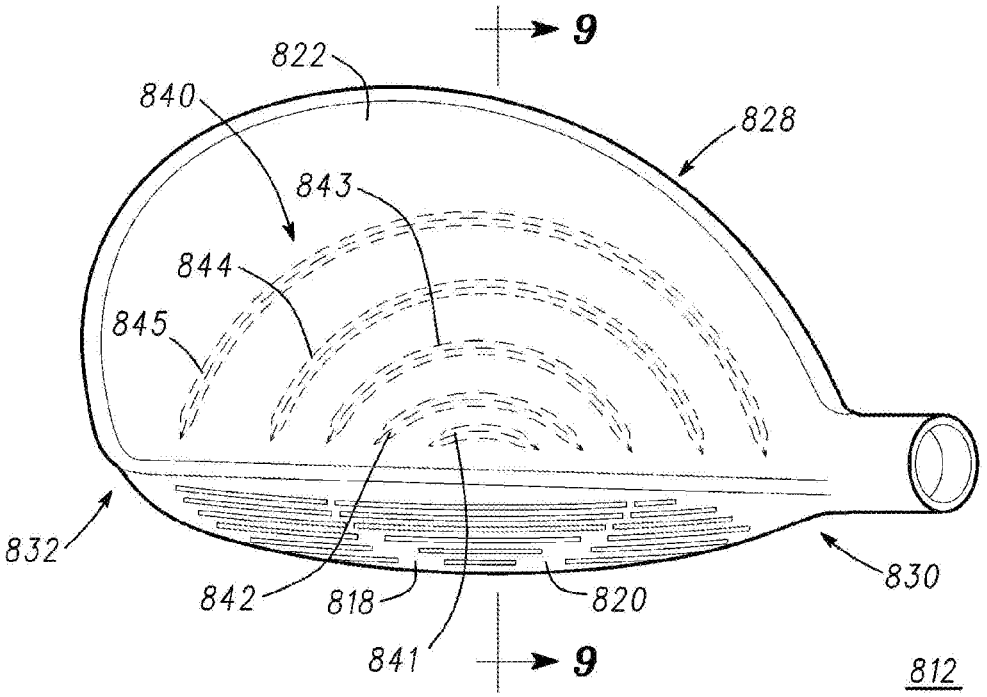
FIG. 8 is a top view of a golf club head, according to a fourth embodiment.
Figure 9:
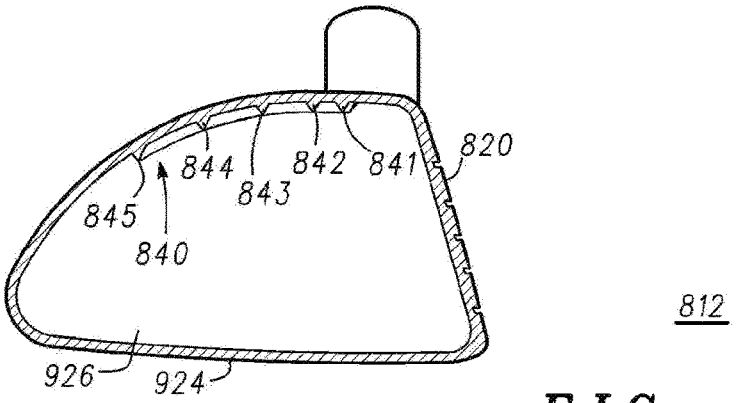
FIG. 9 is a full cross-sectional view of the club head of FIG. 8 viewed from the side.

FIG. 8 illustrates another embodiment of a golf club head. FIG. 9 illustrates a cross-sectional view of the embodiment of FIG. 8 taken at the lines labeled "9." Golf club head 812 (FIG. 8) includes a hollow body 818 (FIG. 8) with a front wall 820 (FIG. 8), a crown 822 (FIG. 8), a sole 924 (FIG. 9), a side wall 926 (FIG. 9) connecting crown 422 and sole 524, a heel end 830 (FIG. 8), a toe end 832 (FIG. 8), and a rear side 828 (FIG. 8) that is opposite of front wall 820. In addition, golf club head 812 can also include ribs 840 (FIG. 8) that extend downwardly from the lower surface of crown 822. In the example of the embodiment illustrated in FIG. 8, ribs 840 comprise ribs 841, 842, 843, 844, and 845 that have a first end that is proximal to toe end 832 and a second end that is proximal to heel end 830.

In some examples, one or more of ribs 840 can be curved. As an example, each of ribs 841, 842, 843, 844, and 845 are curved in the example of FIG. 8. In other examples, however, some of ribs 840 may not be curved. For example, rib 841 can be linear.

Each of ribs 840 of FIG. 8 are curved. In some examples, ribs 840 are all curved in the same direction. For example, ribs 841, 842, 843, 844, and 845 are curved concavely with respect to front wall 820. Therefore, the first end and second end of ribs 840 are curved toward front wall 820. It should be noted that there may be alternate curve arrangements for ribs 840. For example, some of ribs 840 may have a first end that is proximal to front wall 820 and a second end that is proximal to rear side 828. In addition, there may be less or more than six ribs 840.

Each of ribs 840 has a radius of curvature. In some examples, each of ribs 840 has a different radius of curvature. In other examples, some of the radii can be approximately equal.

In the example of golf club head 812 illustrated in FIG. 8, rib 841 has the smallest radius of curvature. The radius of curvature of the subsequent ribs increases the closer the rib is to rear end 828. For example, the radius of curvature of rib 842 is greater than that of rib 841; the radius of curvature of rib 843 is greater than that of rib 842; the radius of curvature of rib 844 is greater than that of rib 843; and the radius of curvature of rib 845 is greater than that of rib 844. In other examples the radii of curvature of ribs 840 can decrease for each rib that is closer to rear end 828. In yet other examples, the radii of curvature of ribs 840 have no relation to the rib's position relative to rear end 828.

In the same or other examples, the radii of curvature for the ribs can be such that the ribs are concentric. If each of ribs 840 was extrapolated to complete a circle, the resulting circles would be concentric. In other examples, the radii of curvature for ribs 840 are not concentric.

Each of ribs 840 has a width dimension. In the example of FIG. 8, each of ribs 840 has a width that is approximately equal to the other ribs. In other examples, ribs 840 can have widths that are not equal to the other ribs. In some examples, each of ribs 840 has a tapering first end and a tapering second end. In other examples, there is no tapering of the first end and/or the second end.

In addition, each of ribs 840 has a height dimension. The height dimension is a measure of the (curved) distance that a rib extends from crown 822 into hollow body 818. In the example of FIG. 9, each of ribs 840 has a height that is approximately equal to the heights of the other ribs. In other examples, ribs 840 can have heights that are not equal to the other ribs.

Each of ribs 840 has a length dimension also. The length dimension is a measure of the distance between a rib's first end and its second end. In the example of FIG. 8, the ribs closer to rear side 828 have a greater length than the ribs closer to front wall 820. As an example, rib 845 has the greatest length; the length of rib 844 is greater than that of rib 843; the length of rib 843 is greater than that of rib 842; and the length of rib 842 is greater than that of rib 841. In other examples, all of ribs 840 have an approximately equal length.

Figure 10:
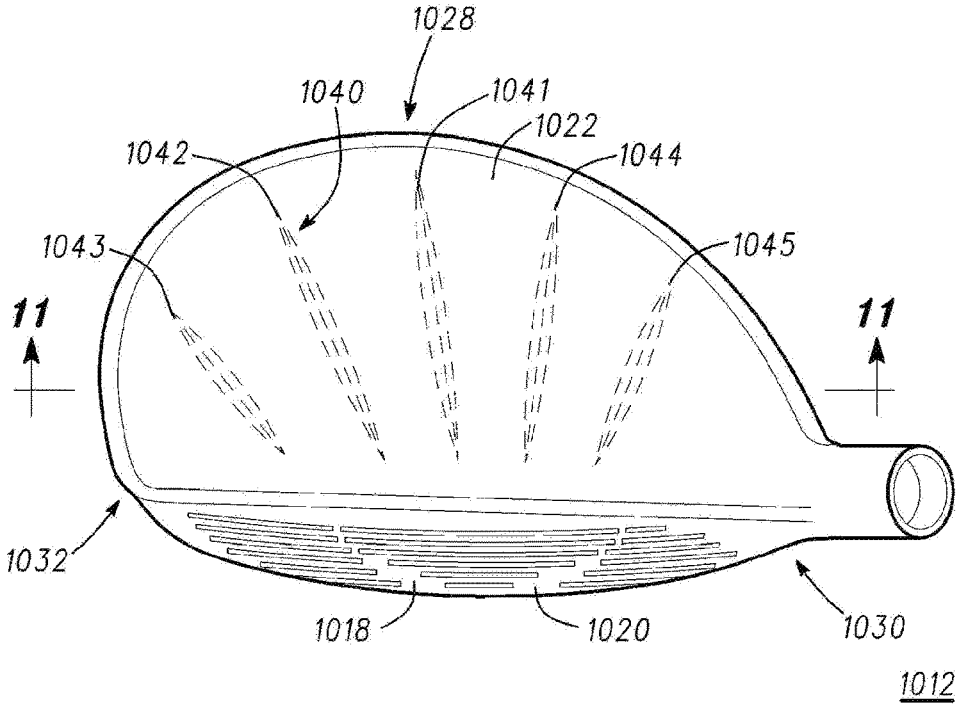
FIG. 10 is a top view of a golf club head, according to a fifth embodiment.
Figure 11:
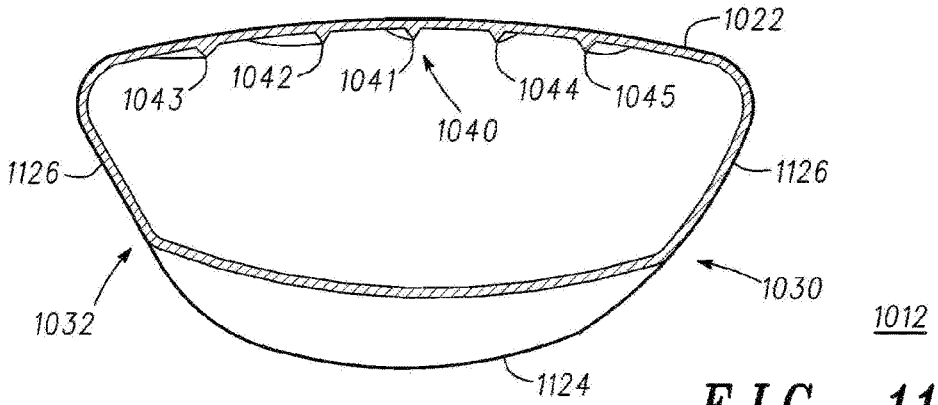
FIG. 11 is a full cross-sectional view of the club head of FIG. 10 viewed from the front.

In addition to having curved ribs, a golf club head can have ribs that have varying widths. For example. FIG. 10 illustrates another embodiment of a golf club head. FIG. 11 illustrates a cross-sectional view of the embodiment of FIG. 10 taken at the lines labeled "11." Golf club head 1012 (FIG. 10) includes a hollow body 1018 (FIG. 10) with a front wall 1020 (FIG. 10), a crown 1022 (FIG. 10), a sole 1124 (FIG. 11), a side wall 1126 (FIG. 11) connecting crown 1022 and sole 1124, a heel end 1030 (FIG. 10), a toe end 1032 (FIG. 10), and a rear side 1028 (FIG. 10) that is opposite of front wall 1020. In addition, golf club head 1012 can also include ribs 1040 (FIG. 10) that extend downwardly from the lower surface of crown 1022. In the example of the embodiment illustrated in FIG. 10, ribs 1040 comprise ribs 1041, 1042, 1043, 1044, and 1045 that have a first end that is proximal to front wall 1020 and a second end that is proximal to rear end 1028.

In some examples, one or more of ribs 1040 are linear. As an example, each of ribs 1041, 1042, 1043, 1044, and 1045 are linear in the example of FIG. 10. In other examples, however, some of ribs 1040 may not be linear. For example, one or more of ribs 1040 can be curved. In some examples, ribs 1040 are arranged so that each of the axes of ribs 1040 converge at a common point. In some examples, the common point is forward of the front wall. In other examples, each of the axes of ribs 1040 do not converge at a common point.

Each of ribs 1040 has a width dimension. In the example of FIG. 10, each of ribs 1040 has a width that tapers. For example, the width of each of ribs 1040 decreases from its midpoint to its first end and its second end. As demonstrated in FIG. 10, the width at the midpoint of each of ribs 1040 can be approximately equal to the width of each of the other ribs at their respective midpoints. In other examples, ribs 1040 can have widths at their midpoints that are not equal to the width of the other ribs at their respective midpoints.

The widths of ribs 1040 can taper at any rate. For example, as illustrated in FIG. 10, the widths can have a smooth, non-constant tapering, giving ribs 1040 the shape of an elongated oval. In other examples, the widths can taper in a linear or constant manner, giving ribs 1040 a shape similar to that of a diamond.

In addition, each of ribs 1040 has a height dimension. The height dimension is a measure of the distance that a rib extends from crown 1022 into hollow body 1018. In the example of FIG. 11, each of ribs 1040 has a height that tapers. For example, the height of each of ribs 1040 decreases from its midpoint to its first end and its second end. As demonstrated in FIG. 11, each of ribs 1040 can have a height that is approximately equal to the heights of the other ribs at their respective midpoints. In other examples, ribs 1040 can have heights at their midpoints that are not equal to the height of the other ribs at their respective midpoints.

The heights of ribs 1040 can taper at any rate. For example, as illustrated in FIG. 11, the widths can have a smooth, non-constant tapering, giving ribs 1040 a smooth contour. In other examples, the widths can taper more drastically or in a linear or constant manner, giving ribs 1040 a shape having a much more pointed height at the midpoint of ribs 1040.

Each of ribs 1040 has a length dimension also. The length dimension is a measure of the distance between a rib's first end and its second end. In the example of FIG. 10, the ribs closer to the midpoint between toe end 1032 and heel end 1030 have a greater length than the ribs closer to toe end 1032 or heel end 1030. As an example, rib 1041 has the greatest length; the length of rib 1042 is greater than that of rib 1043; and the length of rib 1044 is greater than that of rib 1045. In other examples, all of ribs 1040 have an approximately equal length.

Figure 12:
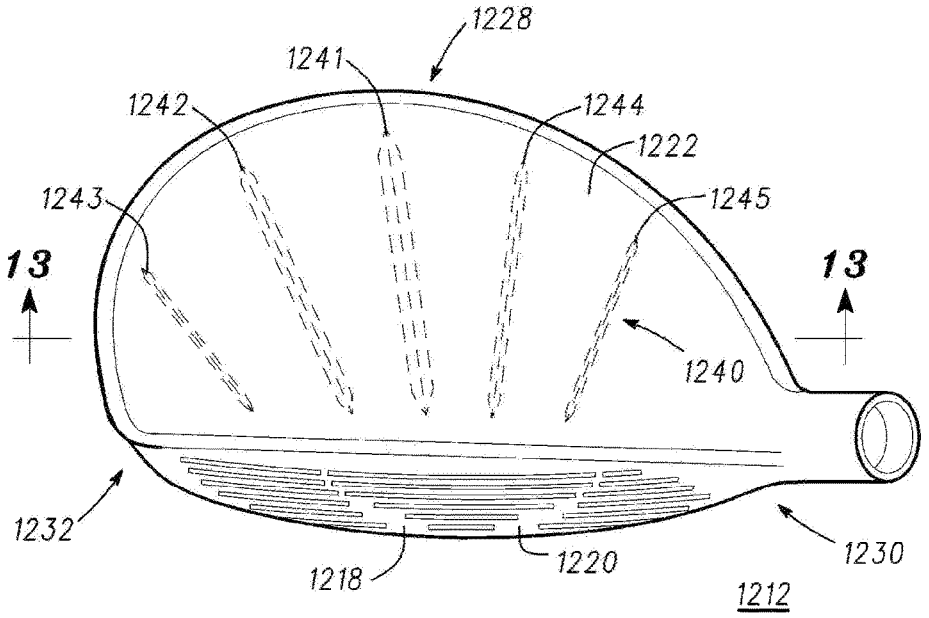
FIG. 12 is a top view of a golf club head, according to a sixth embodiment.
Figure 13:
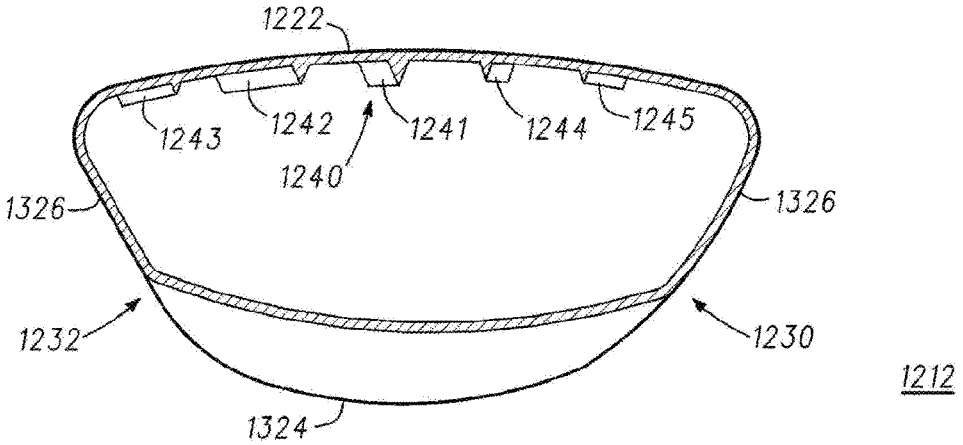
FIG. 13 is a full cross-sectional view of the club head of FIG. 12 viewed from the front.

FIG. 12 illustrates another embodiment of a golf club head. FIG. 13 illustrates a cross-sectional view of the embodiment of FIG. 12 taken at the lines labeled "13." Golf club head 1212 (FIG. 12) includes a hollow body 1218 (FIG. 12) with a front wall 1220 (FIG. 12), a crown 1222 (FIG. 12), a sole 1324 (FIG. 13), a side wall 1326 (FIG. 13) connecting crown 1222 and sole 1324, a heel end 1230 (FIG. 12), a toe end 1232 (FIG. 12), and a rear side 1228 (FIG. 12) that is opposite of front wall 1220. In addition, golf club head 1212 can also include ribs 1240 (FIG. 12) that extend downwardly from the lower surface of crown 1222. In the example of the embodiment illustrated in FIG. 12, ribs 1240 comprise ribs 1241, 1242, 1243, 1244, and 1245 that have a first end that is proximal to front wall 1220 and a second end that is proximal to rear end 1228.

In some examples, one or more of ribs 1240 are linear. As an example, each of ribs 1241, 1242, 1243, 1244, and 1245 are linear in the example of FIG. 12. In other examples, however, some of ribs 1240 may not be linear. For example, one or more of ribs 1240 can be curved. In some examples, ribs 1240 are arranged so that each of the axes of ribs 1240 converge at a common point. In some examples, the common point is forward of the front wall. In other examples, each of the axes of ribs 1240 do not converge at a common point.

Each of ribs 1240 has a width dimension. In the example of FIG. 12, each of ribs 1240 has a width that remains substantially constant. In some examples, the width of each of ribs 1240 tapers at its first end and its second end. In other examples, the width of each of ribs 1240 does not taper at its first and/or second end. As demonstrated in FIG. 12, the width of each of ribs 1040 can vary. For example, the closer a rib is to the midpoint between toe end 1232 and heel end 1230, the greater the width of that particular rib. As illustrated in FIG. 12, rib 1241 can have the largest width; the width of rib 1242 is greater than width of rib 1243; and the width of rib 1244 is greater that the width of rib 1245. In some examples, the widths of ribs 1240 are symmetric across golf club head 1212. For example, the width of rib 1243 is approximately equal to the width of rib 1245, and the width of rib 1242 is approximately equal to the width of rib 1244. In other examples, the widths of ribs 1240 are asymmetric across golf club head 1212. In yet other examples, the widths of ribs 1240 can change such as, for example, by increasing the closer the rib is to toe end 1232 or heel end 1230. In further examples, the widths of ribs 1240 have no correlation to the rib's position relative to toe end 1232 and/or heel end 1230. Ribs 1240 can be positioned so that the ribs with greater widths can be placed in areas of higher vibration.

In addition, each of ribs 1240 has a height dimension. The height dimension is a measure of the distance that a rib extends from crown 1222 into hollow body 1218. In the example of FIG. 13, each of ribs 1240 has a height that remains substantially constant. As also demonstrated in FIG. 13, each of ribs 1240 can have a height that is different from the height of at least one of the other ribs. In some examples, the height of ribs 1240 increases the closer a rib is to the midpoint between toe end 1232 and heel end 1230. As illustrated in FIG. 12, rib 1241 can have the largest height; the height of rib 1242 is greater than height of rib 1243; and the height of rib 1244 is greater that the height of rib 1245. In some examples, the heights of ribs 1240 are symmetric across golf club head 1212. For example, the height of rib 1243 is approximately equal to the height of rib 1245, and the height of rib 1242 is approximately equal to the height of rib 1244. In other examples, the heights of ribs 1240 are asymmetric across golf club head 1212. In yet other examples, the heights of ribs 1240 can change, such as, for example, by increasing the closer the rib is to toe end 1232 and heel end 1230. In further examples, the height of ribs 1240 has no correlation to the rib's position relative to toe end 1232 and/or heel end 1230. Ribs 1240 can be positioned so that the ribs with greater heights can be placed in areas of higher vibration.

Each of ribs 1240 has a length dimension also. The length dimension is a measure of the distance between a rib's first end and its second end. In the example of FIG. 12, the ribs closer to the midpoint between toe end 1232 and heel end 1230 have a greater length than the ribs closer to toe end 1232 or heel end 1230. As an example, rib 1241 has the greatest length; the length of rib 1242 is greater than that of rib 1243; and the length of rib 1244 is greater than that of rib 1245. In other examples, all of ribs 1240 have an approximately equal length.

In other embodiments, ribs can have widths and/or heights that taper and vary from one rib to the next. For examples, ribs can have tapering widths as illustrated by ribs 1040 of FIG. 10, and ribs can have varying widths as illustrated by ribs 1240 of FIG. 12. In addition, ribs can have tapering heights as illustrated by ribs 1040 of FIG. 11, and ribs can have a varying heights as illustrated by ribs 1240 of FIG. 13.

In another embodiment, a method of providing a golf club head is provided. The method of providing a golf club head can include providing a body having a heel end, a toe end, a crown having an upper surface and a lower surface, a sole, a front wall, a rear side, and ribs extending from a first end to a second end and extending downwardly from the lower surface of the crown. In addition, the ribs can comprise a first rib and at least one second rib that is curved. As an example, the heel end can be heel end 430 (FIG. 4), heel end 630 (FIG. 6), or heel end 830 (FIG. 8); the toe end can be toe end 432 (FIG. 4), toe end 632 (FIG. 6), or toe end 832 (FIG. 8); the crown can be crown 422 (FIG. 4), crown 622 (FIG. 6), or crown 822 (FIG. 8); the sole can be sole 524 (FIG. 5), sole 724 (FIG. 7), or sole 924 (FIG. 9); the front wall can be front wall 420 (FIG. 4), front wall 620 (FIG. 6), or front wall 820 (FIG. 8); the rear side can be rear side 428 (FIG. 4), rear side 628 (FIG. 6), or rear side 828 (FIG. 8); and ribs can be ribs 440 (FIG. 4), ribs 640 (FIG. 6), or ribs 840 (FIG. 8).

In one example, the ribs can be provided to be integral with the body. In other examples, the ribs can be provided to be initially separate from the body. Afterwards, the ribs can be coupled to the body by way of a brazing technique, a welding technique, or an adhesive.

In yet another embodiment, a method of providing a golf club head is provided. The method of providing a golf club head can include providing a body having a heel end, a toe end, a crown having an upper surface and a lower surface, a sole, a front wall, a rear side, and generally linear ribs extending downwardly from the lower surface of the crown and extending from a first end proximal the front wall to a second end proximal the rear side. In some examples, the ribs can have a tapering width from its midpoint towards its ends. In the same or other examples, the widths of at least two of the ribs are different. As an example, the heel end can be heel end 1030 (FIG. 10) or heel end 1230 (FIG. 12); the toe end can be toe end 1032 (FIG. 10) or toe end 1232 (FIG. 12); the crown can be crown 1022 (FIG. 10) or crown 1222 (FIG. 12); the sole can be sole 1124 (FIG. 11) or sole 1324 (FIG. 13); the front wall can be front wall 1020 (FIG. 10) or front wall 1220 (FIG. 12); the rear side can be rear side 1028 (FIG. 10) or rear side 1228 (FIG. 12); and ribs can be ribs 1040 (FIG. 10) or ribs 1240 (FIG. 12).

In one example, the ribs can be provided to be integral with the body. In other examples, the ribs can be provided to be initially separate from the body. Afterwards, the ribs can be coupled to the body by way of a brazing technique, a welding technique, or an adhesive.

Figure 14:
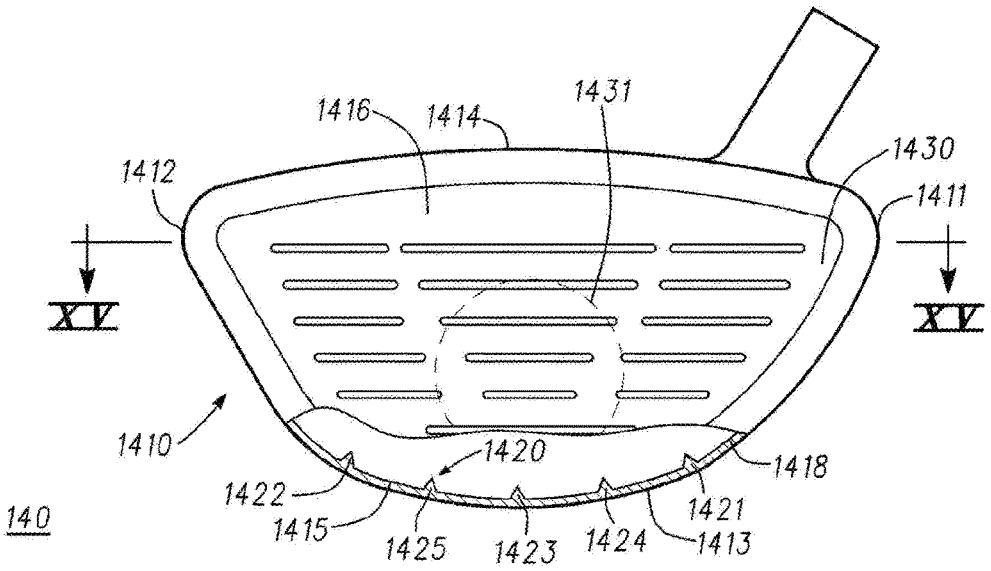
FIG. 14 is a partial front cross-sectional view of a golf club head according to another embodiment.
Figure 15:
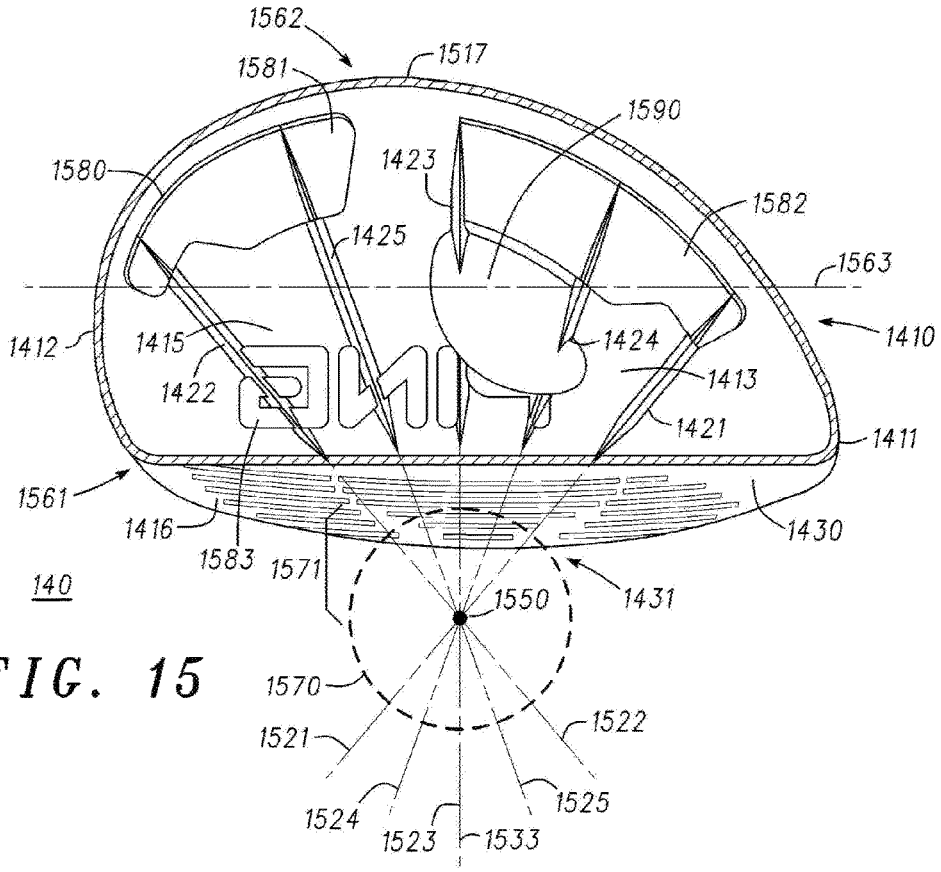
FIG. 15 is a top cross-sectional view of the golf club head of FIG. 14 with respect to line XV-XV of FIG. 14.

Continuing with the figures, FIG. 14 illustrates a partial front cross-sectional view of golf club head 140. FIG. 15 illustrates a top cross-sectional view of golf club head 140 with respect to line XV-XV of FIG. 14. Golf club head 140 is similar to other golf club heads presented herein, such as golf club head 12 (FIGS. 1-4), but differs by comprising ribs 1420 located at rib surface 1415, where rib surface 1415 is defined by the extension of ribs 1420 and the space therebetween. In the present example, ribs 1420 comprise a single piece of material with rib surface 1415, but there may be other embodiments where ribs 1420 may not be integral with rib surface 1415 and could be secured thereto via one or more mechanical or chemical fasteners.

Oftentimes, players or users of golf clubs can be able to gauge the quality of their hits based on the sound that the golf club head makes at impact with a golf ball. The ability to keep a consistent sound at impact can thus be an advantage for keeping such players or users within their comfort zone and/or for maintaining expectations regarding such sound/quality relationship. Considering the above, ribs 1420 can be configured in some embodiments to channel stresses and/or vibrations to achieve a desired impact sound when golf club head 140 impacts a golf ball such as golf ball 1570 (FIG. 15). Such a characteristic may be valuable to maintain and/or restore a desired sound characteristic for the golf club head design, such as when the desired sound characteristic would otherwise be altered as a result of other modifications or improvements made to the structure of the golf club head design in search of better performance. In addition, as previously described with respect to other golf club heads herein disclosed, ribs 1420 may add reinforcement characteristics to the portion of the club head where rib surface 1415 is located to better dissipate or channel stress or impact forces.

Golf club head 140 comprises body 1410 having heel end 1411, toe end 1412, sole 1413, crown 1414, front surface 1416 (comprising strike face 1430 and target strike zone 1431), rear surface 1517 (FIG. 15), and skirt portion 1418. Body 1410 also comprises rib surface 1415, from which ribs 1420 protrude. In the present example, ribs 1420 comprise rib 1421 with rib longitudinal axis 1521 (FIG. 15), rib 1422 with rib longitudinal axis 1522 (FIG. 15), and rib 1423 with rib longitudinal axis 1523 (FIG. 15), where rib longitudinal axes 1521-1523 intersect external to body 1410 at common point 1550 (FIG. 15). Rib 1421 is located closest to heel end 1411, rib 1422 is located closest to toe end 1412 of body 1410, and rib 1423 is located between ribs 1411 and 1412. Ribs 1420 are arranged on or over rib surface 1415 in a substantially radial pattern in the present example, forming a fan-like shape between rib 1421 and rib 1422. Common point 1550 is located forward of front surface 1416 in the present embodiment, but there can be embodiments where common point 1550 is located elsewhere external to body 1410. As an example, a different embodiment could comprise ribs similar to ribs 1420 but configured to intersect at a common point located behind rear surface 1517.

Ribs 1420 also comprise rib 1424 with longitudinal axis 1524, and rib 1425 with longitudinal axis 1525. In the present example, longitudinal axes 1524 and 1525 also intersect at common point 15500 with longitudinal axes 1521-1523. There can be other embodiments, however, where not all longitudinal axes of ribs 1420 need to intersect at common point 15500. As an example, there can be embodiments where longitudinal axes 1524 and 1525 may intersect each other external to body 1410 but elsewhere other than at common point 15500. Other embodiments may comprise a different number of ribs. As an example, ribs 1423-25 may be absent in some embodiments, such that ribs 1420 would comprise only two ribs. As another example, some embodiments may comprise more than five ribs, such as an embodiment with 10 ribs similar to that described with respect to FIGS. 1-3 but with ribs at sole 24 (FIG. 3). Some of such embodiments may comprise ribs that may not intersect with all of the other ribs thereof.

In the present example of FIG. 15, rib surface 1415 is located at sole 1413 internal to body 1410, such that ribs 1420 are also internal to body 1410 and invisible at sole 1413 opposite rib surface 1415. In other examples, however, ribs 1420 may be external to body 1410, where rib surface could be located, instead, at an exterior surface of crown 1414 or at an exterior surface of sole 1413. Ribs 1420 are non-convex relative to crown 1414, and thus can be concave or substantially flat relative to crown 1414 in the present or other examples. Rib surface 1415 extends past sole 1413 into part of skirt portion 1418 of body 1410. There can be other embodiments, however, where ribs 1420 need not extend into skirt portion 1418. In some examples, extending ribs 1420 into skirt portion 1418 can be beneficial for reinforcing one or more sections of skirt portion 1418, and/or for tuning the impact sound of golf club head 140.

As can be seen in FIG. 15, each of ribs 1420 are spaced apart from front surface 1416 and from rear surface 1517. Such a characteristic can be beneficial, for example, so as to not interfere with the bending or deformation of the transition region between front surface 1416 and the rest of body 1410 upon impact with a golf ball. Also in the present example, different ribs of ribs 1420 are separated by different distances from front surface 1416 along their respective longitudinal rib axes. As an example, rib 1423 is spaced apart from front surface 1416 along rib longitudinal axis 1523 by a distance greater than the distance spacing apart ribs 1421 and/or 1422 from front surface 1416 along rib longitudinally axes 1521 and/or 1522, respectively. In the present embodiment, rib 1421 is spaced apart from front surface 1416 by approximately 1.732 cm, rib 1422 is spaced apart from front surface 1416 by approximately 1.638 cm, rib 1423 is spaced apart from front surface 1416 by approximately 1.742 cm, rib 1424 is spaced apart from front surface 1416 by approximately 1.737 cm, and rib 1425 is spaced apart from front surface 1416 by approximately 1.709 cm. Such different spacing may be valuable in some examples for influencing or tuning the stiffness of the transition region between strike face 1430 and sole 1413 to control one or more attributes of golf club head 140, such as a characteristic time, a coefficient of restitution, an impact sound, and/or a feel thereof. In other examples, ribs 1420 may be equally spaced apart from front surface 1416.

In the present embodiment, rib 1421 comprises a length of approximately 4.1 cm, rib 1422 comprises a length of approximately 7.3 cm, rib 1423 comprises a length of approximately 8.6 cm, and rib 1424 comprises a length of approximately 6.5 cm, rib 1425 comprises a length of approximately 8.8 cm. The lengths of ribs 1420 can extend through and/or above indentations or other features of rib surface 1415, such as indentations 1580 including indentations 1581-1583. Indentations 1580 may thus partially engulf one or more portions of one or more of ribs 1420, as can be seen in the example of FIG. 15. As an example, parts of the top of ribs 1422 and 1425 are shown protruding above indentation 1581, while parts of the top of ribs 1421, 1424, and 1423 are shown protruding above indentation 1582. As another example, parts of ribs 1422-1425 are shown protruding above indentations 1583. Indentations 1581-1583 all protrude from rib surface 1415 into an interior of golf club head 140 in the embodiment of FIGS. 14-15, where indentations 1581-1582 delineate pockets into which external weights can be attached to an exterior surface of golf club head 140, and where indentations 1583 can correspond to a logo or other design located or embossed at rib surface 1415. There can be other embodiments, however, where one or more of ribs 1420 may not protrude above one or more of indentations 1580. As an example, in another embodiment, ribs 1420 may protrude above indentations 1583, while the length of one or more of ribs 1420 may end at the interface with one or more of indentations 1581-1582. In the same or other embodiments, one or more of indentations 1580 may completely engulf at least one portion of one or more of ribs 1420.

Ribs 1420 can be configured to comprise a maximum width of approximately 4.5 millimeters (mm) to approximately 5 mm, and/or a maximum thickness of approximately 0.5 to approximately 1.0 mm in some embodiments. More specifically, in the present example of FIGS. 14-15, the maximum width of ribs 1420 can be of approximately 4.8 mm, and the maximum thickness of ribs 1420 can be approximately 0.76 mm.

Ribs 1420 are non-intersected by any rib in the present example. In addition, the thickness and width of ribs 1420 blend into rib surface 1415 proximate to front surface 1416. Such characteristics may permit ribs 1420 to better pick up or channel stresses and/or vibrations along their length for dissipation towards or throughout desired portions of body 1410 without interruption or deviation of such channeling by any intersecting rib. The blending of ribs 1420 into rib surface 1415 may also permit a reduction of stress concentration than if ribs 1420 protruded abruptly proximate to front surface 1416. Other embodiments, however, may comprise one or more ribs that may or may not intersect all of ribs 1420, and/or one or more of ribs 1420 that may not blend into rib surface 1415.

In the present example, as can be seen in FIG. 15, adjacent ribs of ribs 1420 diverge from each other towards rear surface 1517, and converge towards each other towards front surface 1416. Also, body 1410 comprises forward portion 1561 and rearward portion 1562, divided by midline 1563 therebetween, where midline 1563 lies generally parallel to front surface 1416 at substantially one-half the distance between a forwardmost point of front surface 1416 and a rearwardmost point of rear surface 1517. In the present example, the front end of each of ribs 1422-1425 lies at forward portion 1561, while the rear end of each of ribs 1422-1425 lies at rearward portion 1562. There can be examples where all of ribs 1420 comprise front ends at forward portion 1561 and rear ends at rearward portion 1562. Also, in the present example, ribs 1420 are located such that their collective center of gravity is located between the center of gravity of golf club head 140 and rear surface 1517. In the same or other examples, the center of gravity of each of ribs 1420 may be located between the center of gravity of golf club head 140 and rear surface 1517. As a result, ribs 1420 may beneficially displace the center of gravity of golf club head 140 rearwards from where it would have otherwise been for better impact and launch characteristics.

The embodiment of FIGS. 14-15 also present a target strike zone 1431 at front surface 1416, configured to be the desired point of impact with a golf ball under most circumstances. In the present example, longitudinal axis 1523 of rib 1423 is substantially perpendicular to strike face 1430, and is aligned with a center of target strike zone 1431. Target strike axis 1533 extends substantially perpendicular to strike face 1430, from a center of target strike zone 1431, where common point 1550 is located along target strike axis 1533 in the present embodiment such that ribs longitudinal axes 1521-1525 of ribs 1421-1425 intersect each other along target strike axis 1533. Rib longitudinal axis 1523 can be collinear with target strike axis 1533.

As seen in FIG. 15, common point 1550 is separated from target strike zone 1431 by distance 1571 comprising approximately a radius of golf ball 1570. In some examples, distance 1571 may be of approximately 21.3 mm, and/or tailored with respect to the radius of a golf ball compliant with the rules of the United States Golf Association (USGA). Currently, the USGA requires conforming golf balls to have a diameter of not less than 1.680 inches (42.67 mm). In other examples, common point 1550 may be separated from target strike zone 1431 by a different distance, such as a distance of a golf ball diameter, instead.

In the present example, golf club head 140 comprises sole weight 1590 located at least partially at sole 1413. Sole weight 1590 is situated at a lowermost portion of sole 1413, so as to more effectively lower the center of gravity of golf club head 140, and the perimeter of sole weight 1590 can be contoured to fill-in the volume of such lowermost portion of sole 1413. In the same or other examples, sole weight 1590 comprises a single piece of material with sole 1413 in the present example, but there may be other examples where sole weight 1590 may comprise a different material or piece than sole 1413, and/or where sole weight 1590 may be affixed to sole 1413 via a mechanical or chemical fastener such as via an adhesive, one or more screws, welding, and/or brazing, among others. As shown in FIG. 15, sole weight 1590 may at least partially engulf one or more ribs of ribs 1420, such as ribs 1423-1424. In the same or other examples, the thickness of sole weight 1590 can engulf a thickness of one or more portions of the engulfed ribs, such as seen with respect to the portions of ribs 1423-1424 that become subsumed into the thickness of sole weight 1590.

Figure 17:
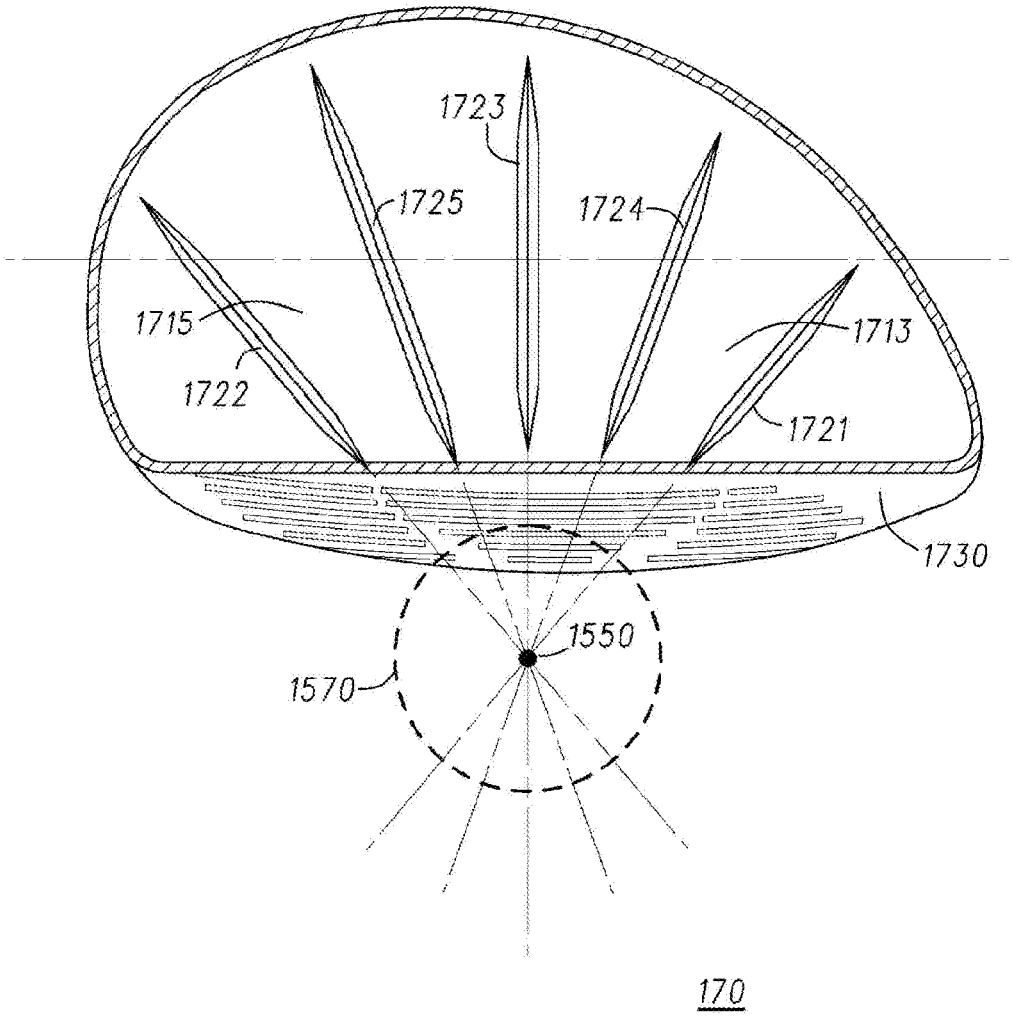
FIG. 17 illustrates a top cross-sectional view of a golf club head similar to the golf club head of FIGS. 14-15 but according to another embodiment.

Skipping ahead in the figures, FIG. 17 illustrates a top cross-sectional view of golf club head 170. In the present example, club head 170 is similar to golf club head 140 (FIGS. 14-15), and comprises ribs 1721-1725 similar to ribs 1421-1425 (FIGS. 14-15). Ribs 1721-1725 are located at rib surface 1715, which is devoid of features such as weight 1590 and indentations 1581-1583 that could otherwise engulf one or more portions of ribs 1721-1725. There can be other examples, however, where one or more indentations like indentations 1581-1583, and/or one or more weights like weight 1590, could be located at rib surface 1715.

Figure 16:
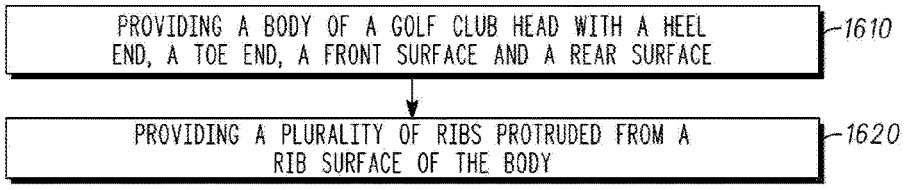
FIG. 16 illustrates a flowchart of a method for providing a golf club head in accordance with examples and embodiments of the present disclosure.

Backtracking through the figures, FIG. 16 illustrates a flowchart of a method 1600 for providing a golf club head. In some examples, the golf club head can be similar to one or more of the golf club heads previously described, such as golf club head 12 (FIGS. 1-3), golf club head 412 (FIGS. 4-5), golf club head 1012 (FIGS. 10-11), golf club head 1212 (FIGS. 12-13), golf club head 140 (FIGS. 14-15), and/or variations thereof.

Block 1610 of method 1600 comprises providing a body of the golf club head with a heel end, a toe end, a sole, a front surface, and a rear surface. As an example, with respect to the embodiment of FIGS. 14-15, the body can be similar to body 1410, the toe end can be similar to toe end 1412, the heel end can be similar to heel end 1411, the sole can be similar to sole 1413, the front surface can be similar to front surface 1416, and the rear surface can be similar to rear surface 1517. Corresponding associations are envisioned for other golf club heads taught herein, or variations thereof.

Block 1620 of method 1600 comprises providing a plurality of ribs protruded from a rib surface of the body. As an example, with respect to the embodiment of FIGS. 14-15, the rib surface can be similar to rib surface 1415, and the plurality of ribs can be similar to a plurality of ribs 1420. For instance, the plurality of ribs may comprise a subset of ribs 1421-1425. Corresponding associations can be made with respect to ribs of the other golf club heads taught herein, or variations thereof. In some embodiments, at least a subset of the plurality of ribs may intersect at a common point external to the body, such as illustrated with respect to common point 1550 located forward of front surface 1416 in FIG. 15, for example. There can be other examples, however, where common point need not be located forward of the front surface of the body. In addition, the plurality of ribs may comprise a single piece of material with the rib surface, or may be attached thereto via a mechanical or chemical fastener.

In some examples, providing the plurality of ribs in block 1620 can comprise providing the rib surface and the plurality of ribs internal to the body; and/or providing the plurality of ribs at the sole of the body. In other examples, the plurality of ribs may be external to the body instead, and/or the plurality of ribs may be provided elsewhere, such as at a crown of the body, and/or at a skirt portion of the body.

There can be examples where different blocks of method 1600 can be combined into a single block or performed simultaneously, and/or the sequence of such blocks can be changed. For example, blocks 1610-1620 may be performed simultaneously, such as by forming the plurality of ribs integrally with the rib surface, where the rib surface comprises one or more portions of one or more parts of the body of the club head. There can also be examples where method 1600 can comprise further or different blocks. As an example, method 1600 can comprise another block for providing a weight similar to sole weight 1590 (FIG. 15), where such weight could engulf one or more portions of one or more of the plurality of ribs of block 1620. Other variations can be implemented for method 1600 without departing from the scope of the present disclosure.

Figure 18:
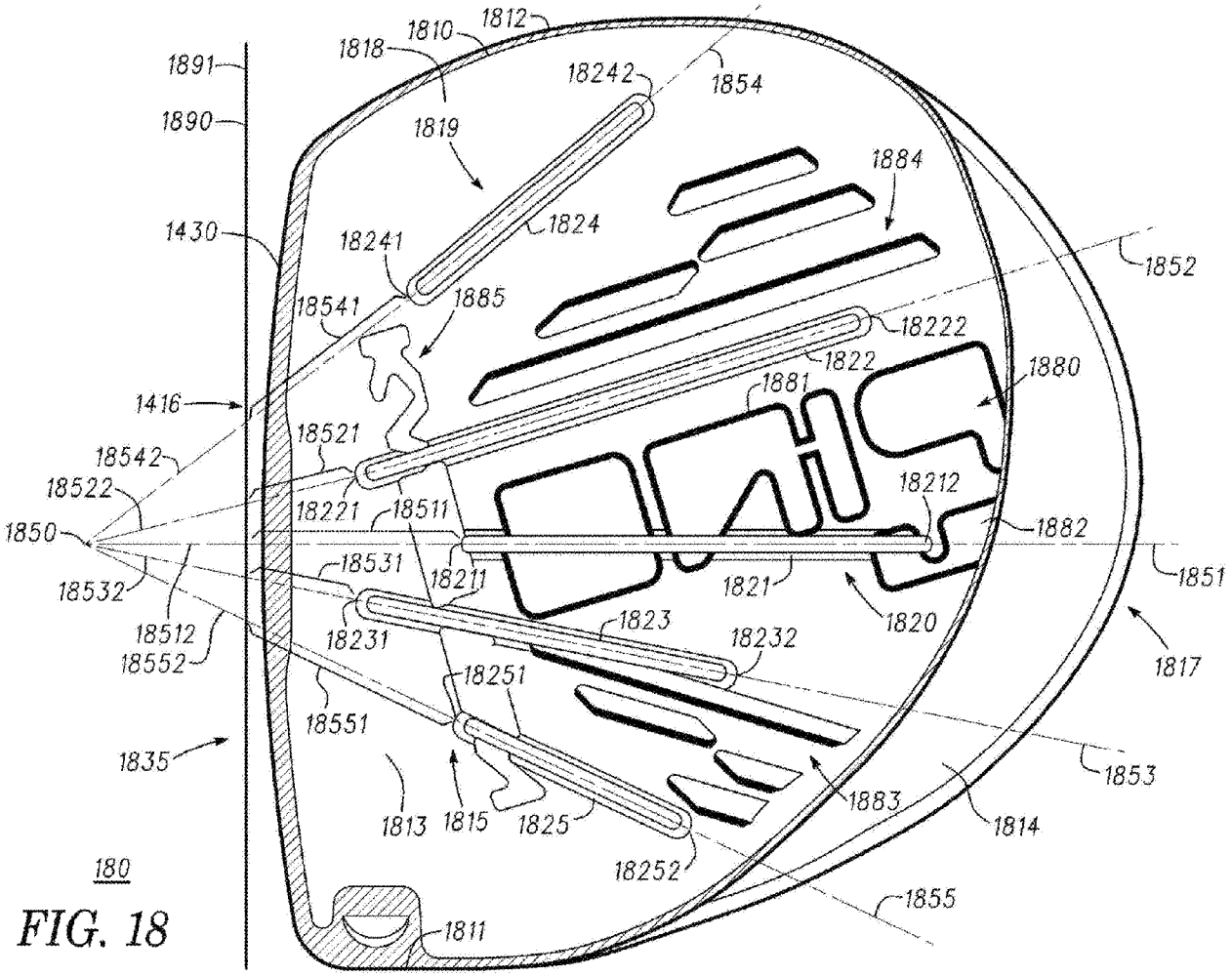
FIG. 18 illustrates a top cross-sectional view of a golf club head according to another embodiment.
Figure 21:
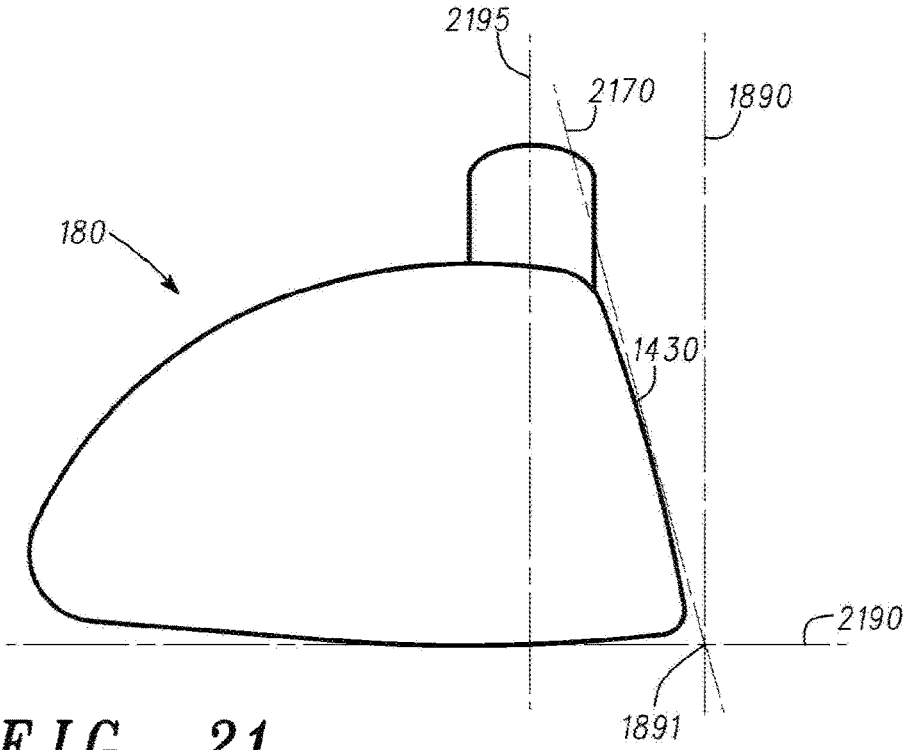
FIG. 21 illustrates a side view of the golf club head of FIG. 18 at address.

Moving along, FIG. 18 illustrates a top cross-sectional view of golf club head 180. Skipping ahead in the figures, FIG. 21 illustrates a side view of golf club head 180 at address. Golf club head 180 comprises several ribs, and is similar in many respects to other golf club heads presented herein, such as golf club head 12 (FIGS. 1-4), golf club head 140 (FIGS. 14-15), and golf club heads 170 (FIG. 17). Golf club head 180 comprises ribs 1820 in a staggered pattern including ribs 1821-1825 that protrude from rib surface 1815. Rib surface 1815 can be similar to rib surface 1415 (FIGS. 14-15), but is defined by the extension of ribs 1820 and the space therebetween. In the present example, ribs 1820 comprise a single piece of material with rib surface 1815, but there may be other embodiments where ribs 1820 need not be integral with rib surface 1815 and could be secured thereto via one or more mechanical, chemical, or other fasteners. Although ribs 1820 are shown in FIG. 18 as straight ribs, there can be embodiments with corresponding curved rib(s) that can still exhibit the staggered pattern characteristics described herein. In such embodiments, the curved rib(s) can curve similar to the ribs in FIGS. 4, 6, and/or 9, among other configurations.

Golf club head 180 comprises body 1810 having heel end 1811, toe end 1812, sole 1813, crown 1814, front surface 1416, (comprising strike face 1430 and target strike zone 1431, as seen in FIG. 14), and rear surface 1817. Golf club head 180 also comprises loft plane 2170 (FIG. 21), which is tangent to a strikeface centerpoint of strikeface 1430. In some examples the strikeface centerpoint can be located at a center of target strike zone 1431 (FIG. 14), and/or may be defined in accordance with the definition of a golf governing body such as the United States Golf Association (USGA). For example, a strikeface centerpoint can be determined in accordance with Section 6.1 of the USGA's Procedure for Measuring the Flexibility of a Golf Clubhead (USGA-TPX3004, Rev. 1.0.0, May 1, 2008) (available at http://www.usga.org/equipment/testing/protocols/Procedure-For-Measuring-The-Flexibility-Of-A-Golf-Club-Head/).

Golf club head 180 can be configured such that, when it is at address, with the vertical component of shaft axis 2195 orthogonal to ground flat surface 2190 as seen in FIG. 21, loft plane 2170 intersects ground flat surface 2190 along front intersection line 1891, from which front plane 1890 extends orthogonal to ground flat surface 2190. In some examples relative distances of ribs 1820 can be measured with respect to front plane 1890 or loft plane 2170.

In the present example, rib surface 1815 is located at sole 1813 and skirt portion 1818, and is internal to body 1810, such that ribs 1820 are also internal to body 1810. Ribs 1821-1823 are located at least partially at sole 1813 in the present example, and extend into skirt portion 1818 along with ribs 1824 and 1825 to reinforce one or more sections of skirt portion 1818. In the same or other examples, such extension of at least some of ribs 1820 into skirt portion 1818 can adjust the impact sound of golf club head 180 to a desired level or frequency. There also can be other examples where rib surface 1815 can be located elsewhere in body 1810, such as at crown 1814, and/or where rib surface 1815 can be located only at sole 1813 or only at skirt portion 1818. Rib surface 1815 also can be located at an exterior of body 1810, and can be visible from the exterior of body 1810 in some implementations, such that ribs 1820 would instead protrude towards the exterior of body 1810.

Ribs 1820 of golf club head 180 are similar to other ribs presented herein, such as ribs 34 of golf club head 12 (FIGS. 1-3), ribs 440 of golf club head 412 (FIGS. 4-5), ribs 640 of golf club head 612 (FIGS. 6-7), ribs 840 of golf club head 812 (FIGS. 8-9), ribs 1040 of golf club head 1012 (FIG. 10), ribs 1240 of golf club head 1212 (FIGS. 12-13), ribs 1420 of golf club head 140 (FIGS. 14-15), and/or the ribs of golf club head 170 (FIG. 17), regardless of whether such ribs are located at the crown, sole, skirt, or other portions of their respective golf club heads. In the present example, ribs 1821-1825 are aligned in a staggered pattern with respect to front surface 1416, front plane 1890, and/or relative to loft plane 2170 (FIG. 21).

Ribs 1820 comprise five ribs (i.e., ribs 1821-1825) in the present implementation. Rib 1821 comprises rib end 18211 and rib end 18212 opposite rib end 18211, where rib axis 1851 extends through rib ends 18211-18212. Rib 1822 comprises rib end 18221 and rib end 18222 opposite rib end 18221, where rib axis 1852 extends through rib ends 18221-18222. Rib 1823 comprises rib end 18231 and rib end 18232 opposite rib end 18231, where rib axis 1853 extends through rib ends 18231-18232. Rib 1824 comprises rib end 18241 and rib end 18242 opposite rib end 18241, where rib axis 1854 extends through rib ends 18241-18242. Rib 1825 comprises rib end 18251 and rib end 18252 opposite rib end 18251, where rib axis 1855 extends through rib ends 18251-18252. There can be other embodiments, however, where ribs 1820 can comprise more or less than five ribs. For example, in one such embodiment, ribs 1820 can comprise a subset of ribs 1821-1825, such as only ribs 1821-1823, or such as only ribs 1821, 1824, and 1825. As another example, in another embodiment, ribs 1820 can comprise further ribs, which may be interspersed proximate or between two or more of ribs 1821-1825.

In the current embodiment, rib 1821 is located between ribs 1822 and 1823; rib 1822 is located between rib 1821 and rib 1824; and rib 1823 is located between rib 1821 and rib 1825. Ribs 1820 are aligned such that rib 1822 is located between rib 1821 and toe end 1812 of body 1810, and such that rib 1823 is located between rib 1821 and heel end 1811 of body 1810. As can be seen in FIG. 8, ribs 1821-1823 are non-intersected by any other rib or each other, although there can be other embodiments where at least some ribs of ribs 1820 can be intersected by other ribs.

Rib 1821 is aligned such that, from the top view perspective of FIG. 18, rib axis 1851 is substantially orthogonal relative to front plane 1890 and substantially aligned with target strike zone 1431 (FIG. 14). There can be other embodiments, however, where rib axis 1851 need not be substantially orthogonal to front plane 1890 and/or where rib axis 1851 need not be substantially aligned with target strike zone 1431, depending on the desired configuration and/or based on the area(s) of body 1810 of golf club head 180 needing reinforcement by ribs 1820.

Ribs 1820 also comprise different lengths relative to each other in the present example. For instance, in the present example, rib 1821 comprises a rib length of approximately 64 mm from rib end 18211 to rib end 18212, rib 1822 comprises a rib length of approximately 70 mm from rib end 18221 to rib end 18222, rib 1823 comprises a rib length of approximately 51 mm from rib end 18231 to rib end 18232, rib 1824 comprises a rib length of approximately 38 mm from rib end 18241 to rib end 18242, and rib 1825 comprises a rib length of approximately 32 mm from rib end 18251 to rib end 18252. In the present example, the rib length of rib 1822 is greater than the rib length of rib 1823 and greater than the rib length of rib 1821. There can be other embodiments, however, where the rib length of rib 1821 can be greater than the rib length of ribs 1822-1823, and/or where the rib lengths of ribs 1822-1823 can be substantially equal to each other.

In some examples, rib lengths for straight ribs, such as ribs 1820, can range individually between approximately 20 mm to approximately 130 mm. In other examples having curved rib(s), such as those having rib(s) with curvature(s)

similar to those of the ribs in FIG. 4, 6 or 9, the rib length for individual ribs can range between approximately 20 mm to approximately 205 mm. In addition, each of ribs 1820 comprises a rib width of approximately 3 mm, but there can be other embodiments where individual rib widths can be of up to approximately 10 mm, where the rib widths can be non-uniform along their rib lengths, and/or where the rib widths can be unique relative to other ribs. Furthermore, each of ribs 1820 comprise a rib height of approximately 3 mm, but there can be other embodiments where individual rib heights can be of up to approximately 10 mm, where the rib heights can be non-uniform along their rib lengths, and/or where the rib heights can be unique relative to other ribs.

Rib axis 1851 comprises distance 18511 between front plane 1890 and rib end 18211. Similarly, rib axis 1852 of rib 1822 comprises distance 18521 between front plane 1890 and rib end 18221, while rib axis 1853 of rib 1823 comprises distance 18531 between front plane 1890 and rib end 18231. In addition, rib axis 1854 of rib 1824 comprises distance 18541 between front plane 1890 and rib end 18241, while rib axis 1855 of rib 1825 comprises distance 18551 between front plane 1890 and rib end 18251. In the present example, distance 18511 can be of approximately 32 mm, distance 18521 can be of approximately 20 mm, distance 18531 can be of approximately 20 mm, distance 18541 can be of approximately 34 mm, and distance 18551 can be of approximately 36 mm. There can also be examples where distances 18511, 18521, 18531, 18541, and/or 18551 can vary within 15% of the numbers listed above. Although distances 18511, 18521, 18531, 18541, and 18551 represent distances between ribs 1820 and front plane 1890, corresponding distances between ribs 1820 and one or both of front surface 1416 or loft plane 2170 (FIG. 21) can be similar to such distances 18511, 18521, 18531, 18541, and/or 18551 in the same or other examples.

As can be seen in FIG. 18, distance 18511 of rib 1821 is greater than distance 18521 of rib 1822, and greater than distance 18531 of rib 1823, such that rib 1821 is further separated from front plane 1890 than either of ribs 1822-1823, thus yielding a staggered pattern therebetween. Although in the present embodiment distance 18531 of rib 1823 is approximately equal to distance 18521 of rib 1822, there can be other embodiments where distances 18521 and 18531 can substantially differ from each other.

In addition, in the present embodiment, distance 18541 of rib 1824 is different than distance 18521 of rib 1822, and different than distance 18511 of rib 1821. For example, distance 18541 is greater than distance 18521 and can be greater than distance 18511 in the present example, although there can be examples where distance 18541 is greater than only one of distance 18521 or distance 18511. In addition, there can be other embodiments where distance 18541 can differ from only one of distance 18521 or distance 18511.

Similarly, in the present embodiment, distance 18551 of rib 1825 is different than distance 18531 of rib 1823, and different than distance 18511 of rib 1821, For example, distance 18551 is greater than distance 18531 and greater than distance 18511 in the present example, though there can be examples where distance 18551 is greater than only one of distance 18531 or distance 18511. In addition, there can be other embodiments where distance 18551 can differ from only one of distance 18531 or distance 18511. Distances 18541 and 18551 can be similar or equal to each other in the present or other embodiments.

Ribs 1820 are also aligned in the present embodiment to intersect, with respect to the top view of FIG. 18, at common point 1850 external to body 1810. In some examples, such alignment may be similar to that of ribs 34 with respect to common point 40 (FIG. 1), and/or ribs 1420 with respect to common point 1550 (FIG. 15). Although each of ribs 1820 intersects at common point 1850 in the present example, there can be other implementations where ribs 1822-1823 do not intersect at common point 1850, or where ribs 1824-1825 do not intersect at common point 1850. Common point 1850 is located forward of front surface 1416, at a distance of approximately a golf ball radius as described above with respect to common point 1550 (FIG. 15). There can be other embodiments, however, where common point 1850 can be otherwise distanced from front surface 1416, and/or where common point 1850 can be located at front surface 1416.

In the present example, ribs 1820 are aligned in a staggered pattern with respect to common point 1850, where the distances between common point 1850 and ribs 1820 vary depending on the rib. For example, rib axis 1851 of rib 1821 comprises extended distance 18512 from common point 1850 to rib end 18211, rib axis 1852 of rib 1822 comprises extended distance 18522 from common point 1850 to rib end 18221, rib axis 1853 of rib 1823 comprises extended distance 18532 from common point 1850 to rib end 18231, rib axis 1854 of rib 1824 comprises extended distance 18542 from common point 1850 to rib end 18241, and rib axis 1855 of rib 1825 comprises extended distance 18552 from common point 1850 to rib end 18251. Extended distance 18512 of rib 1821 is greater than extended distance 18522 of rib 1822, and greater than extended distance 18532 of rib 1823, thus yielding a staggered pattern. In the present embodiment, extended distance 18512 can be of approximately 44 mm, extended distance 18522 can be of approximately 33 mm, extended distance 18532 can be of approximately 33 mm, extended distance 18542 can be of approximately 51 mm, and extended distance 18552 can be of approximately 50 mm. There can also be examples where distances 18512, 18522, 18532, 18542, and/or 18552 can vary within 15% of the numbers listed above.

Figure 19:
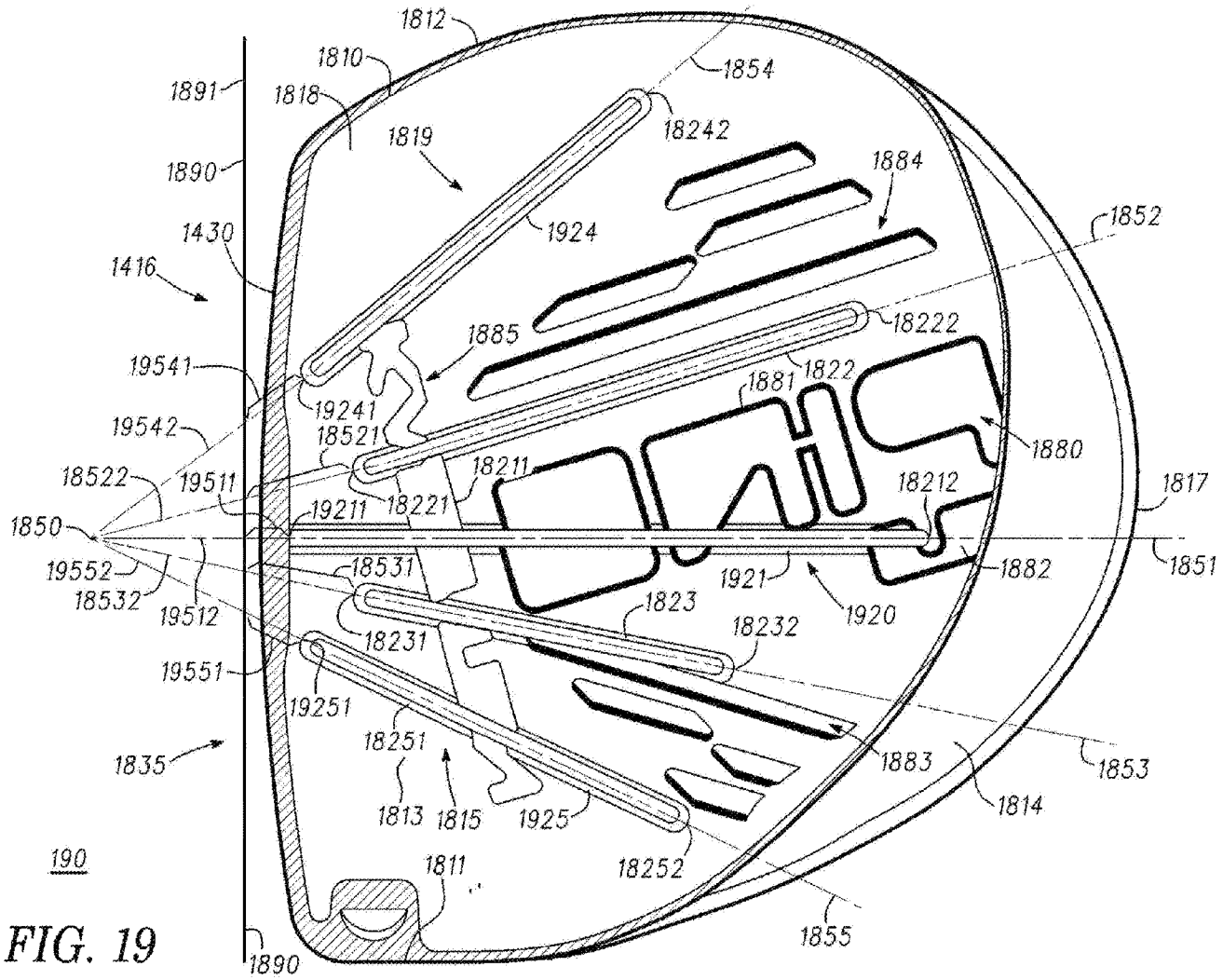
FIG. 19 illustrates a top cross-sectional view of a golf club head according to another embodiment.

FIG. 19 illustrates a top cross-sectional view of golf club head 190. Golf club head 190 is similar to golf club head 180 (FIG. 18), but comprises ribs 1920 staggered in a different pattern than ribs 1820 of golf club head 180. For example, ribs 1920 comprise ribs 1921, 1822, 1823, 1924, and 1925, where ribs 1921, 1924, and 1925 are respectively similar to ribs 1821, 1824, and 1825 of ribs 1820 (FIG. 18), but exhibit different respective rib lengths and respective distances from front plane 1890 than ribs 1821, 1824, and 1825. In particular, rib 1921 extends to front wall 1835 in the present example, such that distance 19511 between front plane 1890 and rib end 19211 of rib 1921 can be similar to the thickness of front wall 1835 at its intersection with rib 1921. Accordingly, distance 19511 of rib 1921 is less than distance 18521 of rib 1822 and less than distance 18531 of rib 1823. In other embodiments, rib 1921 does not extend all the way to front wall 1835, but can still extend closer thereto such that distance 19511 is still less than distance 18521 of rib 1822 and/or less than distance 18531 of rib 1823.

In the present implementation, rib 1921 comprises a rib length of approximately 88 mm from rib end 19211 to rib end 18212, rib 1822 comprises a rib length of approximately 70 mm from rib end 18221 to rib end 18222, rib 1823 comprises a rib length of approximately 51 mm from rib end 18231 to rib end 18232, rib 1924 comprises a rib length of approximately 53 mm from rib end 19241 to rib end 18242, and rib 1925 comprises a rib length of approximately 58 mm from rib end 19251 to rib end 18252. There can also be examples where the rib lengths of ribs 1920 can vary within 15% of the numbers listed above. In addition, each of ribs 1920 comprise substantially a rib width of approximately 3 mm, but there can be other embodiments where such the rib widths can vary within 15% of the rib width listed above, and/or where the rib widths can be non-uniform or unique.

Ribs 1924 and 1925 of ribs 1920 are closer in the present example to front plane 1890 than corresponding ribs 1824 and 1825 of ribs 1820 (FIG. 18). In view of this difference, distance 19541, which extends from front plane 1890 to rib end 19241 of rib 1924, is shorter than distance 18521 of rib 1822. Similarly, distance 19551, which extends from front plane 1890 to rib end 19251 of rib 1925, is shorter than distance 18531 of rib 1823. In the present example, distances 19541 and 19551 are substantially different from each other, but can be approximately equal to each other in other embodiments. The differences between distances 19511, 18521, 18531, 19541, and 19551 described above generate a staggered pattern for ribs 1920 that places ribs 1921, 1924, and 1925 closer to the front of golf club head 190 than ribs 1822 and 1823, where such staggered pattern is thus different than that described above with respect to ribs 1820 in FIG. 18, where ribs 1822 and 1823 are closer to the front of the golf club head than ribs 1821, and 1824, and 1825.

Consistent with the above, in the present example, distance 19511 can be of up to approximately 9 mm, distance 18521 can be of approximately 20 mm, distance 18531 can be of approximately 20 mm, distance 19541 can be of approximately 18 mm, and distance 19551 can be of approximately 10 mm. There can also be examples where distances 19511, 18521, 18531, 19541, and/or 19551 can vary within 15% of the numbers listed above. Although distances 19511, 18521, 18531, 19541, and 19551 represent distances between ribs 1920 and front plane 1890, corresponding distances between ribs 1920 and one or both of front surface 1416 or loft plane 2170 (FIG. 21) can be similar to such distances 19511, 18521, 18531, 19541, and/or 19551 in the same or other examples.

In the present example of FIG. 19, ribs 1920 are also aligned in a staggered pattern with respect to common point 1850, where the distances between common point 1850 and ribs 1920 vary depending on the rib. For example, rib axis 1851 of rib 1921 comprises extended distance 19512 from common point 1850 to rib end 19211, rib axis 1852 of rib 1822 comprises extended distance 18522 from common point 1850 to rib end 18221, rib axis 1853 of rib 1823 comprises extended distance 18532 from common point 1850 to rib end 18231, rib axis 1854 of rib 1924 comprises extended distance 19542 from common point 1850 to rib end 19241, and rib axis 1855 of rib 1925 comprises extended distance 19552 from common point 1850 to rib end 19251. Extended distances 18522 and 18532 can be greater than extended distances 19512, 19542, and 19552, thus yielding a staggered pattern with respect to common point 1850. In the present embodiment, extended distance 19512 can be of approximately 22 mm, extended distance 18522 can be of approximately 33 mm, extended distance 18532 can be of approximately 33 mm, extended distance 19542 can be of approximately 36 mm, and extended distance 19552 can be of approximately 24 mm. There can also be examples where distances 19512, 18522, 18532, 19542, and/or 19552 can vary within 15% of the numbers listed above As can be seen in FIGS. 18-19 golf club heads 180 and 190 have one or more indentation features 1880 which can be similar to indentations 1580 as described above with respect to golf club head 140 (FIGS. 14-15). Indentation features 1880 comprise indentations 1881-1885 distributed throughout different sections of sole 1813 and skirt portion 1818, where at least some of indentation features 1881-1885 can define logos or other designs to decorate and/or to strengthen or reinforce one or more sections of the portion of body 1810 where they are located. Indentations 1880 protrude into the interior of golf club head 180 in the present example, appearing embossed or corrugated from the exterior of golf club head 180, and some of them intersect with ribs 1820 along their respective rib lengths. Accordingly, portions of some ribs 1820 may be at least partially engulfed by indentation features 1880. For example, rib 1821 intersects with, and is partially engulfed by, indentation features 1881, 1882 and 1885 at sole 1813 and skirt portion 1818. Similarly, indentation feature 1885 is intersected by ribs 1822, 1823, and 1825. In addition, indentation feature 1883 is intersected by rib 1823. Not all indentation features 1880, however, need to be intersected by ribs 1820. For example indentation feature 1884 at sole 1813 and skirt portion 1818 is not in contact with any of ribs 1820, and rib 1824 does not intersect any of indentation features 1880.

As mentioned above, the embossed or corrugated configuration of indentation features 1880 can be configured to strengthen or reinforce desired sections of body 1810, such as to compensate for thinner portions thereof, to prevent material failure or deformation due to stresses at impact with a golf ball or a ground surface, and/or to adjust the sound of golf club 180 upon impact with the golf ball. In the present examples of FIGS. 18-19, sole 1813 and/or skirt portion 1818 can comprise a thickness of approximately 0.7 mm. There can be some examples where the thickness of sole 1813 and/or skirt portion 1818 can vary within 15% of the number listed above, and/or where such thickness can be non-uniform across sole 1813 and/or skirt portion 1818.

In some implementations, there may be some sections of body 1810 where it may not be desirable to place any indentation features, such as for aesthetic, design, and/or performance reasons. Such sections may thus be suitable for reinforcement via ribs 1820 rather than via indentation features 1880. As an example, rib surface 1815 comprises clear section 1819 at skirt portion 1818, where clear section 1819 is clear of any indentation features 1880 for design considerations. Nevertheless, by locating rib 1824 to protrude therefrom, clear section 1819 can still be reinforced with respect to strength or sound without having to rely on indentation features 1820. FIG. 19 also comprises indentation features 1880, which relate to sole 1813, skirt portion 1818, and ribs 1920 of golf club head 190 similar to the description above with respect to golf club head 180 in FIG. 18.

Figure 20:
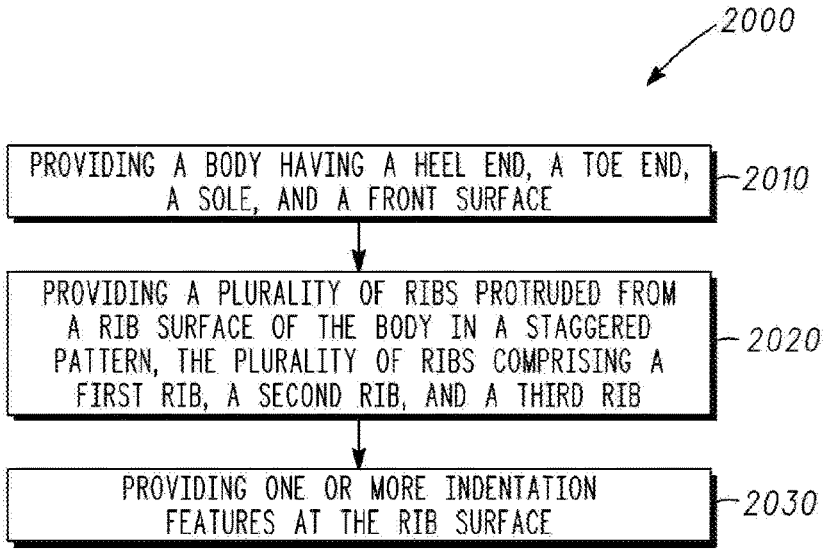
FIG. 20 illustrates a flowchart of a method for providing a golf club head in accordance with examples and embodiments of the present disclosure.

FIG. 20 illustrates a flowchart of a method 2000 for providing a golf club head. In some examples, the golf club head can be similar to one or more of the golf club heads previously described, such as golf club head 12 (FIGS. 1-3), golf club head 412 (FIGS. 4-5), golf club head 1012 (FIGS. 10-11), golf club head 1212 (FIGS. 12-13), golf club head 140 (FIGS. 14-15), golf club head 180 (FIG. 18), golf club head 190 (FIG. 19), and/or variations thereof.

Block 2010 of method 2000 comprises providing a body having a heel end, a toe end, a sole, a front surface, and a rear surface. In some examples, the body can be similar to body 1810 of golf club heads 180 (FIG. 18) or 190 (FIG. 19). The heel end, the toe end, the sole, and the front surface can be respectively similar to heel end 1811, toe end 1812, sole 1813, and front surface 1416 (FIGS. 18-19).

Block 2020 of method 2000 comprises providing a plurality of ribs protruded from a rib surface of the body in a staggered pattern. In some examples, the plurality of ribs can be similar to ribs 1820 (FIG. 18), ribs 1920 (FIG. 19), or variations thereof. The plurality of ribs can comprise first second, and third ribs, which can be similar to ribs 1821, 1822, and/or 1823 of FIG. 18, or to ribs 1921, 1822, and/or 1823 of FIG. 19. In some embodiments, the plurality of ribs can also comprise fourth and fifth ribs, which can be similar to ribs 1824 and/or 1825 of FIG. 18, or to ribs 1924 and/or 1925 of FIG. 19. Some embodiments may comprise more or less ribs, depending on the requirements of the golf club head at issue. In some examples, the staggered pattern for the ribs of method 2000 can be similar to one or more of the staggered pattern options described above with respect to ribs 1820 (FIG. 18) and/or ribs 1920 (FIG. 19).

Method 2000 can also optionally comprise block 2030 for providing one or more indentation features at the rib surface from where the plurality of ribs protrude. In some examples, the indentation features can be similar to indentation features 1880 (FIGS. 18-19) or variations thereof. Some of such indentation features may be intersected by one or more of the plurality of ribs of block 2020. In the same or other examples, the rib surface may comprise a clear section that does not have any indentation features, but that may be reinforced nevertheless by one or more of the plurality of ribs. In some examples, the clear section may be similar to clear section 1819, which is reinforced as described above with respect to FIGS. 18-19.

There can be examples where different blocks of method 2000 can be combined into a single block or performed simultaneously, and/or the sequence of such blocks can be changed. For example, blocks 2010 and 2020 may be performed simultaneously, such as by forming the plurality of ribs integrally with the rib surface, where the rib surface comprises one or more portions of one or more parts of the body of the club head. There can also be examples where method 2000 can comprise further or different blocks. As an example, method 2000 can comprise another block for providing a weight similar to sole weight 1590 (FIG. 15), where such weight can be attached to one or more of the indentation features of block 2030, and/or could engulf one or more portions of one or more of the plurality of ribs of block 2020. Other variations can be implemented for method 2000 without departing from the scope of the present disclosure.

Figure 22:
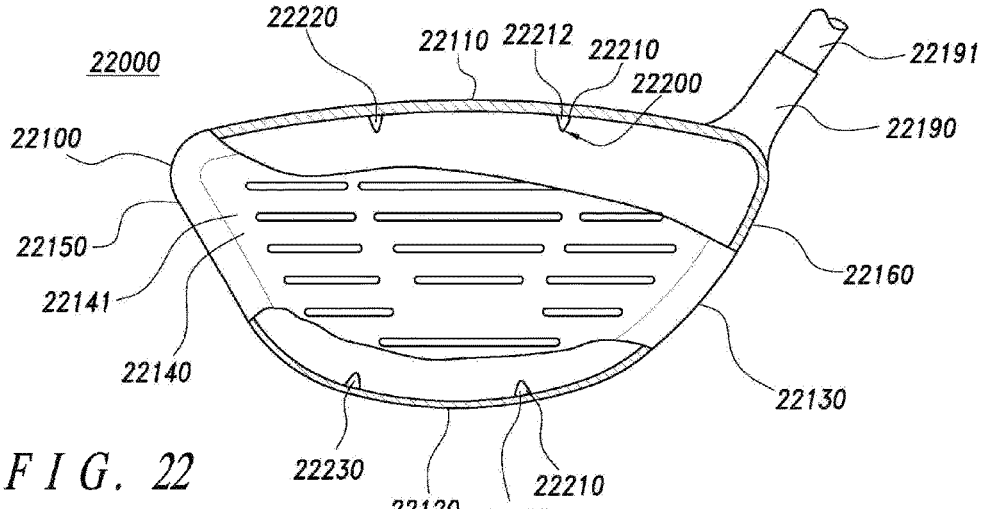
FIG. 22 illustrates a front view of a golf club head with ribs.
Figure 23:
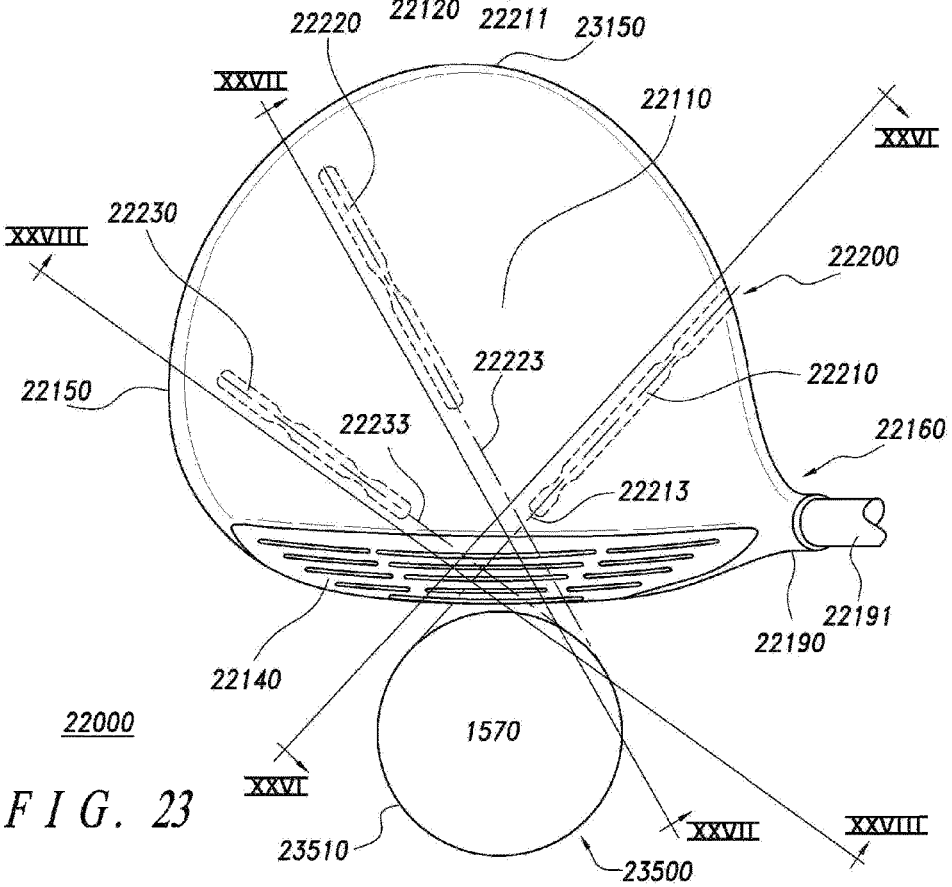
FIG. 23 illustrates a top X-Ray view of the golf club head of FIG. 22.

Moving along, FIG. 22 illustrates a front view of golf club head 22000 comprising body 21200 and ribs 22200 coupled thereto. FIG. 23 illustrates a top X-Ray view of golf club head 22000. In the present example, body 21200 comprises heel end 22160, toe end 22150, crown 22110, sole 22120, skirt 22130, front end 22140, rear end 23150, and hosel 22190, but there can be other examples with more or less sections. Golf club head 22000 and ribs 22200 can be similar to other golf club heads and ribs described herein, and ribs 22200 can be arranged or structured with respect to one or more oscillation amplitude zones of body 21200. A golf club shaft 22191 can be coupled to hosel 22190.

Ribs 22200 comprise ribs 22210, 22220, and 22230 in the present embodiment, where rib 22220 extends along crown 22110, where rib 22230 extends along sole 22120, and where rib 22210 extends continuously from crown 22110 to sole 22120 of golf club head 22000 and in the present example, also extends along skirt 22130 between crown 22110 and sole 22120.

There can be other examples with more or less ribs arranged or structured with respect to more or less oscillation amplitude zones, however.

Figure 24:
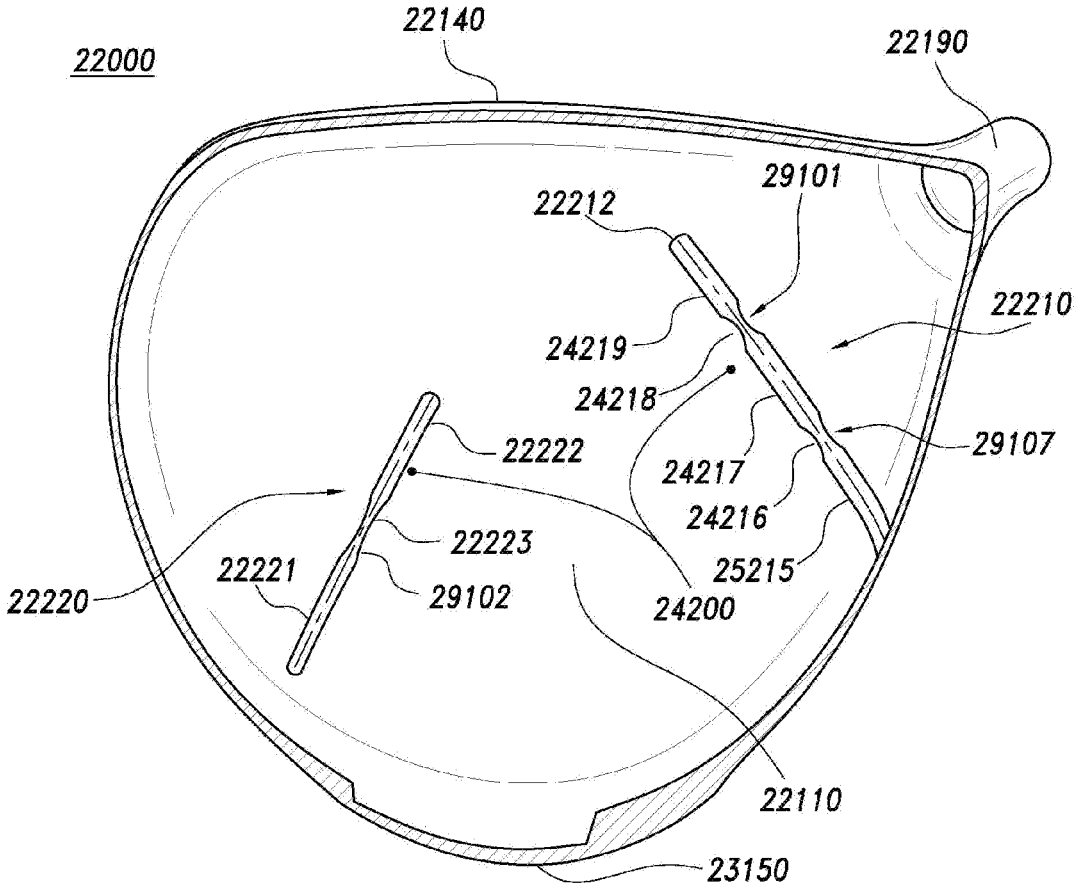
FIG. 24 shows a bottom-up interior view of the crown of the golf club head of FIG. 22.
Figure 25:
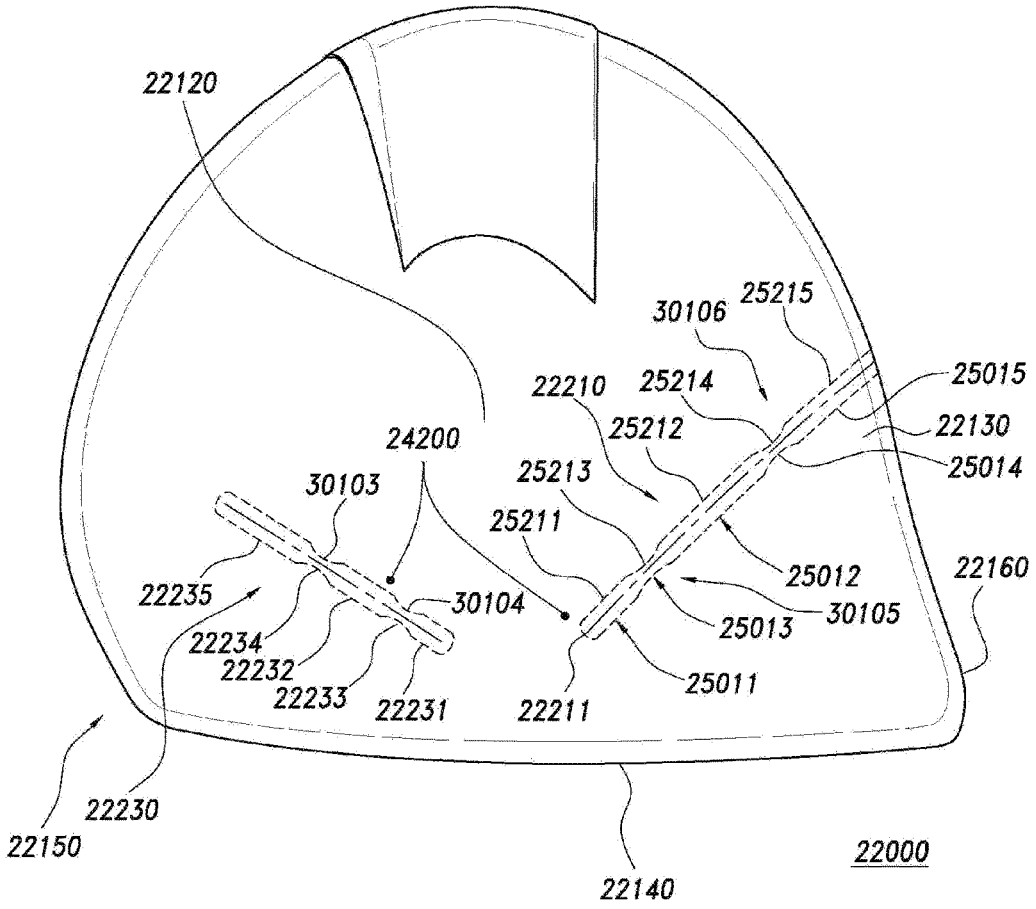
FIG. 25 shows a top-down interior view of the sole and skirt of the golf club head of FIG. 22.
Figure 26:
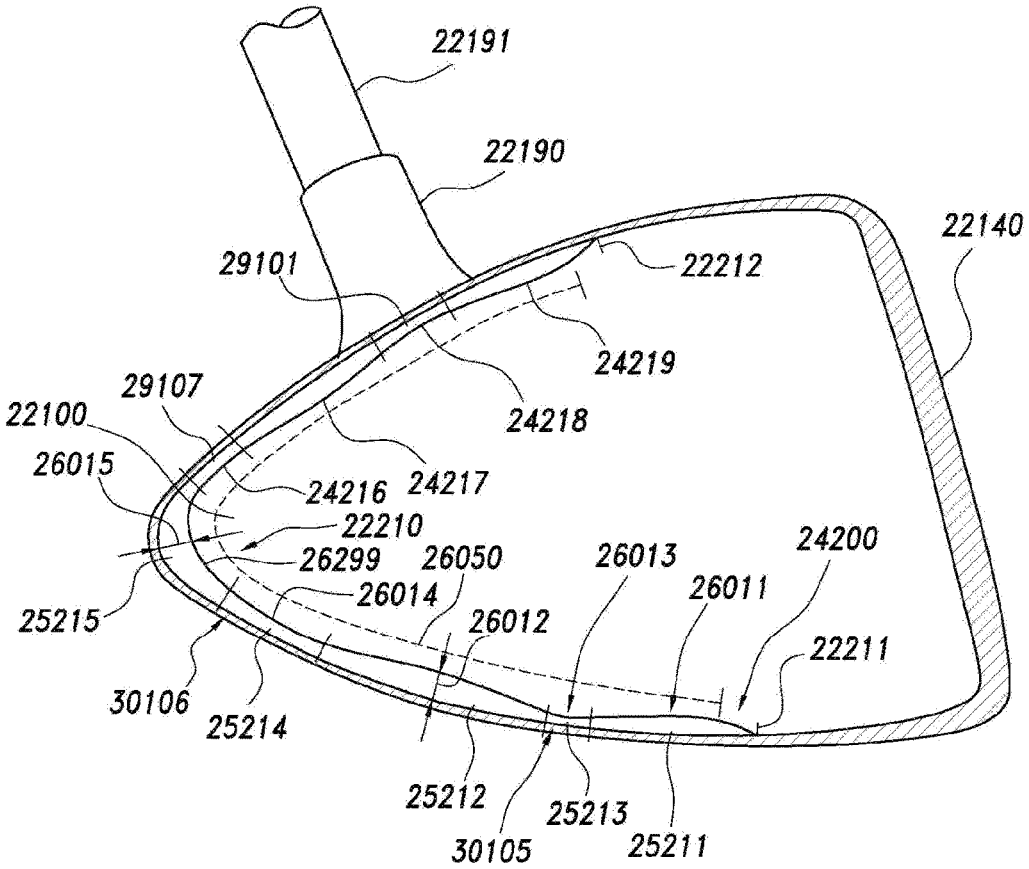
FIG. 26 illustrates a side view of a rib of the golf club head of FIG. 22 with respect to line XXVI-XXVI of FIG. 23.
Figure 27:
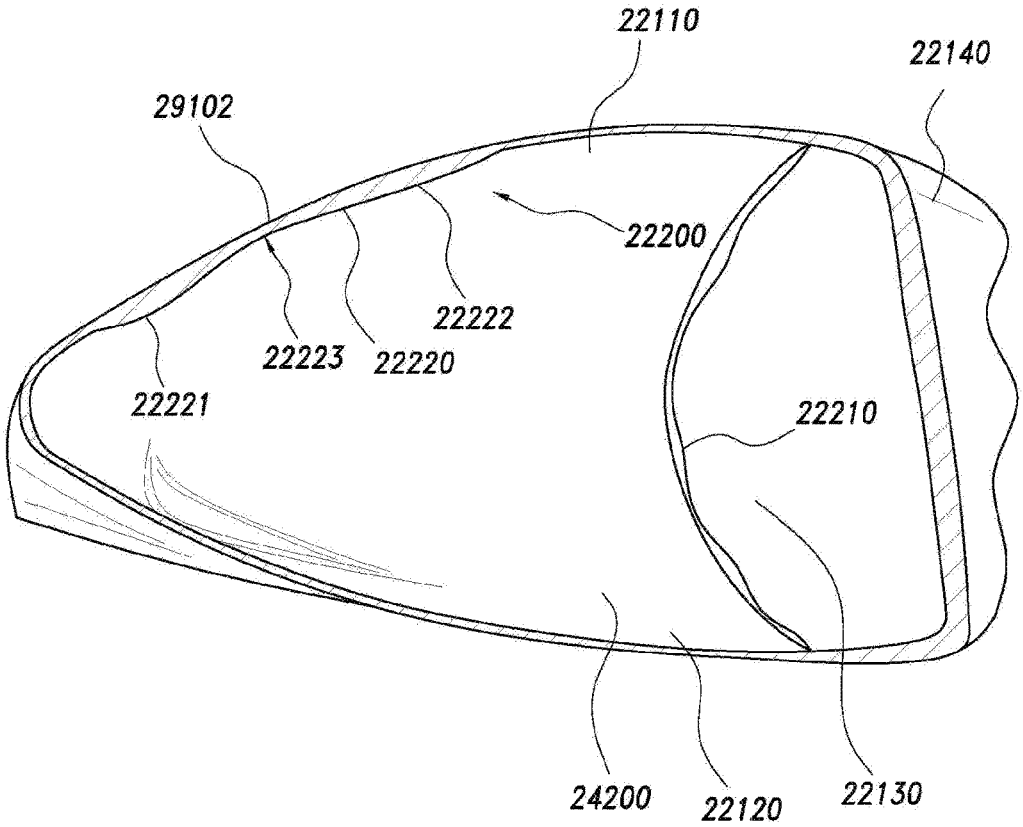
FIG. 27 illustrates a side view of a rib of the golf club head of FIG. 22 with respect to line XXVII-XXVII of FIG. 23.
Figure 28:
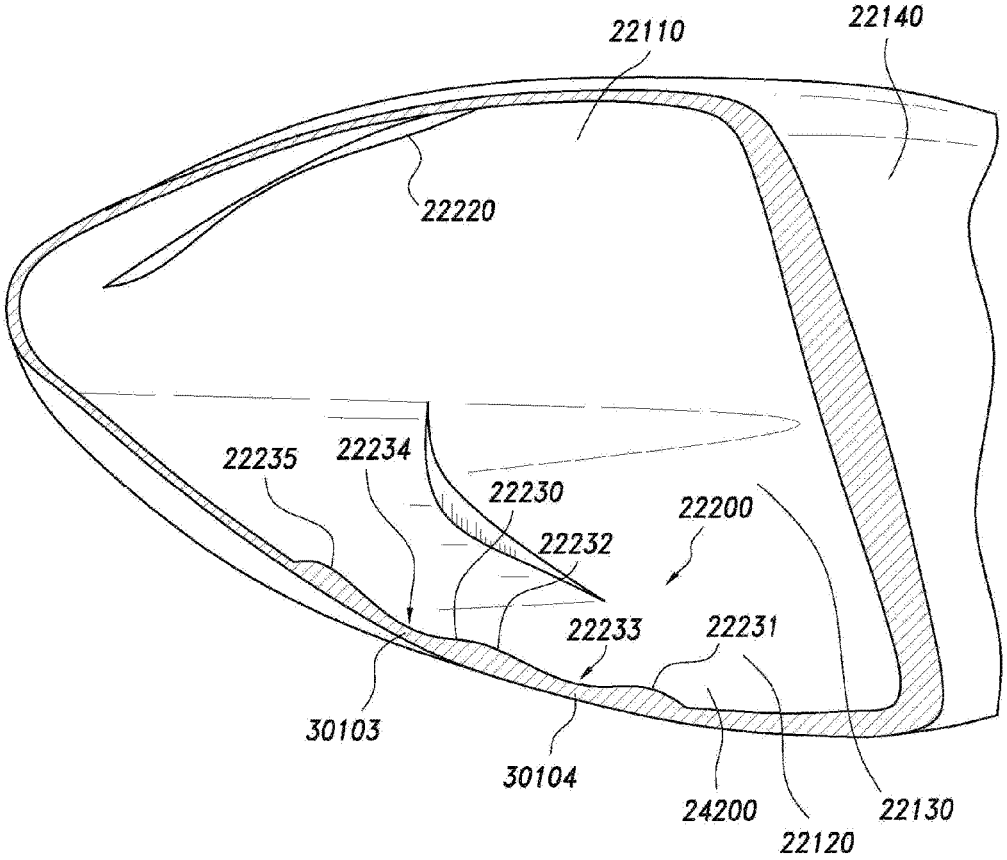
FIG. 28 illustrates a side view of a rib of the golf club head of FIG. 22 with respect to line XXVIII-XXVIII of FIG. 23.

Exemplary details of ribs 22200 can be ascertained through the figures. FIG. 23 shows an X-ray outline of ribs 22200 at crown 22110 and sole 22120 FIG. 24 shows a bottom-up interior view of crown 22110, showing rib 22220 and a crown portion of rib 22210. FIG. 25 shows a top-down interior view of sole 22120 and skirt 22130, showing rib 22230 and a crown and skirt portion of rib 22210. FIG. 26 illustrates a side view of rib 22210 with respect to a cross-sectional view of golf club head 22000 along line XXVI-XXVI of FIG. 23. FIG. 27 illustrates a side view of rib 22220 with respect to a cross-sectional view of golf club head 22000 along line XXVII-XXVII of FIG. 23. FIG. 28 illustrates a side view of rib 22230 with respect to a cross-sectional view of golf club head 22000 along line XXVIII-XXVIII of FIG. 23. As can be seen in FIGS. 24-28, ribs 22200 protrude from rib surface 24200 of body 22100, where rib surface 24200 comprises portions of crown 22110, sole 22120, and/or skirt 22130 in the present embodiment.

Figure 29:
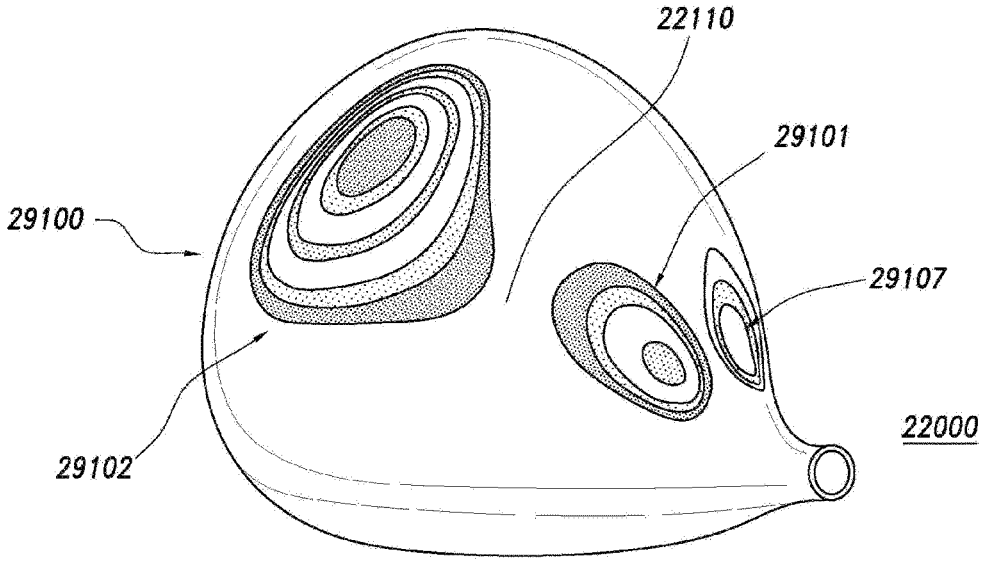
FIG. 29 illustrates a top FEA view of the crown of the golf club head of FIG. 22, identifying high amplitude zones thereat.
Figure 30:
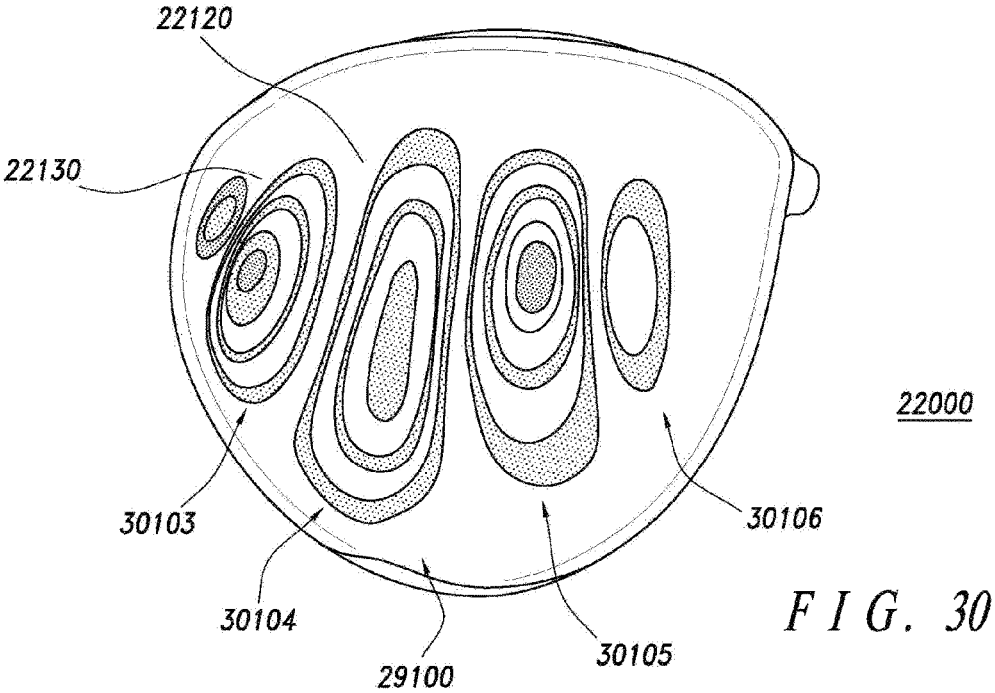
FIG. 30 illustrates a bottom FEA view of the sole of the golf club head of FIG. 22, identifying high amplitude zones thereat.

Ribs 22200 can be configured to vary at least one dimension thereof with respect to one or more high oscillation amplitude zones of body 22100. In some implementations, the location of one or more high amplitude zones can be determined via finite element analysis (FEA) map of a model of body 22100 of golf club head 22000, generated via one or more FEA analysis tools such as, for example Creo Elements from PTC, Inc. (Needham, Mass., USA). For instance, FIG. 29 illustrates a top FEA view of crown 22110, identifying high amplitude zones 29101, 29102, and 29107 as part of high amplitude zones 29100. FIG. 30 illustrates a bottom FEA view of sole 22120, identifying high amplitude zones 30103, 30104, 30105, and 30106 as part of high amplitude zones 29100.

High amplitude zones 29100 can comprise locations at body 22100 that can exhibit higher oscillation amplitudes than other sections of body 22100 following a golf shot impact. For example, high amplitude zones 29100 can correspond to locations at body 22100 that exhibit oscillation amplitudes of approximately 0.5 mm to approximately 4 mm following impact of golf club head 22000 with golf ball 1570 at impact speeds of approximately 25 m/s (meters per second) to approximately 70 m/s. In the same or other examples, high amplitude zones 29100 can be defined with respect to the oscillation amplitudes due to oscillations at one or more frequencies of approximately 1000 Hz (Hertz) to approximately 5000 Hz.

There can be situations where high amplitude zones can generate undesirable sound frequencies upon impact, and/or where structural integrity of golf club head 22000 can be compromised at such high amplitude zones due to, for example, reduced body material thickness(s) thereat. Ribs 22200 can thus be arranged in such situations to provide structural reinforcement to body 22100 while still attenuating such sound frequencies. For instance, rib 22210 is arranged to extend along high amplitude zones 30105 and 30106 (FIG. 30) at sole 22120 and/or skirt 11130, and along high amplitude zones 29101 and 29107 (FIG. 29) at crown 22110. Rib 22220 is arranged to extend along high amplitude zone 29102 (FIG. 29) at crown 22110. Rib 22230 is arranged to extend along high amplitude zones 30103 and 30104 (FIG. 30) at sole 22120 and/or skirt 22130.

Although ribs 22200 can add structural support or strength to body 22100, additional mass at high amplitude zones 29101 can exacerbate vibrations or the amplitude of oscillations thereat. Accordingly, in the present example, ribs 22200 extend along respective portions of body 22100, but vary in dimension such that at least a rib height or a rib thickness thereof decreases when extending along one or more of high amplitude zones 29100. In some examples, the rib height can be measured from, and substantially orthogonal to, rib surface 24200. For instance, rib 22210 comprises heights 26015 and 26012 (FIG. 26), which can be up to approximately 6 mm in some embodiments, and where at least one of rib heights 26015 or 26012 can comprise a maximum rib height of rib 22210. In the same or other examples, the rib thickness can be measured substantially orthogonal to the rib height. For instance rib 22210 comprises maximum rib thickness 25215 (FIG. 25), which can be up to approximately 4 mm in some embodiments.

In the present example, as seen in FIGS. 25-26, rib 22210 comprises rib ends 22211 and 22212 opposite each other. Rib 22210 also comprises rib portions 25211, 25212, and 25213, where rib portion 25211 is located between rib end 22211 and rib portion 25213, and rib portion 25212 is located between rib end 22212 and rib portion 25213.

Rib portions 25211, 25212, and 25213 comprise corresponding rib dimensions, where the respective rib dimensions of rib portions 25211 and 25213 are greater than the corresponding rib dimensions of rib 25213. For instance, as seen in FIG. 26, rib portion 25211 comprises rib height 26011, rib portion 25212 comprises rib height 26012, and rib portion 25213 comprises rib height 26013, where rib heights 26011 and 26012 are greater than rib height 26013. Similarly, as seen in FIG. 25, rib portion 25211 comprises rib thickness 25011, rib portion 25212 comprises rib thickness 25012, and rib portion 25213 comprises rib thickness 25013, where rib thicknesses 25011 and 25012 are greater than rib thickness 25013.

In the present embodiment, rib heights 26011, 26012, and 26013, and rib thicknesses 25011, 25012, and 25013, are located within rib center section 26050, which is centered about rib centerpoint 26299 of rib 22210, and which comprises 95% of the rib length of rib 22210, as measured from rib end 22211 to rib end 22212. Accordingly, rib dimensions outside rib center section 26050 are not considered with respect to determining the maximum or minimum rib height or thickness of rib 22210.

Rib 22210 is arranged in the present embodiment such that rib portion 25213 (FIG. 25-26) is located at high amplitude zone 30105 (FIGS. 25, 26, 30). Accordingly, rib height 26013 and rib width 25013 are reduced when compared to rib heights 26011 and 26012 (FIG. 26) and rib widths 25011 and 25012 (FIG. 25), which are located outside high amplitude zones 29100. High amplitude zone can comprise, for example the maximum amplitude zone with the highest golf impact oscillation amplitude out high amplitude zones 29100. In one example, at least one of rib height 26011 or 26012 can be approximately 1.1 times to approximately 12 times greater than rib height 26013 (FIG. 26). As another example, at least one of rib thickness 25011 or 25012 can be approximately 1.1 times to approximately 8 times greater than rib thickness 25013 (FIG. 25). In the present embodiment, rib height 26013 (FIG. 26) can be approximately 0.5 mm to approximately 4 mm, and can comprise a minimum rib height of rib 22210. In the same or other embodiments, rib thickness 25013 (FIG. 25) can be approximately 0.5 mm to approximately 3 mm, and can comprise a minimum rib thickness of rib 22210.

In the present embodiment, rib 22210 also comprises rib portion 25214 located between rib end 22212 and rib portion 25212, where dimensions of rib portion 25214 comprise rib height 26014 (FIG. 26) and rib thickness 25014 (FIG. 25). Rib portion 25214 is located at high amplitude zone 30106 and, accordingly, rib height 26014 and rib thickness 25014 are reduced when compared to rib heights and thicknesses located outside high amplitude zones 29100. For instance, rib thickness 25012 of rib portion 25212 is greater than rib thickness 25014 of rib portion 25214 (FIG. 25). Similarly, rib height 26012 of rib portion 25212 is greater than rib thickness 26014 of rib portion 25214 (FIG. 26).

Rib 22210 also comprises rib portion 25215 located between rib end 22212 and rib portion 25214, where dimensions of rib portion 25215 comprise rib height 26015 (FIG. 26) and rib thickness 25015 (FIG. 25). Rib portion 2521 is located outside high amplitude zones 29100 and, accordingly, rib thickness 25015 of rib portion 25215 is greater than rib thickness 25014 of rib portion 25214 (FIG. 25). Similarly, rib height 26015 of rib portion 25215 is greater than rib thickness 26014 of rib portion 25214 (FIG. 26).

A similar pattern results for the portions of rib 22210 located at crown 22110. For instance, as seen in FIG. 24, rib 22210 also comprises rib portions 24216, 24217, 24218, and 24219, where rib portion 24216 is located at high amplitude zone 29107, where rib portion 24218 is located at high amplitude zone 29101, and where rib portions 24217 and 24219 are located outside high amplitude zones 29100. Accordingly, the rib thickness(es) of rib portions 24217 or 24219 can be greater than the rib thickness(es) of rib portions 24216 or 24218. In the same or other examples, the rib height(s) of rib portions 24217 or 24219 can be greater than the rib height(s) of rib portions 24216 or 24218.

The dimensions of ribs 22230 and 22220 can be arranged in accordance with the description above with respect to rib 22210 based on the locations of high amplitude portions 29100. For instance, as seen in FIGS. 24 and 27, rib 22220 comprises rib portions 22221, 22222, and 22223, where rib portion 22223 is located at high amplitude zone 29102, and where rib portions 22221 and 22222 are located outside high amplitude zones 29100. Accordingly, the rib thicknesses of rib portions 22221 and 22222 can be greater than the rib thickness of rib portion 22223. In the same or other examples, the rib heights of rib portions 22221 or 22222 can be greater than the rib height of rib portion 22223.

As another example, instance, as seen in FIGS. 25 and 28, rib 22230 comprises rib portions 22231, 22232, 22233, 22234, and 22235, where rib portion 22233 is located at high amplitude zone 30104, where rib portion 22234 is located at high amplitude zone 30103, and where rib portions 22231, 22232, and 22235 are located outside high amplitude zones 29100. Accordingly, the rib thickness(es) of rib portions 22231, 22232, or 22235 can be greater than the rib thickness (es) of rib portions 22233 or 22234. In the same or other examples, the rib height(s) of rib portions 22231, 22232, or 22235 can be greater than the rib height(s) of rib portions 22233 or 22234.

As seen in FIG. 23, rib 22210 comprises rib axis 22213, rib 22220 comprises rib axis 22223, and rib 22230 comprises rib axis 22233, where rib axes 22213, 22223, and 22233 can be aligned such as to intersect each other and locus 23500 forward of front end 22140 of body 22100, and where locus 23500 is defined in the present example by conic section perimeter 23510. In the same or other examples, rib axes 22213, 22223, and/or 22233 can be tangent to conic section perimeter 23510. Conic section perimeter 23510 comprises the size of a perimeter of golf ball 1570 in the present example, but can comprise other conic section shapes or locations such as described below with respect to the conic section perimeters of FIGS. 32-39.

Figure 31:
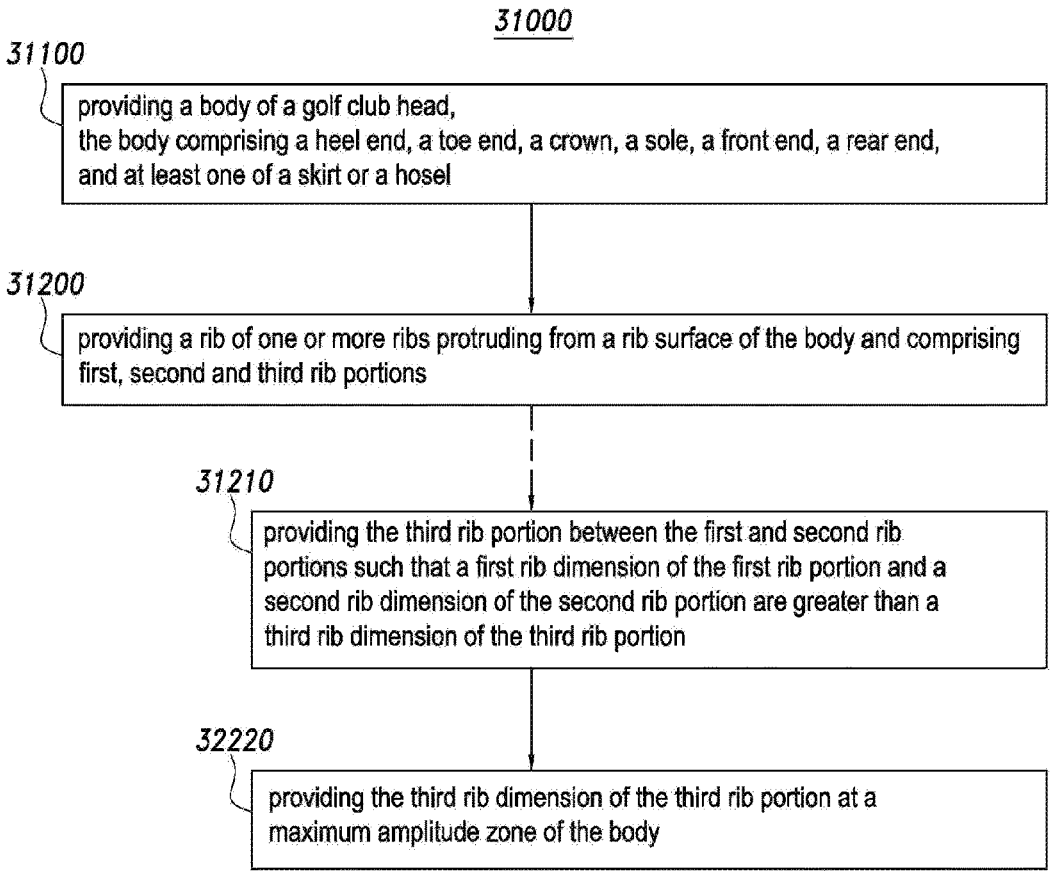
FIG. 31 illustrates a flowchart of a method for providing a golf club head in accordance with examples and embodiments of the present disclosure.

FIG. 31 presents a flowchart of method 31000 for providing a golf club head in accordance with the present disclosure. In some examples, the golf club head of method 31000 can be similar to one or more of the golf club heads presented herein, such as golf club head 22000 (FIGS. 22-30).

Method 31000 comprises block 31100 for providing a body of the golf club head, the body comprising a heel end, a toe end, a crown, a sole, a front end, a rear end, and at least one of a skirt or a hosel. In some examples, the body of the golf club head can be similar to body 22100 of golf club head 22000, comprising heel end 22160, toe end 22150, crown 22110, sole 22120, a front end 22140, rear end 23150, skirt 22130, and/or hosel 22190 (FIGS. 22-30).

Method 31000 also comprises block 31200 for providing a rib of one or more ribs protruding from a rib surface of the body and comprising first, second, and third rib portions. In some examples, the rib can be similar to one or more of ribs 22210, 22220, or 22230 (FIGS. 22-28). In the same or other examples, the rib surface can be similar to rib surface 24200 and can comprise one or more portions of the body of the golf club head, such as a portion of the crown, a portion of the sole, and/or a portion of the skirt thereof.

Block 31200 can comprise sub-block 31210 in some examples, where sub-block 31210 comprises providing the third rib portion between the first and second rib portions such that a first rib dimension of the first rib portion and a second rib dimension of the second rib portion are greater than a third rib dimension of the third rib portion. In some implementations, the first rib dimension can correspond to a rib height of the first rib, similar to the rib heights described above with respect to ribs 22210, 22220, and/or 22230, for example. In the same or other implementations, the rib dimension can also or alternatively correspond to a rib thickness of the first rib, similar to the rib thicknesses described above with respect to ribs 22210, 22220, and/or 22230, for example The first, second and third rib portions can be similar to corresponding portions of ribs 22210, 22220, or 22230 in some examples. For instance, where the rib is similar to rib 22210, the third rib portion can be similar to rib portion 25213 while the first and second rib portions can be similar to rib portions 25211 and 25212 (FIGS. 25-26). As another example, again where the rib is similar to rib 22210, the third rib portion can be similar to rib portion 25214 while the first and second rib portions can be similar to rib portions 25212 and 25215 (FIGS. 25-26). As another example, again where the rib is similar to rib 22210, the third rib portion can be similar to rib portion 24216 while the first and second rib portions can be similar to rib portions 25215 and 24217 (FIGS. 24,26). As yet another example, again where the rib is similar to rib 22210, the third rib portion can be similar to rib portion 24218 while the first and second rib portions can be similar to rib portions 24217 and 24219 (FIGS. 24,26).

In a different example, where the rib is similar to rib 22220, the third rib portion can be similar to rib portion 22223 while the first and second rib portions can be similar to rib portions 22221 and 22222 (FIGS. 24,27). In another different example, where the rib is similar to rib 22230, the third rib portion can be similar to rib portion 22233 while the first and second rib portions can be similar to rib portions 22231 and 22232 (FIGS. 25,28). In yet another different example, again where the rib is similar to rib 22230, the third rib portion can be similar to rib portion 22234 while the first and second rib portions can be similar to rib portions 22232 and 22235 (FIGS. 25,28).

Block 31200 can also comprise sub-block 32220 in some embodiments, where sub-block 32220 comprises providing the third rib dimension of the third rib portion at a maximum amplitude zone of the body. In some examples, the maximum amplitude zone can be similar to one or more of high amplitude zones 29100 as described above with respect to FIGS. 24-30, which can be matched with respective rib portions of reduced dimension similar to those of one or more of rib portions 25213, 25214, 24216, 24218, 22223, 22233, or 22234 (FIGS. 24-28).

In some examples, one or more of the different blocks or sub-blocks of method 32000 can be combined into a single block or sub-block, or performed simultaneously, and/or the sequence of such blocks or sub-blocks can be changed. For example, blocks 31100 and 31200 can be performed simultaneously, such as where the one or more ribs are integral with the body by comprising a single piece with one or more portions of the body of the golf club head. In the same or other examples, some of the blocks of method 32000 can be subdivided into several sub-blocks. For example, block 31100 can be subdivided into a sub-block for providing the crown, sole, and/or skirt, and another sub-block for providing the front end of the body and/or a strikeface thereof. There can also be examples where method 32000 can comprise further or different blocks. As an example, a further block can comprise coupling a shaft to the hosel of the body. As another example, a further block or sub-block can comprise generating an FEA map of the body of the golf club head, and/or determining the location of the maximum amplitude zone from the FEA map. In such examples, the FEA map can be similar to the FEA maps or views of golf club head 22000 as shown in FIGS. 29-30. In addition, there may be examples where method 32000 can comprise only part of the steps described above. For instance, sub-block 32220 can be optional in some implementations. Other variations can be implemented for method 32000 without departing from the scope of the present disclosure.

Figure 32:
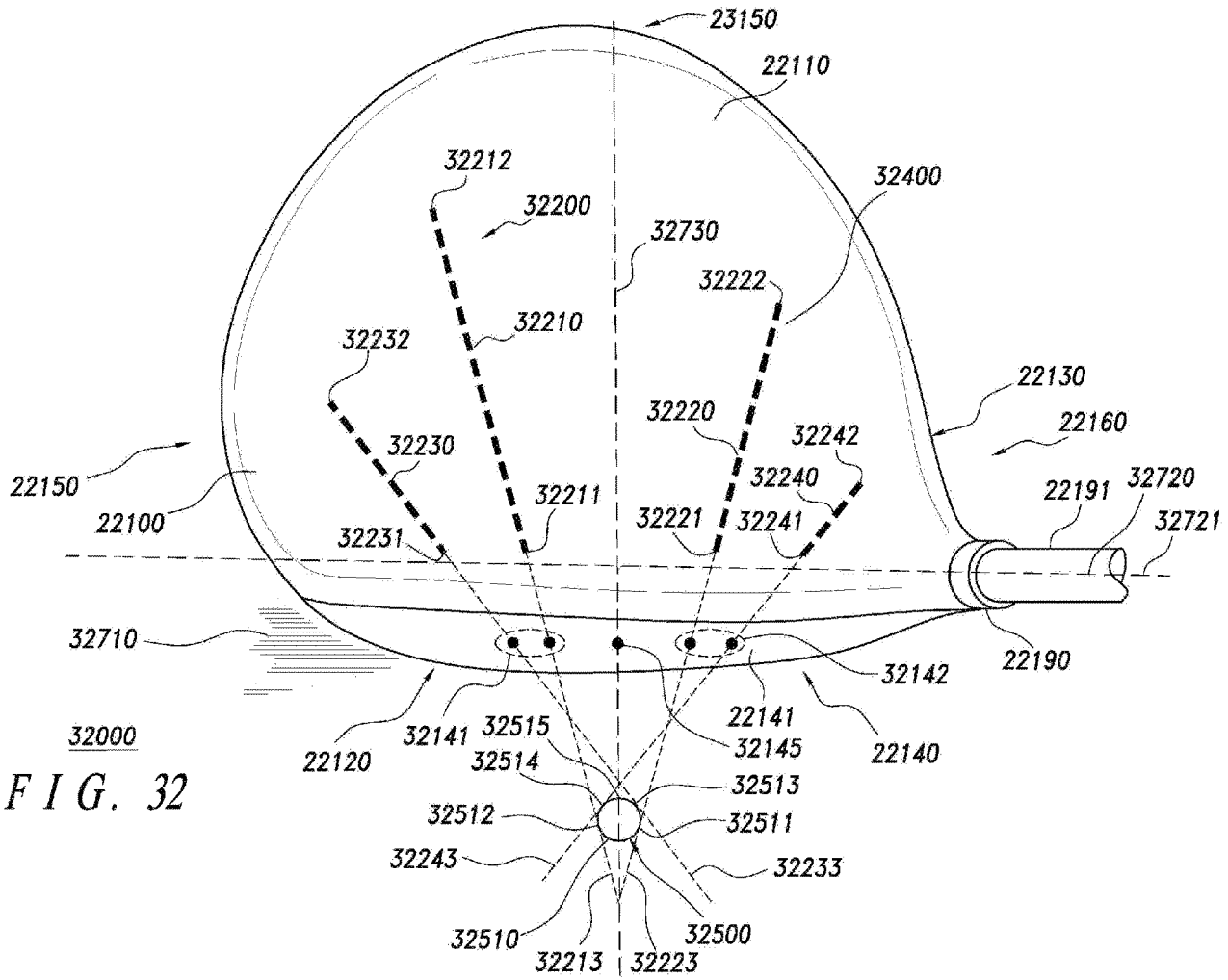
FIG. 32 illustrates a top X-Ray view of a golf club head with ribs.

FIG. 32 illustrates a top X-Ray view of golf club head 32000 with ribs 32200, which can be similar to other golf club heads and ribs described herein. Golf club head 32000 comprises body 22100 with crown 22110, sole 22120, heel end 22160, toe end 22150, front end 22140, rear end 23150, skirt 22130 and/or hosel 22190 as described above with respect to FIGS. 22-31, and also comprises ribs 32200 coupled to body 22100 and protruding from rib surface 32400 thereof. As seen in FIG. 32, hosel 22190 can have golf club shaft 22191 inserted therein. In the present example, rib surface 32400 comprises an interior surface of body 22100, but there can be other similar embodiments where rib surface 32400 can comprise an exterior surface of body 22100.

Ribs 32200 comprise rib 32210 and 32220 in the present embodiment. Rib 32210 comprises rib endpoints 32211 and 32212 opposite each other, and rib axis 32213 intersecting rib endpoints 32211 and 32212. Similarly, rib 32220 comprises rib endpoints 32221 and 32222 opposite each other, and rib axis 32223 intersecting rib endpoints 32221 and 32222. Ribs 32200 also comprise ribs 32230 and 32240 in the present embodiment, where rib 32230 comprises rib axis 32213 intersecting rib endpoints 32231 and 32232 thereof, and where rib 32240 comprises rib axis 32243 intersecting rib endpoints 32241 and 32242 thereof. Other embodiments can comprise fewer or greater number of ribs.

The top view of FIG. 32 depicts golf club head 32000 with body 22100 at address over ground plane 32710 such that shaft plane 32720, which comprises shaft axis 32721 of shaft 22190, is orthogonal to ground plane 32710. As can be seen in FIG. 32, rib axes 32213, 32223, 32233, and 32243 intersect each other and also intersect locus 32500, which is defined by conic section perimeter 32510. In some examples, conic section perimeter 32510 can extend in a direction orthogonal to ground plane 32710 when body 22100 is at address, and locus 32500 can comprise an area or a volume bounded by conic section perimeter 32510.

Figure 38:
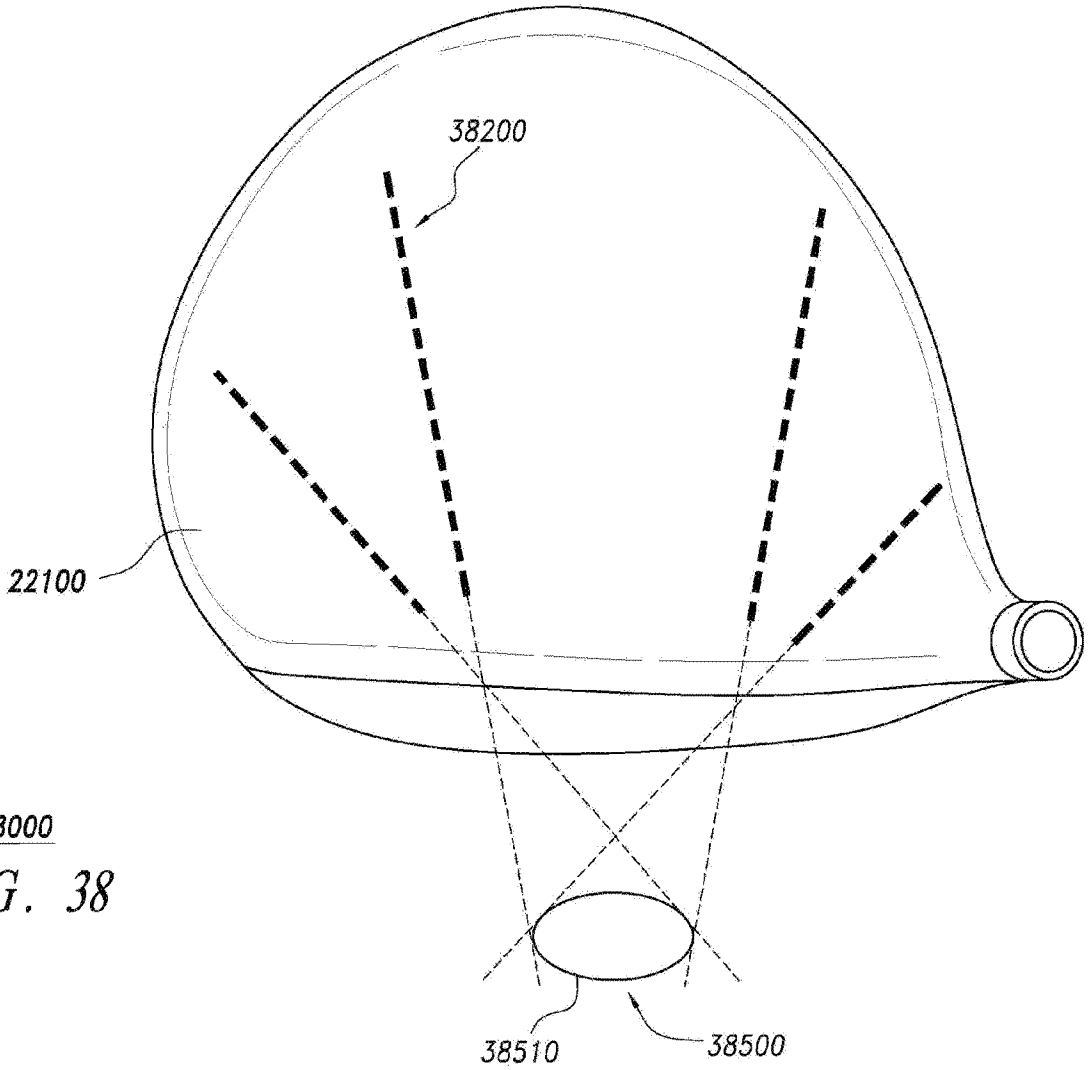
FIG. 38 illustrates a top X-Ray view of a golf club head with ribs.

Conic section perimeter 32510 comprises a circular perimeter as seen from the top view of FIG. 32 in the present embodiment, but can comprise a different conic section shape in other embodiments such as a semi-circular perimeter, an elliptical perimeter, a semi-elliptical perimeter, a parabolic perimeter, or a hyperbolic perimeter. For instance, skipping ahead in the figures, FIG. 38 illustrates a top X-Ray view of golf club head 38000 with ribs 38200 having rib axes aligned with respect to locus 38500 as defined by elliptical conic section perimeter 38510.

Backtracking to FIG. 32, rib axes 32213, 32223, 32233, and 32243 intersect locus 32500 at conic section perimeter 32150 in the present implementation. In addition, rib axes 32213, 32223, 32233, and 32243 intersect each other outside locus 32500 and forward of front end 22140 of body 22100. There also can be embodiments where rib axes 32213, 32223, 32233, and 32243 intersect locus 32500 within conic section perimeter 32150.

Ribs 32200 can be similar to other ribs described herein for other embodiments in some respects. For example, none of ribs 32200 are intersected by any other ribs, even though rib axes 32213, 32223, 32233, and 32243 intersect each other forward of front end 22140 of body 22100. Although ribs 32200 comprise a substantially constant rib height and rib thickness, there can be other embodiments with varying rib heights and/or rib thicknesses. In such embodiments, reduced rib heights or rib thicknesses can correspond to high amplitude zones of the body of the golf club head, as described above with respect to the rib heights and/or rib thicknesses of the ribs of golf club head 22000 (FIGS. 22-31).

Ribs 32200 are aligned with respect to locus 32500 and conic section perimeter 32510 such as to better channel or dissipate impact stresses with respect to a target stress direction from which such impact stresses may come. In the present embodiment, rib axes 32213, 32223, 32233, and 32243 are tangent to conic section perimeter 32510, where (a) rib axis 32223 is tangent to conic section perimeter 32510 at tangency point 32511, which is located towards a heelside end of conic section perimeter 32510, (b) rib axis 32213 is tangent to conic section perimeter 32510 at tangency point 32512, which is located towards a toeside end of conic section perimeter 32510, (c) rib axis 32233 is tangent to conic section perimeter 32510 at tangency point 32513, which is located between tangency point 32511 and rearward end 32515 of conic section perimeter 32510, and (d) rib axis 32243 is tangent to conic section perimeter 32510 at tangency point 32514, which is located between tangency point 32512 and rearward end 32515 of conic section perimeter 32510.

In some embodiments, the size of conic section perimeter 32510 can be configured with respect a target stress direction or area from which such impact stresses may generate forward of front end 22140. For instance, to better align ribs 32200 with conic section perimeter 32510 relative to such target stress direction, a maximum diameter of conic section perimeter 32510, comprising a greatest distance between any two points thereof, can be relatively small. As an example, such maximum diameter of conic section perimeter 32510 can be approximately 3 mm be to approximately 10 mm. Such alignment of ribs 32200 with respect to such small diameter of conic section perimeter 32510 can be beneficial, for instance, in the case of experienced individuals that can more consistently hit golf ball 1570 at a desired area of front end 22140 and/or which may want to align front end 22140 and/or ribs 32200 with respect to a specific zone or point of golf ball 1570.

Figure 33:
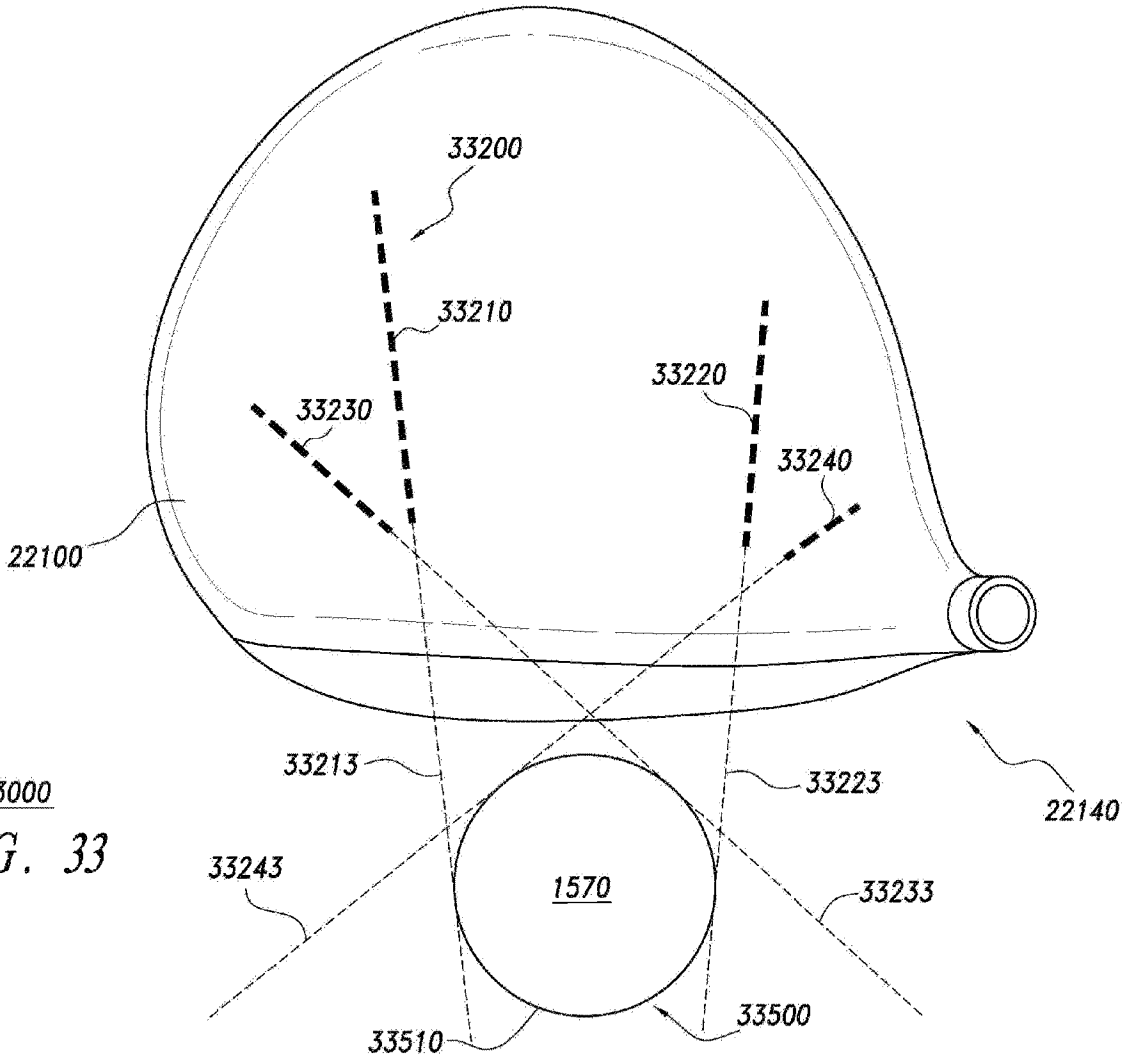
FIG. 33 illustrates a top X-Ray view of a golf club head with ribs.

In other embodiments, the maximum diameter of the conic section perimeter can be greater and can comprise, for example, a golf ball diameter of a golf ball of approximately 42.67 mm (approximately 1.68 inches). For instance, FIG. 33 illustrates a top X-Ray view of golf club head 33000 with ribs 33200, which can be similar to golf club head 32000 and ribs 32200 (FIG. 32), such that ribs 33210, 33220, 33330, and 33340 (FIG. 33) can be respectively similar to ribs 32210, 32220, 32330, and 32340 (FIG. 32) and such that rib axes 33213, 33223, 33233, and 33243 can be respectively similar to rib axes 32213, 32223, 32223, 32233, and 243 (FIG. 32). Ribs 33200 are aligned similar to ribs 32200, but with respect to locus 33500 as defined by conic section perimeter 33510, which comprises the size of a perimeter of golf ball 1570. Such alignment of ribs 33200 with respect to a larger diameter, such as the diameter of conic section perimeter 33510, can be beneficial in the case of higher handicap individuals that may tend to hit a golf ball more inconsistently across a broader area of front end 22140.

Returning to the example of FIG. 32, ribs 32230 and 32240 comprise outermost ribs of ribs 32200, being respectively located closest to toe end 22150 and heel end 22160 of body 22100. Ribs 32210 and 322120 comprise inner ribs of ribs 32200, being located between outermost ribs 32230 and 32240. As seen in the present example, rib axes 32213 and 32223 of inner ribs 32210 and 32220 intersect each other forward of conic section perimeter 32510, while rib axes 32233 and 32243 of outermost ribs 32230 and 32240 intersect each other rearward of conic section perimeter 32510. Such an arrangement leads to relatively smaller angles between rib axes 32213 and 32233 of toeside ribs 32230 and 32210, and between rib axes 32223 and 32243 of heelside ribs 32220 and 32240. Accordingly, toeside ribs 32230 and 32210 can be focused to a narrower area 32141 of front end 22140, while heelside ribs 32240 and 32220 can be focused to a narrower area 32142 of front end 22140. In some implementations, such an alignments can thus be beneficial for more experienced individuals that may want to focus their golf swings with respect to specific areas of front end 22140, such as narrower area 32141 towards toe end 22150, and/or narrower area 32142 towards heel end 22160.

Figure 34:
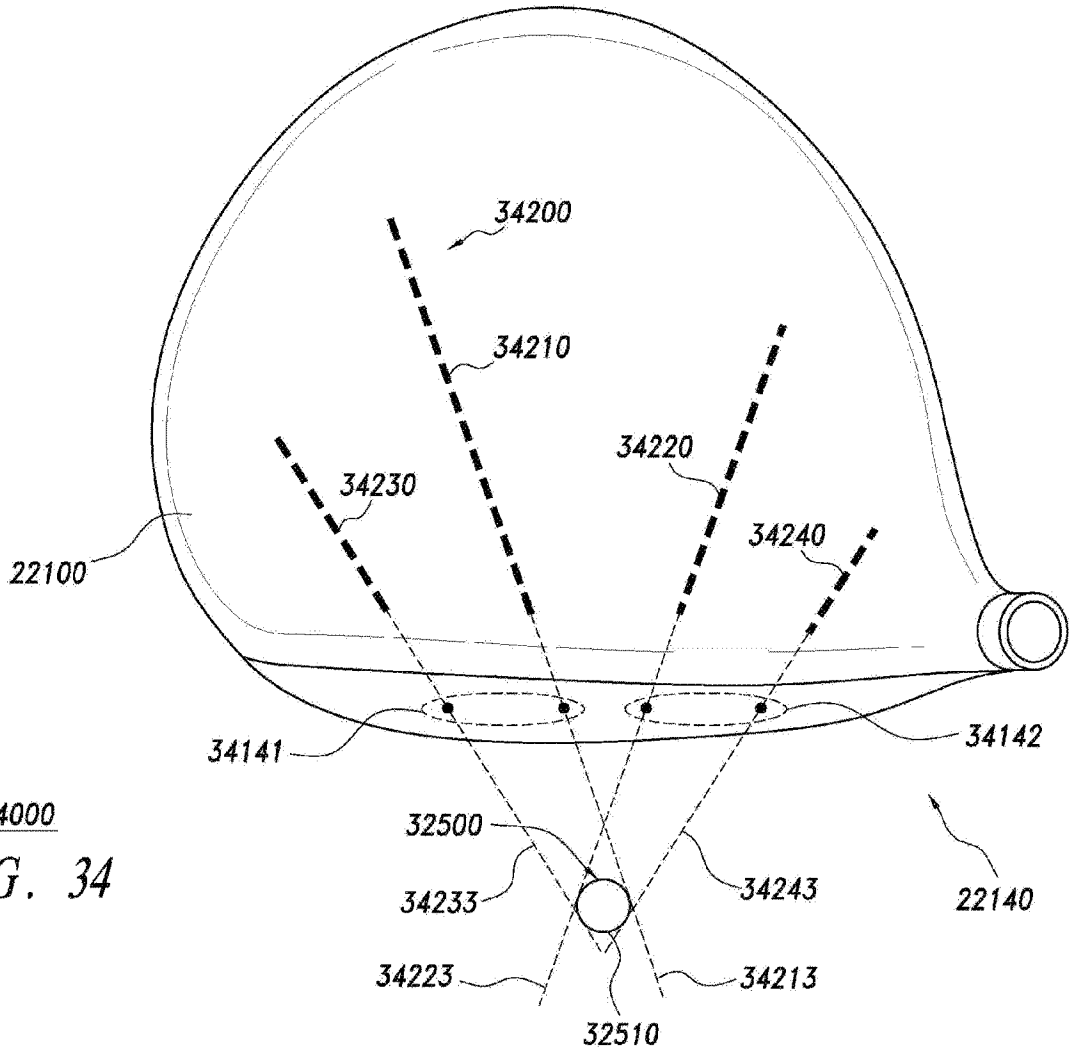
FIG. 34 illustrates a top X-Ray view of a golf club head with ribs.

There can be other embodiments, however, with different rib arrangements. For example, FIG. 34 illustrates a top X-Ray view of golf club head 34000 with ribs 34200, which can be similar to golf club head 32000 and ribs 32200 (FIG. 32), where ribs 34230 and 34240 comprise outermost ribs of ribs 34200, and where ribs 34210 and 34220 comprise inner ribs of ribs 34200. As seen in the present example, rib axes 34213 and 34223 of inner ribs 34210 and 34220 intersect each other rearward of conic section perimeter 32510, while rib axes 34233 and 34243 of outermost ribs 34230 and 34240 intersect each other forward of conic section perimeter 32510. Such an arrangement leads to relatively greater angles between rib axes 34213 and 34233 of toeside ribs 34230 and 34210, and between rib axes 34223 and 34243 of heelside ribs 34220 and 34240. Accordingly, toeside ribs 34230 and 34210 are focused to a broader area 34141 of front end 22140, while heelside ribs 32240 and 32220 are be focused to a broader area 32142 of front end 22140. In some implementations, such an alignments can thus be beneficial for higher handicap individuals that may be more inconsistent with their golf swings with respect to specific areas of front end 22140. Accordingly, broader area 34141 (FIG. 34) can be greater than narrower area 32141 (FIG. 20), and broader area 34142 (FIG. 34) can be greater than narrower area 32142 (FIG. 32).

As described above, the conic section perimeter for a golf club head can be aligned with respect to a target stress direction from which impact stresses are desired to be channeled or attenuated. For instance, locus 32500 and ribs 32200 in general are aligned in FIG. 32 with respect to strikeface centerpoint 32145 of strikeface 22141 for a target stress direction traversing the center of strikeface 22141. Accordingly, when golf club head 32000 is at address as described above, conic section perimeter 32510 is centered at center plane 32730, where center plane 32730 is orthogonal to ground plane 32710 and comprises strikeface centerpoint 32145.

Figure 35:
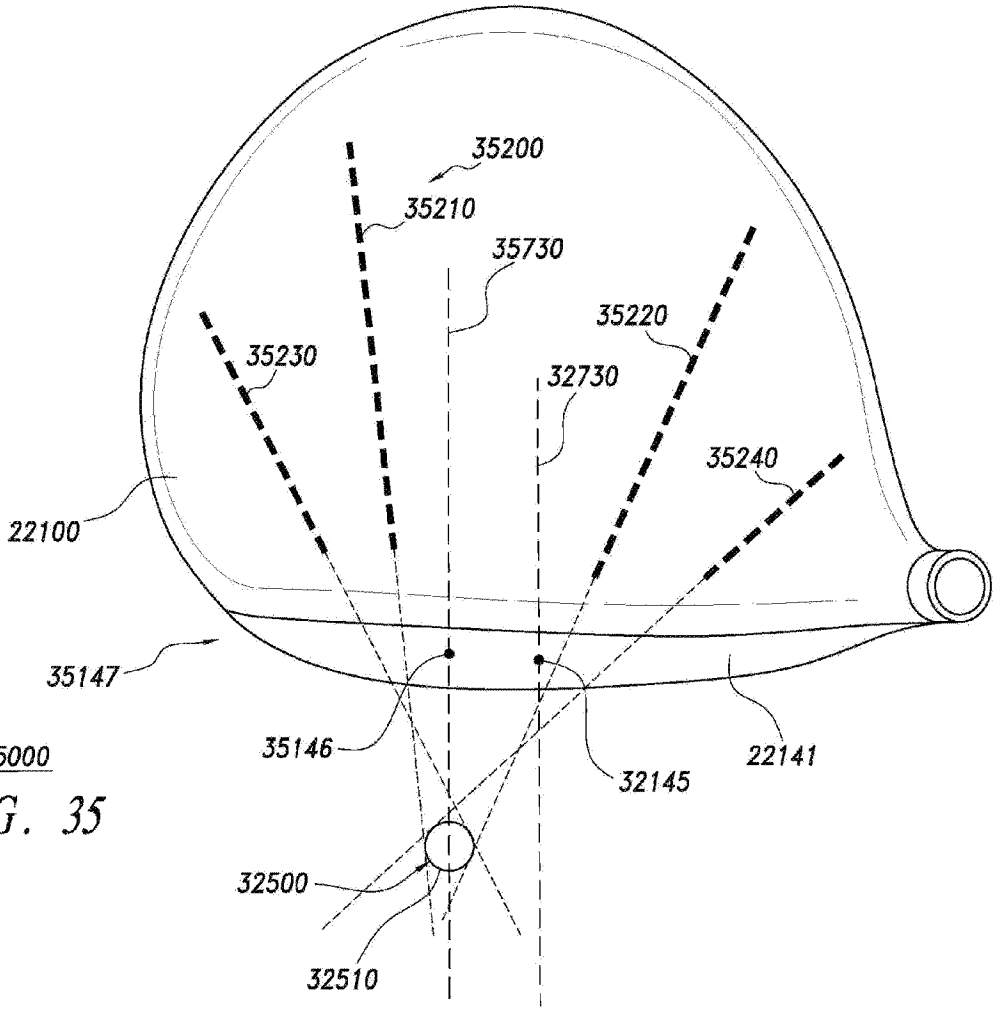
FIG. 35 illustrates a top X-Ray view of a golf club head with ribs.

FIG. 35 illustrates another example showing a top X-Ray view of golf club head 35200 with ribs 35200 aligned with respect to a toeward location for locus 32500. Ribs 35200 can be similar to ribs 32200 (FIG. 32), such that ribs 35210, 35220, 35330, and 35340 (FIG. 35) can be respectively similar to ribs 32210, 32220, 32330, and 32340 (FIG. 32), but ribs 35200 are aligned with the toeward location of locus 32500. In the present example, strikeface 22141 comprises strikeface toe end 35147 and strikeface toe-end point 35146 between strikeface centerpoint 32145 and strikeface toe end 35147. Toe-end plane 35730, which comprises strikeface toe-end point 35146, is parallel to center plane 32730. Ribs 35200 are aligned with conic segment perimeter 32510, which is centered at toe-end plane 35730 to address a target stress direction traversing the toe portion of strikeface 22141. In the same or other examples, strikeface toe-end point 35146 can be located midway between strikeface centerpoint 32145 and strikeface toe end 35147.

Figure 36:
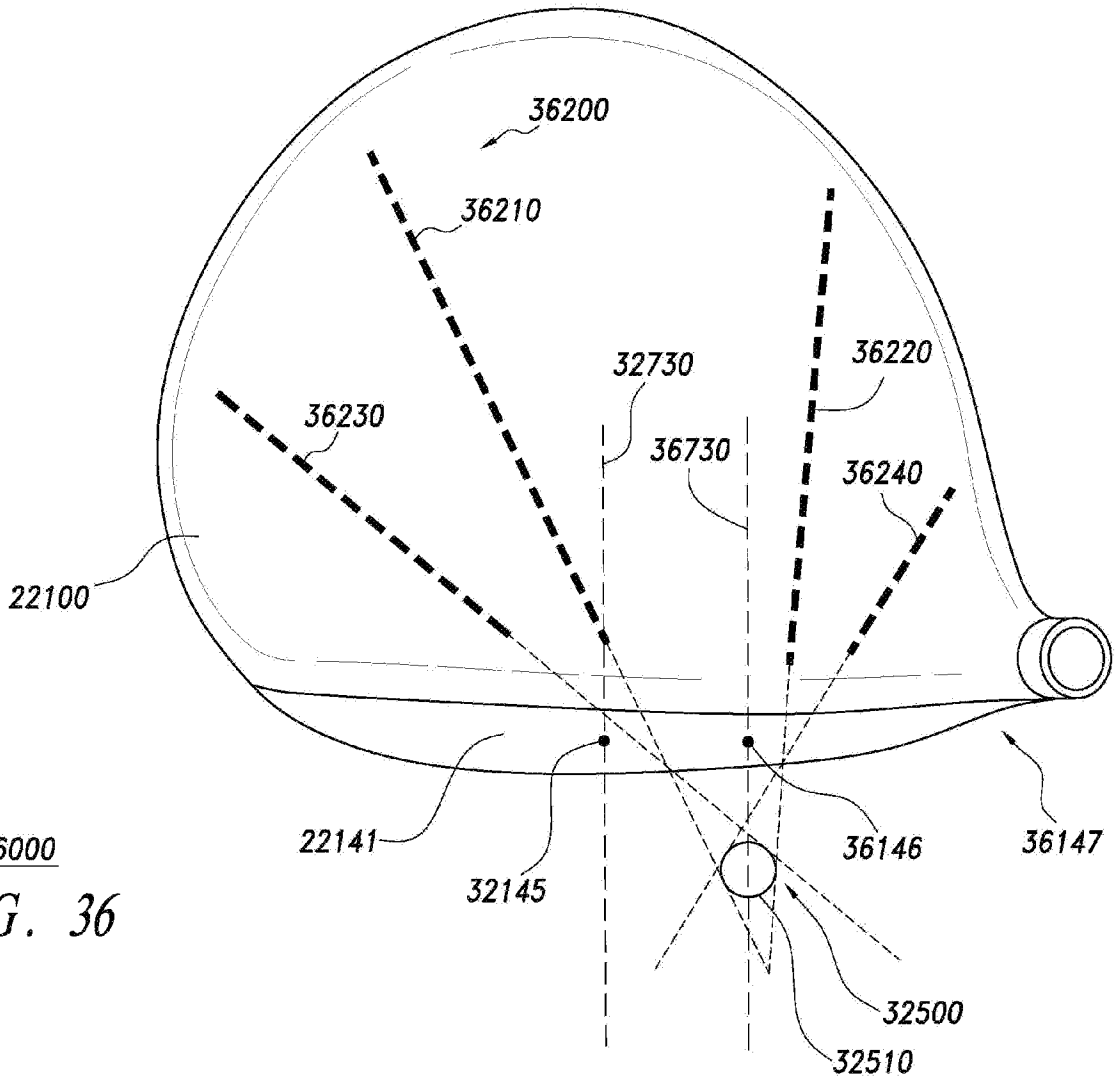
FIG. 36 illustrates a top X-Ray view of a golf club head with ribs.

As another example, FIG. 36 illustrates a top X-Ray view of golf club head 36200 with ribs 36200 aligned with respect to a heelward location for locus 32500. Ribs 36200 can be similar to ribs 32200 (FIG. 32), such that ribs 36210, 36220, 36330, and 36340 (FIG. 36) can be respectively similar to ribs 32210, 32220, 32330, and 32340 (FIG. 32), but ribs 36200 are aligned with the heelward location of locus 32500. In the present example, strikeface 22141 comprises strikeface heel end 36147 and strikeface heel-end point 36146 between strikeface centerpoint 32145 and strikeface heel end 36147. Heel-end plane 36730, which comprises strikeface heel-end point 36146, is parallel to center plane 32730. Ribs 36200 are aligned with conic segment perimeter 32510, which is centered at heel-end plane 36730 to address a target stress direction traversing the heel portion of strikeface 22141. In the same or other examples, strikeface heel-end point 36146 can be located midway between strikeface centerpoint 32145 and strikeface heel end 36147.

Figure 37:
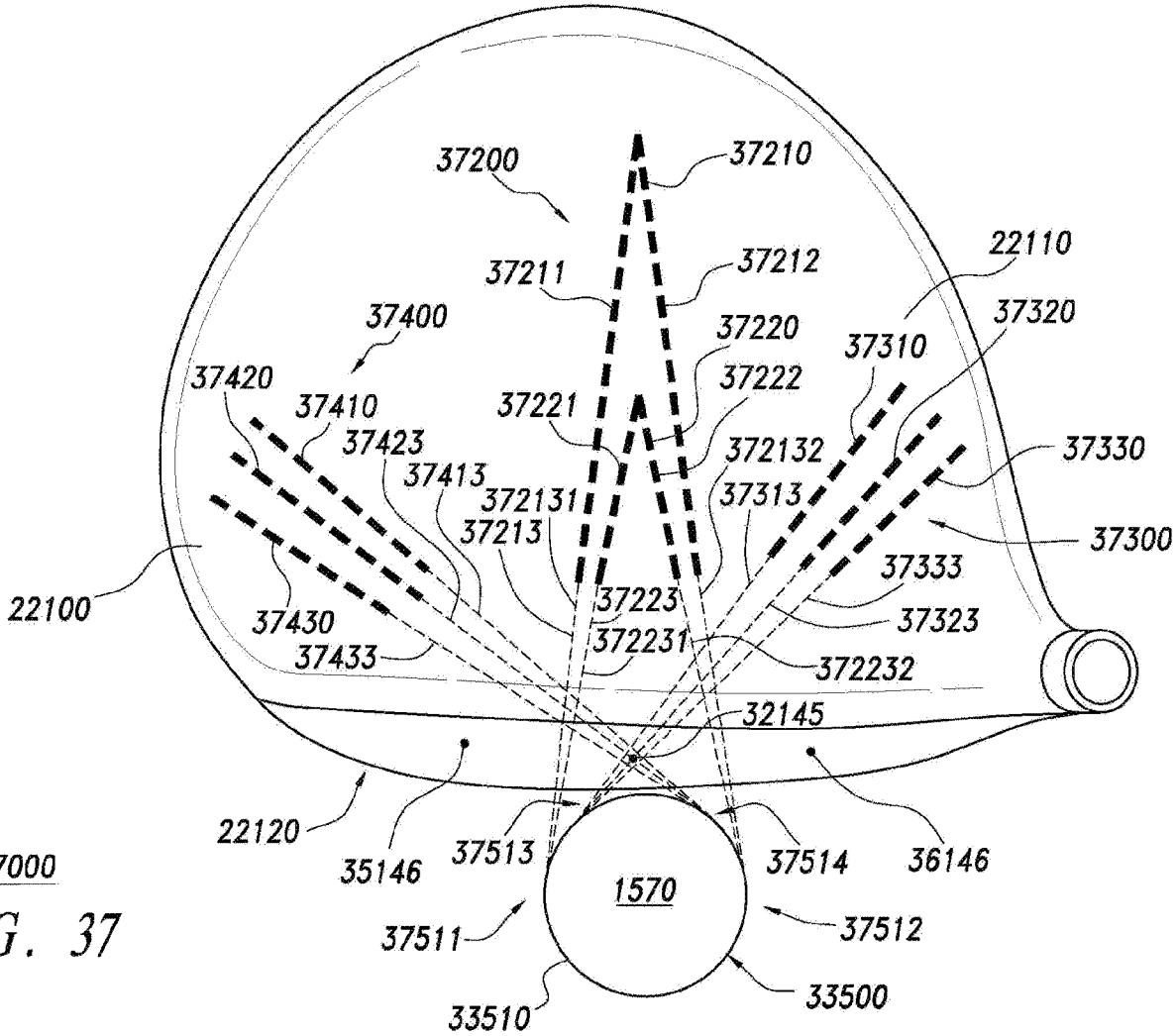
FIG. 37 illustrates a top X-Ray view of a golf club head with ribs.

FIG. 37 illustrates a top X-Ray view of golf club head 37000, comprising ribs 37200, 37300, and 37400 aligned with respect to locus 33500 and conic section perimeter 33510, which in the present example comprises the golf ball perimeter of golf ball 1570. In the present example, conic section perimeter 33510 is aligned with respect to strikeface centerpoint 32145 as described above in FIG. 32 with respect to center plane 32730, locus 32500, and conic section perimeter 32510. There can be other examples, however, where conic section perimeter 33510 can be aligned with toe-end point 35146 as described above for FIG. 35, or aligned with heel-end point 36146 as described above for FIG. 36.

The ribs of golf club head 37000 can be located at different portions of body 22100. For example, in the present embodiment, ribs 37300 and 37400 are located at crown 22110, while ribs 37200 are located at sole 22120. Such locations can change in other embodiments. For instance, ribs 37200 can be located at crown 22110 in some implementations, while at least one of ribs 37300 or 37400 can be located at sole 22120 in the same or other implementations.

Ribs 37300 comprise rib 37310 with rib axis 37313, rib 37320 with rib axis 37323, and rib 37330 with rib axis 37333, where rib axes 37313, 37323, and 37333 intersect each other at conic section perimeter 33510. In the present example, ribs 37300 are located at the heelside of golf club head 37000, and intersect each other at a toeward segment of conic section perimeter 33510, and can be tangent to perimeter section 37513 of conic section 33510. There can be other embodiments, however, where ribs 37300 can intersect conic section perimeter 33510 elsewhere, such as at a heelward, forward, or rearward section thereof.

Ribs 37400 comprise rib 37410 with rib axis 37413, rib 37420 with rib axis 37423, and rib 37430 with rib axis 37433, where rib axes 37413, 37423, and 37433 also intersect each other at conic section perimeter 33510. In the present example, ribs 37400 are located at the toeside of golf club head 37000, and intersect each other at a heelward segment of conic section perimeter 33510, and can be tangent to perimeter section 37154 of conic section 33510. There can be other embodiments, however, where ribs 37400 can intersect conic section perimeter 33510 elsewhere, such as at a toeward, forward, or rearward section thereof.

Ribs 37200 comprise rib 37210 and 37220. Rib 37210 comprises rib segments 37211 and 37212 coupled to each other, and rib axis 37213. Rib axis 37213 comprises rib axis portion 372131 along rib segment 37211, and rib axis portion 372132 along rib segment 37212. In the present embodiment, rib axis portion 372131 intersects conic section perimeter 33510 at perimeter section 37511, while rib axis portion 372132 intersects conic section perimeter 33510 at perimeter section 37512. Rib axis portions 372131 and 372132 also can be respectively tangent to perimeter sections 37511 and 37512 of conic section perimeter 23510 in the present example.

Rib 37220 of ribs 37200 comprises rib segments 37221 and 37222 coupled to each other, and rib axis 37223. Rib axis 37223 comprises rib axis portion 372231 along rib segment 37221, and rib axis portion 372232 along rib segment 37212. In the present embodiment, rib axis portion 372231 intersects rib axis portion 372131 at or proximate to perimeter section 37511 of conic section perimeter 23510, while rib axis portion 372232 intersects rib axis portion 372132 at perimeter section 37512 of conic section perimeter 23510.

Figure 39:
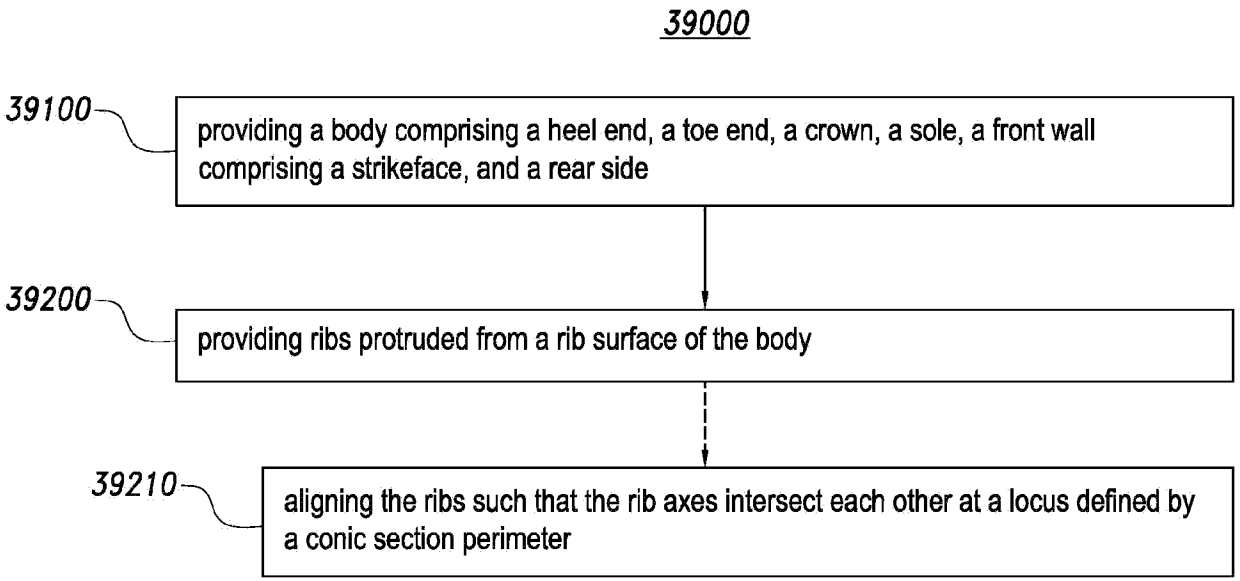
FIG. 39 illustrates a flowchart of a method for providing a golf club head in accordance with examples and embodiments of the present disclosure.

FIG. 39 presents a flowchart of method 39000 for providing a golf club head in accordance with the present disclosure. In some examples, the golf club head of method 39000 can be similar to one or more of the golf club heads presented herein, such as golf club head 22000 (FIGS. 22-30), of the golf club heads of FIGS. 32-38.

Method 39000 comprises block 39100 for providing a body comprising a heel end, a toe end, a crown, a sole, a front wall comprising a strikeface, and a rear side. In some examples, the body can be similar to body 22100 as described with respect to FIGS. 22-38.

Method 39000 also comprises block 39200 for providing ribs protruded from a rib surface of the body. In some examples, the ribs can be similar to the ribs of the exemplary embodiments described herein, such as at least a portion of ribs 22200 (FIGS. 22-26), ribs 32200 (FIG. 32), ribs 33200 (FIG. 33), ribs 34200 (FIG. 34), ribs 35200 (FIG. 35), ribs 34600 (FIG. 36), ribs 37200 (FIG. 37), and/or ribs 38200 (FIG. 38). The ribs can protrude from one or more of the portions of the body of the golf club head, such as from the crown, the sole, and/or the skirt thereof, whether internally or externally.

Block 39200 of method 39000 can comprise sub-block 39210 for aligning the ribs such that the rib axes intersect each other and intersect a locus defined by a conic section perimeter. In some examples, the ribs can be aligned with respect to the loci and conic section perimeters as described above for FIGS. 22, and/or 32-38.

In some examples, one or more of the different blocks or sub-blocks of method 39000 can be combined into a single block or sub-block, or performed simultaneously, and/or the sequence of such blocks or sub-blocks can be changed. For example, blocks 39100 and 39200 can be performed simultaneously, such as where the one or more ribs are integral with the body by comprising a single piece with one or more portions of the body of the golf club head. In the same or other examples, some of the blocks of method 39000 can be subdivided into several sub-blocks. For example, block 39100 can be subdivided into a sub-block for providing the crown, sole, and/or skirt, and another sub-block for providing the front end of the body and/or a strikeface thereof. There can also be examples where method 39000 can comprise further or different blocks. As an example, a further block can comprise coupling a shaft to the hosel of the body. Other variations can be implemented for method 32000 without departing from the scope of the present disclosure.

Side Ribs

Illustrated in FIG. 40-52 is another embodiment of a golf club head, club head 40000 comprising side ribs which can improve the sound of the golf club head 40000 during impact with a golf ball. Club head 40000 comprises a hollow body 40018, a front end 40020, a crown 40022, a sole 40024, a heel end 40030, a toe end 40032, and a rear end 40028. Club head 40000 can further comprise a plurality of ribs 40040 similar to the plurality of ribs of club heads 12, 140, 178, 180, 190, 412, 612, 812, 1012, and 1212. Further still, club head 40000 can comprise a sole weight 40590 similar to the sole weight 1590 of the golf club head 140. Further still, the club head 40000 can comprise a plurality of side ribs 40050 extending laterally from the front end 40020 toward the rear end 40028, wherein the plurality of side ribs 40050 can comprise of one side rib, two side ribs, three side ribs, four side ribs, five side ribs, six side ribs, seven side ribs or eight side ribs.

Figure 40:
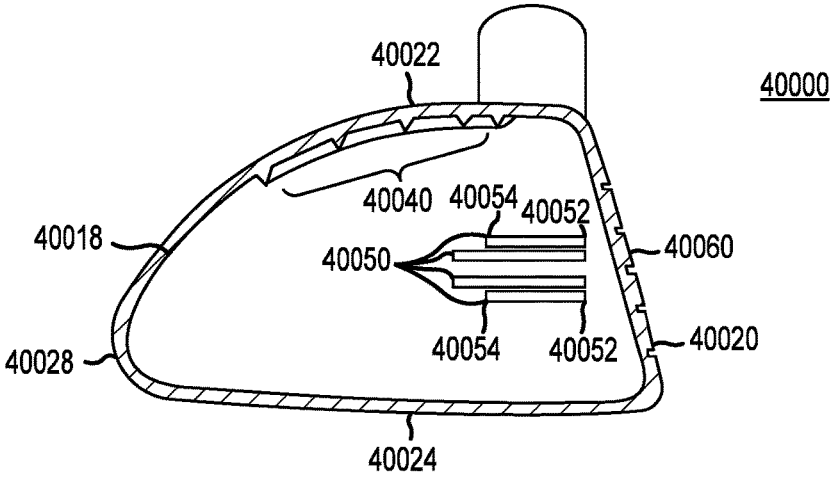
FIG. 40 illustrates a side cross-sectional view of a golf club head according to another embodiment.
Figure 41:
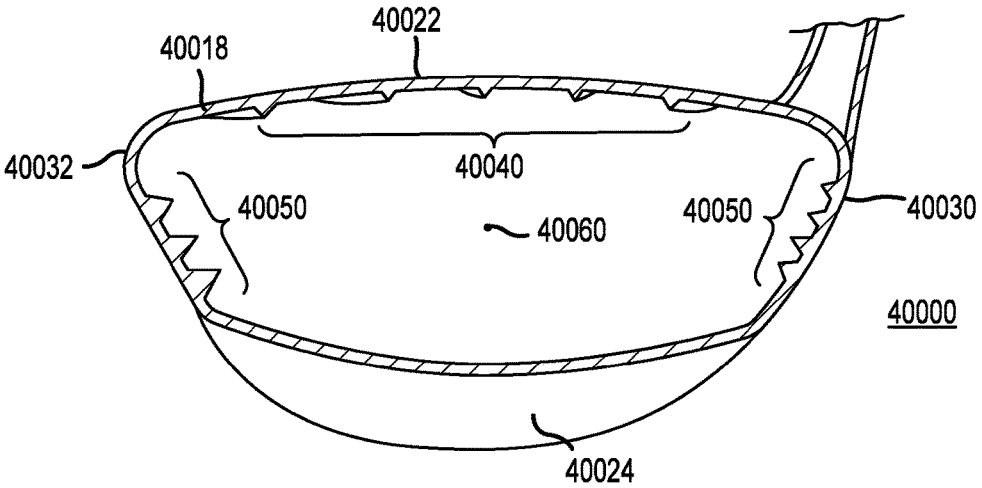
FIG. 41 illustrates a front cross-sectional view of the golf club head of FIG. 40.
Figure 43:
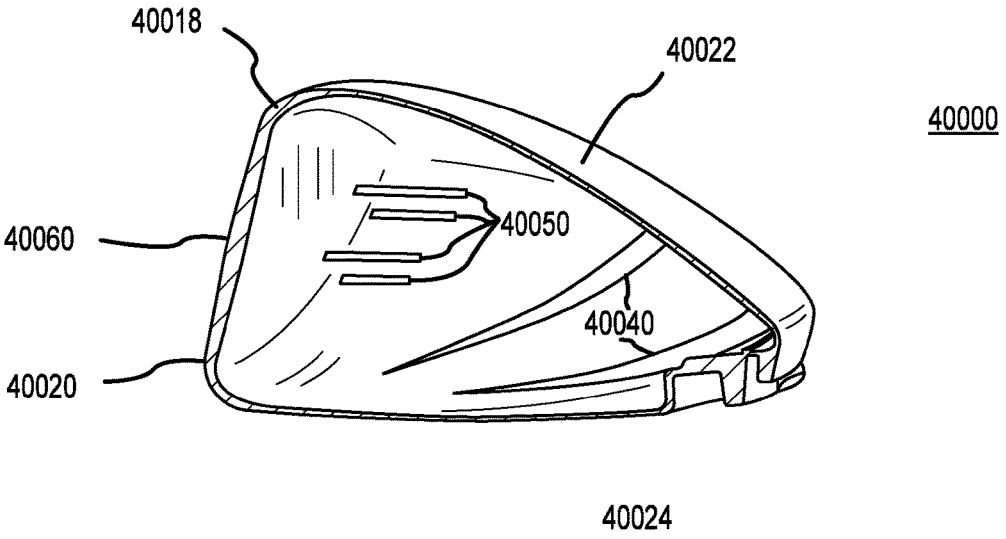
FIG. 43 illustrates another side cross-sectional view of the golf club head of FIG. 40.

The side ribs 40050 can be positioned proximate to or in contact with the front end 40020 on the heel end 40030 as illustrated in FIG. 40, or toe end 40032 as illustrated in FIG. 43. More specifically, the side ribs 40050 can be positioned in a range from 0 inch to 0.35 inch, 0 inch to 0.30 inch, 0 inch to 0.25 inch, 0 inch to 0.20 inch, 0.05 inch to 0.30 inch, 0.10 inch to 0.30 inch, or 0.15 inch to 0.25 inch away from the front end 40020. In some embodiments, the side ribs 40050 can extend into a portion of the strikeface. The side ribs 40050 can further be positioned within a perpendicular distance of 0.5 in. from an apex of the crown 40022, and a perpendicular distance of 0.5 in. from a bottommost point of the sole 40024. The positioning of the side ribs 40050 can improve the sound of the golf club head 40000.

In some examples, the side ribs 40050 can be positioned on both the toe end 40032 and the heel end 40030, wherein each side ribs 40050 positioned on the toe end 40032 is asymmetric from the side ribs 40050 positioned on the heel end 40030. The side ribs 40050 on the toe end 40032, and the heel end 40030 are asymmetrical to one another when the side ribs 40050 on the toe end 40032 and the side ribs 40050 on the heel end 40030 are not equidistant from a strikeface centerpoint 40060 of the front end 40020. In some examples, the side ribs 40050 on the heel end 40030 can be positioned closer or farther to the strikeface centerpoint 40060 than the side ribs 40050 on the toe end 40032. In other examples, the side ribs 40050 on the toe end 40032 can be in contact with the front end 40020, while the side ribs 40050 on the heel end 40030 can be positioned farther from the front end 40020. In other examples, the side ribs 40050 on heel end 40030 can be in proximate the front end 40020, while the side ribs 40050 on the toe end 40032 can be positioned farther from the front end 40020.

In some examples, the strikeface centerpoint 40060 can be located at a center of a target strike zone (similar to target strike zone 1431 as illustrated in FIG. 14 and described above), and/or may be defined in accordance with the definition of a golf governing body such as the United States Golf Association (USGA). For example, the strikeface centerpoint 40060 can be determined in accordance with Section 6.1 of the USGA's Procedure for Measuring the Flexibility of a Golf Clubhead (USGA-TPX3004, Rev. 1.0.0, May 1, 2008) (available at http://www.usga.org/equipment/testing/protocols/Procedure-For-Measuring-The-Flexibility-Of-A-Golf-Club-Head/).

The amount of side ribs 40050 on the toe end 40032 compared to the heel end 40030 can be equal or vary. In some examples, there can be three side ribs 40050 on the toe end 40032 and 1 side rib 40050 on the heel end 40030. In another example, there can be two side ribs on the toe end 40032 and three side ribs on the heel end 40030. Further, in examples with multiple side ribs 40050 located on one end (the toe end 40032 or the heel end 40030) can stagger from one another, wherein some side ribs 40050 are positioned closer to or farther from the front end 40020. In some embodiments with a plurality of side ribs 40050 positioned on the toe end 40032 and/or the heel end 40030, each consecutive side rib 40050 can be positioned uniformly spaced apart from one another, and/or unevenly spaced from one another. In some embodiments with a plurality of side ribs 40050 positioned on the toe end 40032 and/or the heel end 40030, each consecutive side rib 40050 can be positioned 0.1 inch to 0.75 inch, 0.1 inch to 0.25 inch, 0.025 inch to 0.050 inch, 0.50 inch to 0.75 inch, 0.20 inch to 0.60 inch, or 0.40 inch to 0.50 inch from one another. The number of side ribs 40050 and the spacing between each side rib 40050 can improve the sound of the golf club head 40000. In all embodiments, the plurality of side ribs 40050 positioned on the toe end 40032 can be asymmetric from the plurality of side ribs 40050 positioned on the heel end 40030, wherein the side ribs 40050 on the toe end 40032 and the side ribs 40050 on the heel end 40030 are not positioned at the same distance away from the strikeface centerpoint 40060 of the front end 40020.

The side ribs 40050 can comprise a height, a width (or thickness), and a length. In some examples, the height of side ribs 40050 can remain constant, extending from the front end 40020 toward the rear end 40028. In other embodiments, the height of the side ribs 40050 can vary, extending from the front end 40020 toward the rear end 40028 (e.g., increase incrementally, increase linearly, decrease incrementally, decrease linearly, and any combination thereof). Further in some examples, the height of each of the side ribs 40050 can be equal to the heights of each of the other side ribs 40050. In other examples, each of the side ribs 40050 can have heights that are different to the other side ribs

40050. The height of the side ribs 40050 can have ranges of 0.051 cm.±0.013 (0.038-0.064 cm), 0.051 cm.±0.050 cm (0.001-0.101 cm), 0.51 in.±0.13 in (0.38-0.64 in), and 0.50 in.±0.25 in (0.25-0.75 inch).

In some examples, the width of the side ribs 40050 can remain constant or can vary (e.g., increase incrementally, increase linearly, decrease incrementally, decrease linearly, and any combination thereof) as the side ribs 40050 extend from the front end 40020 toward the rear end 40028. In some examples, the width of each of the side ribs 40050 can be equal to the other side ribs 40050. In other examples, the side ribs 40050 can have widths that are different to the other side rib 40050. In some examples, each of the side ribs 40050 can taper at a first end 40052 near the front end 40020 and can taper at a second end 40054 near the rear end 40028. In other examples, there is no tapering of the first end 40052 and/or the second end 40054. The length of the side ribs 40050 can remain constant or can vary from one another. In some examples, the side ribs 40050 closer to the crown 40022 can have a greater length than the side ribs 40050 closer to the sole 40024. In other examples, the side ribs 40050 on the toe end 40032 can have a length greater than the side ribs 40050 on the heel end 40030. In other examples, all of side ribs 40050 have an equal length. The width of the side ribs 40050 can have ranges of 0.178 cm±0.013 cm (0.165-191 cm), 0.178 in.±0.078 in. (0.100-0.256 in.), and 0.035 in.±0.020 in (0.015-0.055 in.).

Figure 42:
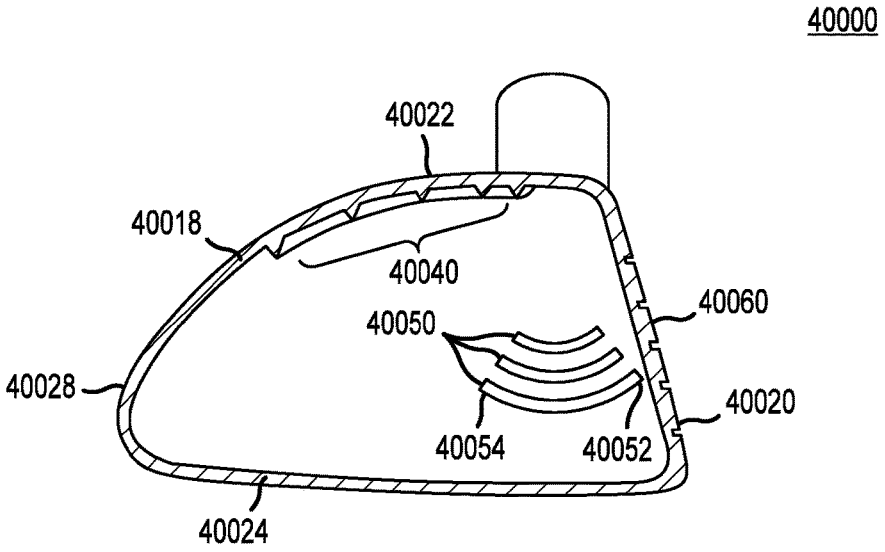
FIG. 42 illustrates another side cross-sectional view of the golf club head of FIG. 40.
Figure 45:
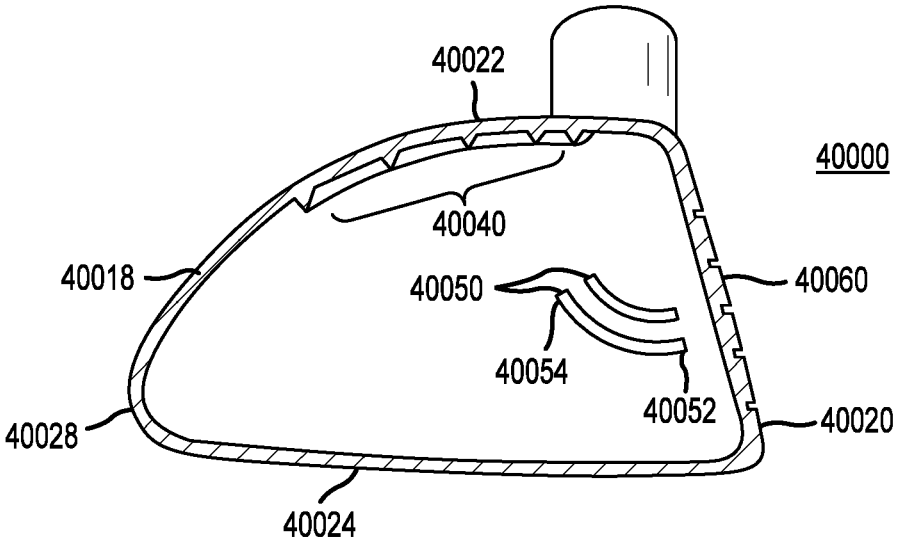
FIG. 45 illustrates another side cross-sectional view of the golf club head of FIG. 40.

As illustrated in FIGS. 42 and 45, the side ribs 40050 can extend from the front end 40020 to the rear end 40028 in a curvilinear manner (e.g., concave, convex, non-linear, etc). In some examples, all the side ribs 40050 can be all curved in the same direction. For instance, the side ribs 40050 can have a concave curve, wherein the first ends 40052 and the second ends 40054 of the side ribs 40050 are curved toward the crown 40022. In other examples, the side ribs 40050 can be curved in an alternate arrangements from one another. For instance, some side ribs 40050 can have a concave curve, while other side ribs 40050 can have a convex curve.

Figure 44:
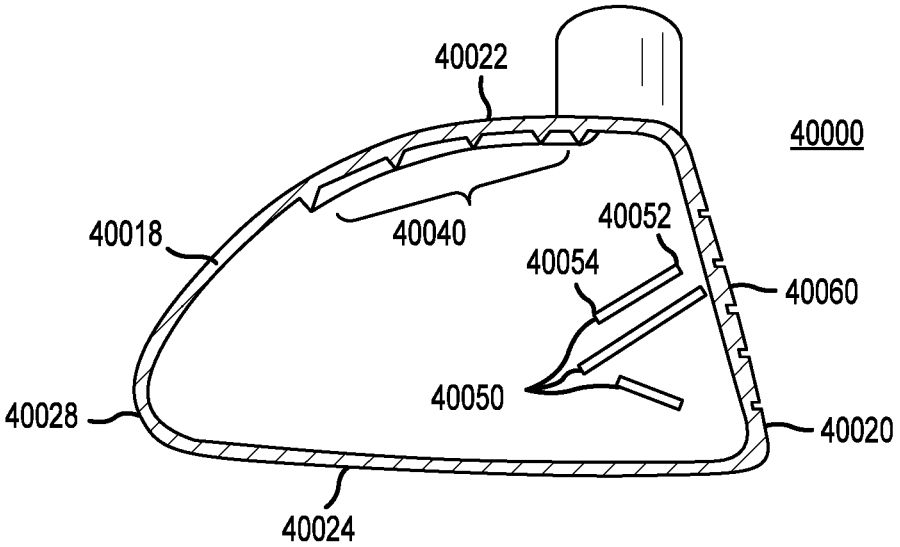
FIG. 44 illustrates another side cross-sectional view of the golf club head of FIG. 40.

As illustrated in FIGS. 44 and 45, the side ribs 40050 can be angled. The angle is determined from an imaginary reference line created by the first end 40052 and the second end 40054, relative to a ground, when the club head 40000 is at a resting position on the ground. For example, the side ribs 40050 can be at a 0 degree angle (i.e. horizontal), or at a 90 degree angle (i.e. vertical). The side ribs 40050 can be orientated at an angle between 0 degrees to 180 degrees. In some examples, the side ribs 4050 can be oriented at an angle between 20 degrees to 160 degrees, between 40 degrees to 140 degrees, between 60 degrees to 120 degrees, between 80 degrees to 100 degrees, between 10 degrees to 80 degrees, or between 100 degrees to 170 degrees. Further, each side ribs 40050 can be orientated at similar angles or vary from one another.

Figure 46:
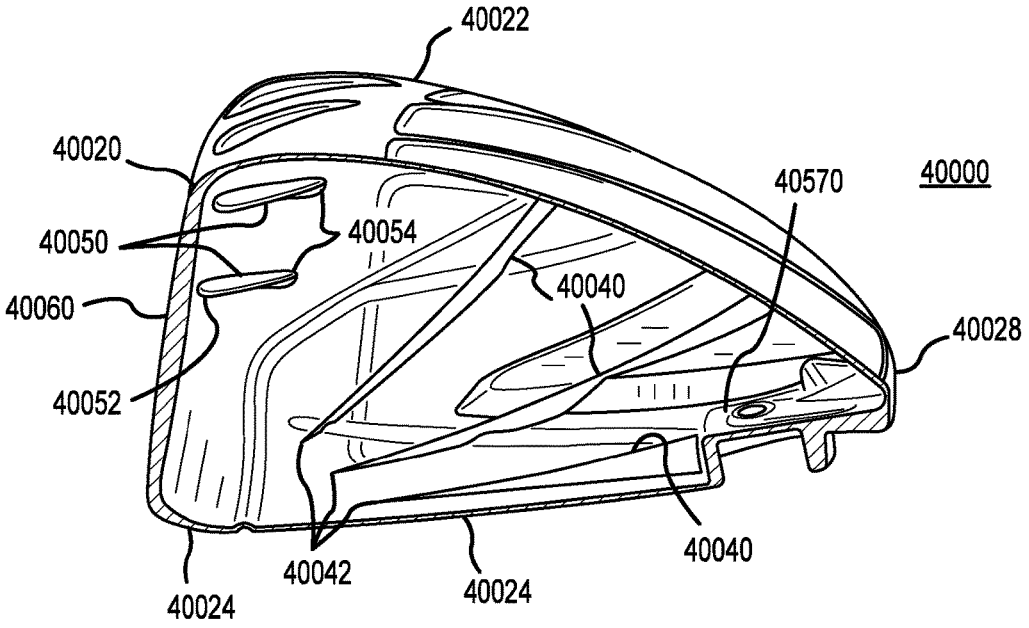
FIG. 46 illustrates another side cross-sectional view of the golf club head of FIG. 40.
Figure 47:
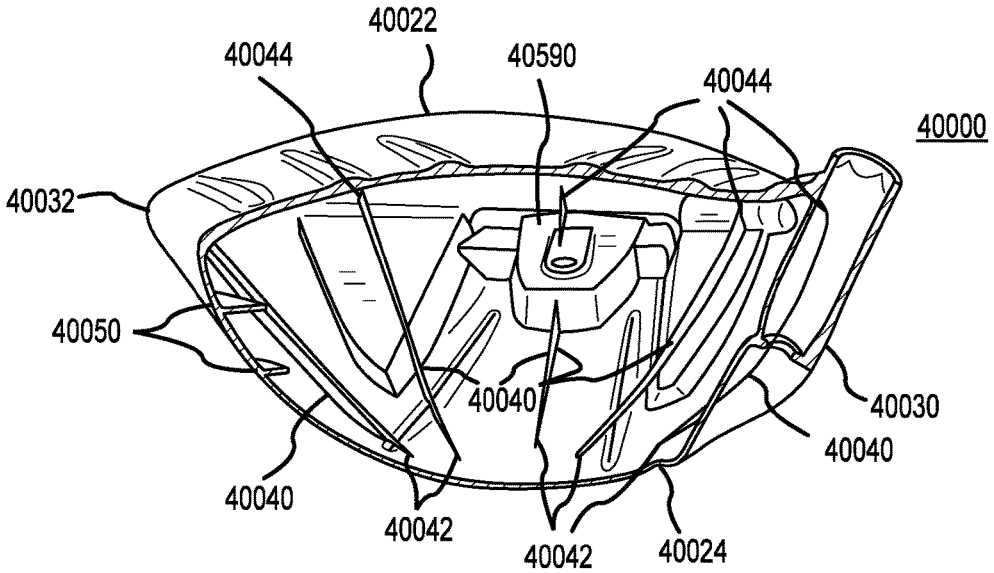
FIG. 47 illustrates another front perspective cross-sectional view of the golf club head of FIG. 40.

As illustrated in FIGS. 46 and 47, is another example of the club head 40000. The club head 40000 comprises ribs 40040, side ribs 40050 and a sole weight 40590. The ribs 40040 and the side ribs 40050 of club head 40000 can comprise similar characteristics and features as the ribs and side ribs of the previous examples and embodiments as described above. Further, the sole weight 40650 can comprises similar characteristics and features as the sole weight 1590 of the golf club head 140 as described above.

In the exemplary example, the rib 40040 are positioned on the sole 40024 of the club head 40000 and comprise a first end 40042 and a second end 40044. The first end 40042 are positioned at proximate the front end 40020 and the second end 40044 extends outward in a radial fashion toward the rear wall 40028. In other examples, the first end 40042 can be in contact with the front end 40020 and the second end 40044 can extend to be proximate to, be in contact with, or further extend along the rear end 40028. Further, the rib 40040 centered in the club head 40000 can extend along the rear end 40028 be in contact and extend the sole weight 40590. In other examples, any of the ribs 40040 can extend along the rear end 40028 and be in contact and extend through the sole weight 40590.

In the exemplary example, the ribs 40040 comprise a width and a height. The width of the ribs 40040 can have a range of 0.178 cm±0.013 cm, 0.178 in.±0.078 in., and 0.035 in.±0.020. Further, the width of the ribs 40040 extending from the first end 40042 to the second end 40044 can remain constant or vary. For example, the width at the first end 40042 can be 0.150 in., the width of the middle of the rib 40040 can be 0.100 in. and the width at the second end 40044 can be 0.195 in.

The height of the ribs 40040 in the exemplary example can have a range of 0.051 cm.±0.013, 0.051 cm.±0.050 cm., 0.51 in.±0.13 in, and 0.50 in.±0.25 in. The height of the ribs 40040 from the first end 40042 extending to the second end 40052 can remain constant or vary. For example, the height at the first end 40042 can be 0.50 in., increases to 0.75 in. extending along the middle of the rib 40040, and decreases to 0.60 in. at the second end 40044.

The side ribs 40050 in the exemplary example are positioned on the toe end 40032 of the club head 40000, proximate the front end 40020. In other examples the side ribs 40050 can be positioned on the heel end 40030, or both the toe end 40032 and heel end 40030, proximate, in contact with or distant from the front end 40020. The side ribs 40050 comprise a first end 40052 and a second end 40054, wherein the width remains constant, but the height decreases from the first end 40052 extending toward the second end 40054. In other examples, the height and width of the ribs 40050 can remain constant or vary when extending from the first end 40052 to the second end 40054. Further, the side ribs are straight and are orientated in an angle relative to the club head 40000 at rest. In other examples, the side ribs 40050 can be curved, straight, or a combination of both, and have any angle orientation. The ribs in this exemplary example allows for the sound of the club head 40000 to be more pleasing during impact.

Connecting Ribs

Figure 48:
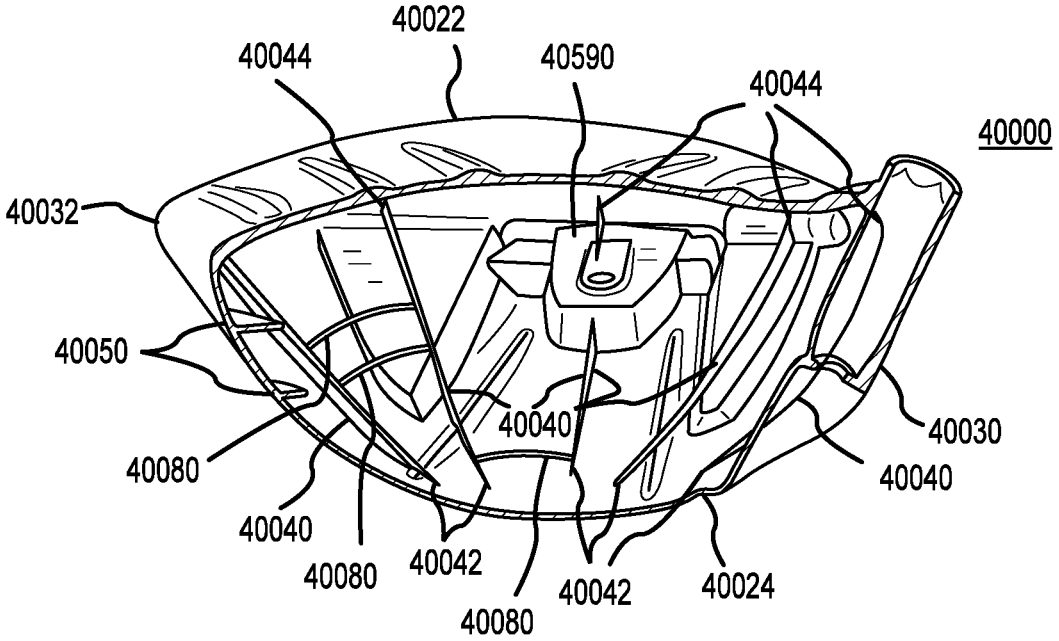
FIG. 48 illustrates another front perspective cross-sectional view of the golf club head of FIG. 40.

In other embodiments, the golf club head 40000 can further comprise connecting ribs 40080, wherein the connecting ribs 40080 can intersect a rib 40040 to a consecutive neighboring rib 40040 to improve sound. In other embodiments, the connecting rib 40080 can intersect any ribs as describe above. For example, the connecting ribs 40080 can be positioned between ribs 443-446 of FIG. 5, ribs 641-646 of FIG. 6, ribs 841-845 of FIG. 8, ribs 1043-1045 of FIG. 10, ribs 1243-1245 of FIG. 12, ribs 1721-1725 of FIG. 17, robs 1851-1855 of FIG. 19, ribs 22213, 22223, and 22233 of FIG. 23, ribs 32312, 32322, 32332, 32342, and 32352 of FIG. 32, ribs 33210, 33220, 33230, and 33240 of FIG. 33, ribs 34210, 34220, 34230, and 34240 of FIG. 34, ribs 35410, 35420, 35430, and 35440 of FIG. 35, ribs 36210, 36220, 36230, and 36240 of FIG. 36, ribs 37210, 37220, 37310, 37320, 37330, 37410, 37420, and 37430 of FIG. 37, and ribs 38200 of FIG. 38. As illustrated in FIG. 48, the connecting ribs 40080 comprise a first end and a second end. The connecting ribs 40080 extends between a rib 40040 to a consecutive neighboring rib 40040, wherein the first end of the connecting ribs

40080 can be adjacent to, or integrally formed with the rib 40040, and the second end of the connecting ribs 40080 can be adjacent to, or integrally formed with the consecutive neighboring rib 40040.

The golf club head 40000 can comprise any number of connecting ribs 40080. For example, the golf club head 40000 can comprise 1 connecting rib 40080, 2 connecting ribs 40080, 3 connecting ribs 40080. 4 connecting ribs 40080, 5 connecting ribs 40080, 6 connecting ribs 40080, 7 connecting ribs 40080, or 8 connecting ribs 40080. In embodiments wherein the golf club head 40000 can comprise any number of connecting ribs 40080, each connecting rib 40080 can be positioned between the same two ribs 40040. For example, the golf club head 40000 can comprise a first and second connecting ribs 40080, and first, second, and third ribs 40040, wherein the first connecting rib 40080 can extend between the first and second ribs 40040, and the second connecting rib 40080 can extend between the second and third ribs 40040. In other embodiments, wherein the golf club head 40000 can comprise any number of connecting ribs 40080, each connecting rib 40080 can be positioned between different ribs 40040. For example, the golf club head 40000 can comprise a first and second connecting ribs 40080, and first, second, and third ribs 40040, wherein the first and second connecting ribs 40080 can extend between the first and second ribs 40040.

In some embodiments, the connecting ribs 40080 can extend from the first end toward the second end in a curvilinear manner. In other embodiments, the connecting ribs 40080 can extend from the first end toward the second end in a linear and straight manner. In other embodiments, the connecting ribs 40080 can extend in a combination of linear and a curvilinear manner. In some embodiments having any number of connecting ribs 40080, each connecting rib can extend in a curvilinear manner, extend in a linear manner, or extend in a combination of some are curvilinear, and some are linear. In some embodiments having any number of connecting ribs 40080 between the same two ribs 40040, the connecting ribs 40080 can be parallel to one another For example, a first connecting rib 40080 is parallel with a second connecting rib 40080, wherein both connecting ribs 40080 are positioned between a first rib 40040, and a second neighboring rib 40040.

In some embodiments, the connecting ribs 40080 can be orientated in such a way between the two neighboring ribs 40040, wherein one end is positioned closer toward the front end 40020 than the other. For example, the connecting rib 40080 can be orientated where the first end is positioned closer toward the front end 40020, and the second end is positioned closer toward the rear end 40028. In other embodiments, the connecting rib 40080 can be orientated where the second end is positioned closer toward the front end 40020, and the first end is positioned closer toward the rear end 40028. In other embodiments, the connecting rib 40080 can be orientated where both the first end and the second end can be positioned at an equal distance from the front end 40020.

The connecting ribs 40080 can comprise a height, and a width (or thickness). In some examples, the height of connecting ribs 40080 can remain constant, extending from the first end of the connecting ribs 40080 toward the second end of the connecting ribs 40080. In other embodiments, the height of the connecting ribs 40080 can vary, extending from the first end toward the second end (e.g., increase incrementally, increase linearly, decrease incrementally, decrease linearly, and any combination thereof). Further in some examples, the height of each of the connecting ribs 40080 can be equal to the heights of one another. In other examples, each of the connecting ribs 40080 can have heights that are different to one another. In some embodiments, the height of the connecting ribs 40080 can range between at least half the height of ribs 40040 to matching the height of ribs 40040. The height of the connecting ribs 40080 can have ranges of 0.051 cm.±0.013 (0.038-0.064 cm), 0.051 cm.±0.050 cm (0.001-0.101 cm), 0.51 in.±0.13 in (0.38-0.64 in), and 0.50 in.±0.25 in (0.25-0.75 inch).

In some examples, the width of the connecting ribs 40080 can remain constant or can vary (e.g., increase incrementally, increase linearly, decrease incrementally, decrease linearly, and any combination thereof) as the connecting ribs 40080 extend from the first end of the connecting ribs 40080 toward the second end of the connecting ribs 40080. In some examples, the width of each of the connecting ribs 40080 can be equal to one another. In other examples, the connecting ribs 40080 can have widths that are different to one another. In some examples, each of the connecting ribs 40080 can have a tapering at a first end near a first rib 40040 and a tapering at the second end near a neighboring second rib 40040. In other examples, there can be no tapering of the first end and/or the second end. The width (or thickness) of the connecting ribs 40080 can have ranges of 0.178 cm±0.013 cm (0.165-0.191 cm), 0.178 in.±0.078 in. (0.100-0.256 in.), and 0.035 in.±0.020 in (0.015-0.055 in.).

As described above, the connecting ribs 40040 can be positioned between a rib 40040 and a consecutive neighboring rib 40040. More specifically, the connecting rib can be positions between a rib 40040 and a consecutive neighboring rib 40040 at high amplitude zones 40090 on the golf club head 40000, much like the high amplitude zones described above in FIGS. 29 and 30. As illustrated in FIGS. 49-52, these high amplitude zones 40090 can result on the crown 40022, the sole 40024, and/or the skirt of golf club head 40000. In some embodiments, the high amplitude zones 40090 can are present on a first third, second third, and/or third third of the crown 40022 (from front end 40020 to rear end 40028) near the heel end 40030, near the toe end 40032, between the heel and toe end 40030 and 40032, or a combination thereof. In other embodiments, the high amplitude zones 40090 are present on a first third, second third, and/or third third of the sole 40024 (from front end 40020 to rear end 40028) near the heel end 40030, near the toe end 40032, between the heel and toe end 40030 and 40032, or a combination thereof. The connecting ribs 40080 can be positioned on any of the high amplitude zones 40090 mention above.

Figure 49:
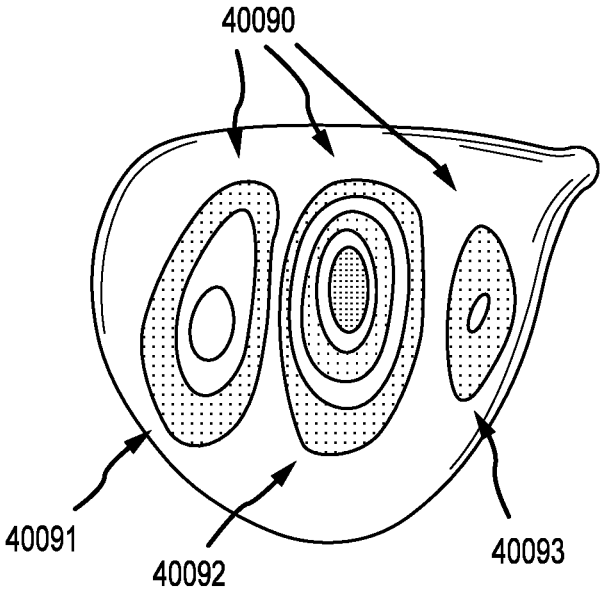
FIG. 49 illustrates a bottom modal analysis view of the sole of the golf club head of FIG. 40, identifying high amplitude zones thereat.
Figure 50:
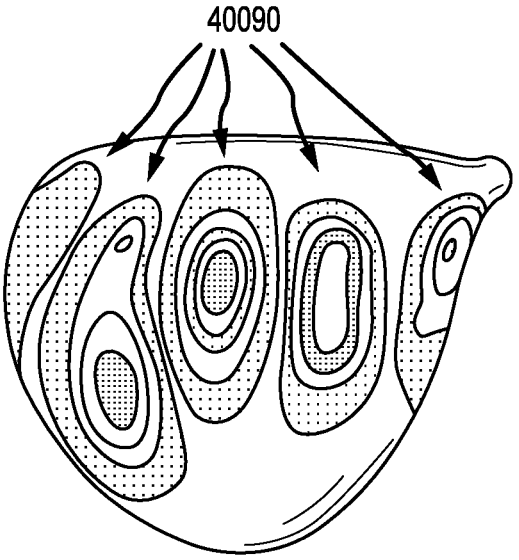
FIG. 50 illustrates a bottom modal analysis view of the sole of the golf club head of FIG. 40, identifying high amplitude zones thereat.
Figure 51:
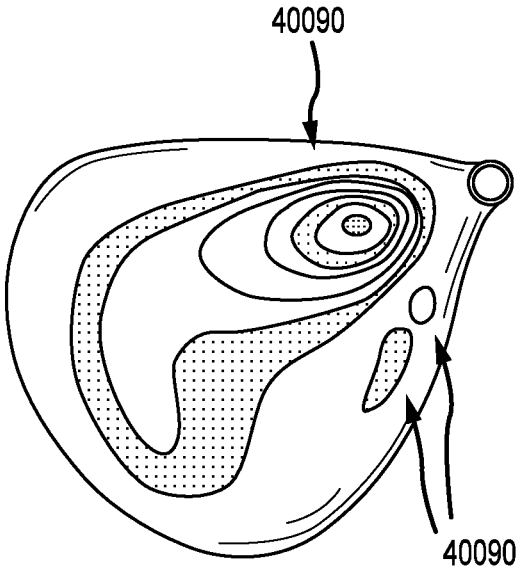
FIG. 51 illustrates a top modal analysis view of the crown of the golf club head of FIG. 40, identifying high amplitude zones thereat.
Figure 52:
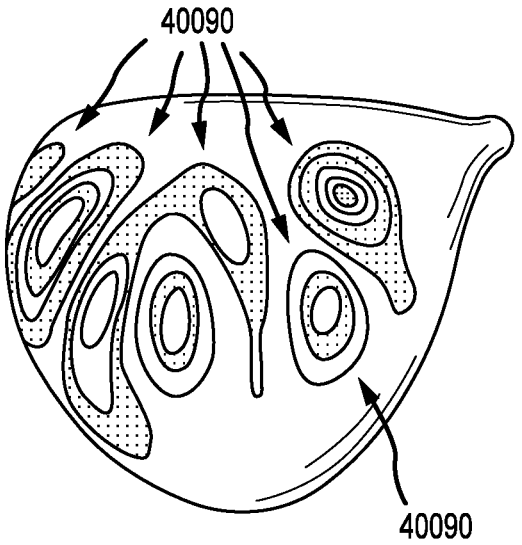
FIG. 52 illustrates a bottom modal analysis view of the sole of the golf club head of FIG. 40, identifying high amplitude zones thereat.

In some embodiments, the golf club head 40000 can comprise one high amplitude zone 40090. In other embodiments, the golf club head 40000 can comprise any number of high amplitude zones 40090 (e.g., 1 high amplitude zone 40090, 2 high amplitude zones 40090, 3 high amplitude zones 40090, 4 high amplitude zones 40090, 5 high amplitude zones 40090, 6 high amplitude zones 40090, 7 high amplitude zones 40090, or 8 high amplitude zones 40090). In one example as illustrated in FIG. 49, the golf club head 40000 can comprise a first high amplitude zone 40091, a second high amplitude zone 40092, and a third high amplitude zone 40093 positioned on the sole 40024.

The high amplitude zones 40090 can be determined through modal analysis, wherein modal analysis tests the response of a golf club head at different frequencies and produces a color map of the golf club head (known as "modes") showing different regions of the golf club head experiencing that specific frequency at different amplitude values. In FIGS. 49-52, the high amplitude zones 40090 can illustrate different severities of oscillation by the different dotted or blank pattern of the circular regions within the high amplitude zones 40090; wherein the oscillation increases going from an outer circular region to an inner circular region of the high amplitude zones 40090. In some embodiments, the inner circular region of a high amplitude zone 40090 can illustrate a more densely dotted inner circular region, which represents the highest intensity of oscillation at that specific frequency. For example as illustrated in FIG. 49, the inner circular region of the second high amplitude zone 40092 comprises a densely dotted pattern compared other circular regions which have a more sparse dotted pattern, wherein the inner circular region of the second high amplitude zone 40092 experiences the highest oscillations. As illustrated in FIGS. 49-52, the golf club head 40000 was tested by model analysis at three separate frequencies, 4000 Hz (FIG. 49), 4400 Hz (FIGS. 50 and 51), and 8000 Hz (FIG. 52), wherein different locations of the golf club head 40000 can comprise the high amplitude zones 40090 that can affect sound.

Figure 53:
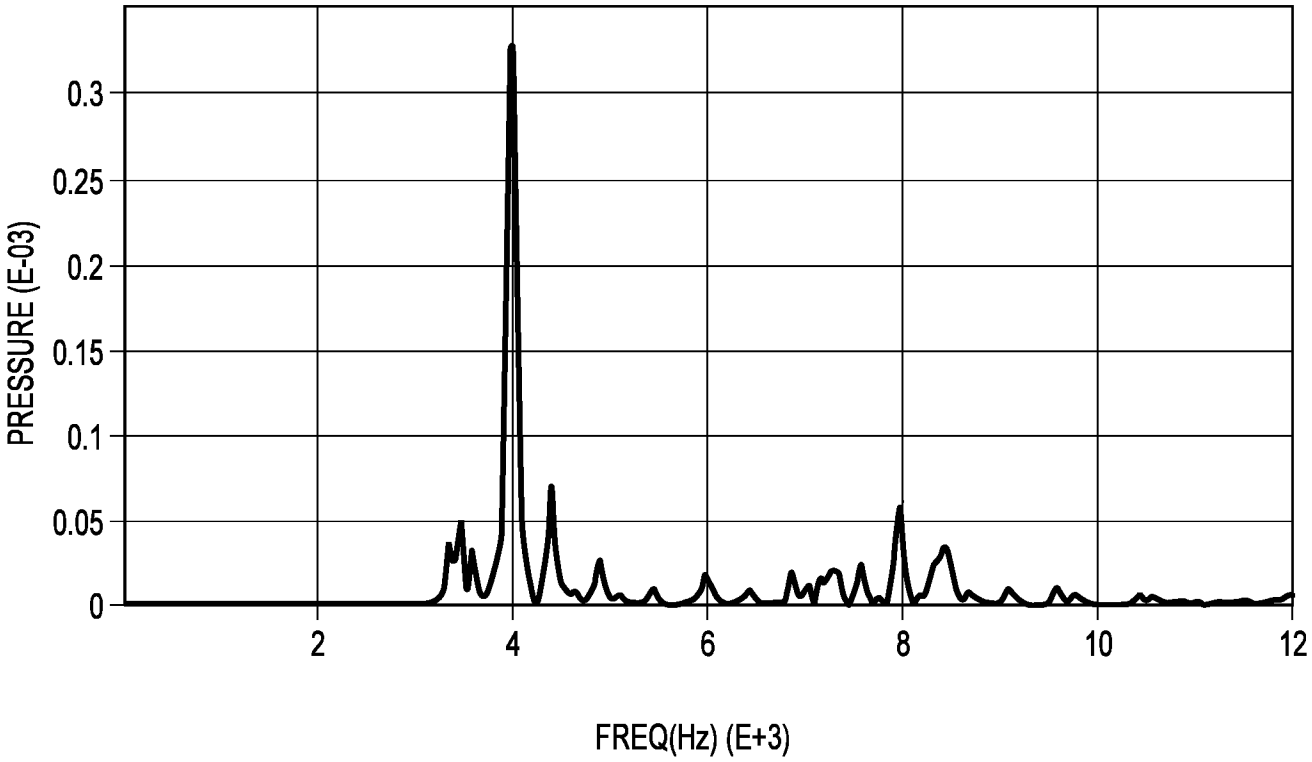
FIG. 53 illustrates an acoustic analysis graph of the golf club head of FIG. 47.

Modal analysis can be observed in conjunction with acoustic analysis (as illustrated in the graph, FIG. 53). The acoustic analysis is conducted by recording the sounds of a golf club head during an impact with a golf ball at the center of the strikeface (at speeds of 100 mph, and square with the face), wherein the sounds are then converted to a frequency domain. The acoustic analysis measures the pressure differential created by the vibrating structure (vibration amplitude), measured in lbs/in.$^2$ lbs/in.$^2$ (psi), experienced by the golf club head during an array of different frequencies, measured in Hertz (Hz), produced by the golf club head during impact. The graph of the acoustic analysis can help to determine which mode produced by the modal analysis is most prevalent in improving sound. As illustrated in FIG. 53 (associated with FIGS. 49-52), the most prevalent mode to focus on is the mode at a frequency of 4000 Hz (FIG. 49), wherein the graph shows a relatively high amplitude at 4000 Hz (pressure of approximately 0.33e-3 psi) compared to the other peak amplitudes at different frequencies (frequency of 4400 Hz produced a pressure of approximately 0.07e-3 psi, and frequency of 800 Hz produced a pressure of approximately 0.06e-3 psi). Referring to FIG. 49, the connecting ribs 40040 can be placed in the second high amplitude zone 40092, located on the second third of the sole 40024 (from front end 40020 to rear end 40028) between the heel and toe end 40030 and 40032 to lower the amplitude at 4000 Hz relative to the other frequencies, thereby improving sound.

In other golf club heads, a graph can be produced by acoustic analysis showing any number of frequencies having different values of relatively high and low amplitudes to one another. Disregarding the frequencies with an amplitude approximately 90% to 100% lower than the highest amplitude generated, the connecting ribs 40080 can be positioned at specific locations on the golf club head 40040 associated with the modal analysis to improve sound, if all the relevant peak amplitudes are within a 1:0.5 ratio to one another, and/or if the following equation is satisfied relative to the amplitudes on the corresponding acoustic analysis graph:

$$Y \times Z = \overline{X} \leq Y' \leq 2\overline{X} \quad (1)$$

Wherein $\overline{X}$ is the average value of the lowest amplitudes within the acoustic analysis (excluding frequencies approximately 90% to 100% lower than the highest amplitude generated); Y is the highest amplitude value within the acoustic analysis; Z is a value less than 1 generated when the connecting rib 40080 is positioned on the golf club head 40000 at the location associated to Y; and Y' is the new and relatively lower amplitude value of Y after the connecting rib(s) 40080 are added.

In embodiments wherein acoustic analysis graphs can comprise multiple relatively high amplitudes compared to the relatively lower amplitudes (excluding frequencies approximately 90% to 100% lower than the highest amplitude generated), the sound can be improved if the following equation is satisfied:

$$(Y_1, Y_2, \ldots Y_n) \times Z = \overline{X} \leq (Y'_1, Y'_2, \ldots Y'_n) \leq 2\overline{Y} \quad (2)$$

Wherein each variable in equation 2 shares the same denotation as equation 1 above, however, 1 stands for the first highest amplitude value within the acoustic analysis, 2 stands for the second highest amplitude value within the acoustic analysis, and n stands for any number of highest amplitudes values within the acoustic analysis.

Having one or more frequencies above the ideal range can produce less than ideal sounds where certain frequencies dominate other frequencies instead of working together to create a frequency "harmony". The connecting ribs 40080 positioned in certain high amplitude zones can reduce the highest amplitude value to be within the range of $\overline{X} \leq Y' \leq 2\overline{X}$, or $\overline{X} \leq (Y'_1, Y'_2, \ldots Y'_n) \leq 2\overline{X}$, which can create the frequency "harmony", and prevent one or more frequency from overpowering the other frequencies during an impact.

The connecting ribs 40080 of golf club head 40000 described can further be incorporated into the golf club heads 12, 140, 178, 180, 190, 412, 612, 812, 1012, and 1212. Additionally, the connecting ribs 40080 in any combination of the side ribs 40050 and/or the radially extending ribs 40040 can be positioned on these high amplitude zones 40090 to improve the sound of the golf club head 40000.

Although the golf club heads with ribs and related methods herein have been described with reference to specific embodiments, various changes may be made without departing from the spirit or scope of the present disclosure. For example, although ribs 22200 are substantially straight as shown in FIGS. 22-28, there can be embodiments with ribs similar to ribs 22200 that are not straight or otherwise follow a curved, zig-zag, or S-shaped path along their respective lengths along the rib surface of the body of their respective golf club heads. As another example, ribs 22200 or other ribs similar thereto can be external rather than internal. As yet another example, although FIGS. 22-28 depict the reduced dimension portions of ribs 22200, such as rib portion 25213, 24218, 22233, and 22223, as continuously protruded above rib surface 24200, there can be other embodiments where at least part of such reduced dimension portions can merge to rib surface 24200 such as to comprise a rib height or rib thickness of zero. In some embodiments, the ribs of the golf club head may be aligned to intersect or be tangential to other loci and perimeter shapes different than those illustrated in FIGS. 22 and 32-38. For instance, such other loci and perimeter shapes can be semi-circular, semi-elliptical, hyperbolic, and/or parabolic.

Additional examples of such changes have been given in the foregoing description. Other permutations of the different embodiments having one or more of the features of the various figures are likewise contemplated. Accordingly, the disclosure herein is intended to be illustrative of the scope of the invention and is not intended to be limiting. It is intended that the scope of this application shall be limited only to the extent required by the appended claims.

The golf club heads with ribs and related methods discussed herein may be implemented in a variety of embodiments, and the foregoing discussion of certain of these embodiments does not necessarily represent a complete description of all possible embodiments. Rather, the detailed description of the drawings, and the drawings themselves, disclose at least one preferred embodiment, and may disclose alternative embodiments.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and/or articles of manufacture described herein may be conforming or non-conforming to the rules of golf at any particular time. Accordingly, golf equipment related to the apparatus, methods, and/or articles of manufacture described herein may be advertised, offered for sale, and/or sold as conforming or non-conforming golf equipment. The apparatus, methods, and/or articles of manufacture described herein are not limited in this regard.

While at least some of the above examples have been depicted and/or described with respect to with fairway wood-type golf clubs or driver-type golf clubs, the apparatus, methods, and/or articles of manufacture described herein may be applicable to other types of golf clubs such as, a hybrid-type golf club, an iron-type golf club, a wedge-type golf club, and/or a putter-type golf club. Alternatively, the apparatus, methods, and/or articles of manufacture described herein may be applicable other type of sports equipment such as a hockey stick, a tennis racket, a fishing pole, a ski pole, etc.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are expressly stated in such claims.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

The invention claimed is:

1. A golf club head comprising:

a body comprising:

a heel end, a toe end, a crown, a sole, a front wall comprising a strikeface, and a rear side;

an interior surface defined by the heel end, the toe end, the crown, the sole, the front wall, and the rear side; and an interior cavity bounded by the interior surface;

and ribs protruded from a rib surface of the body;

wherein:

the ribs comprise:

a first rib comprising:

a first first-rib endpoint;

a second first-rib endpoint; and a first rib axis intersecting the first and second first-rib endpoints;

a first rib length, a first rib width, and a first rib height; wherein:

the first rib length extends from the first first-rib endpoint to the second first-rib endpoint;

the first rib width is substantially parallel to the rib surface and substantially orthogonal to the first rib length; and the first rib height is substantially orthogonal to the rib surface; and a second rib comprising:

a first second-rib endpoint;

a second second-rib endpoint; and a second rib axis intersecting the first and second second-rib endpoints;

a second rib length, a second rib width, and a second rib height; wherein:

the second rib length extends from the first second-rib endpoint to the second second-rib endpoint;

the second rib width is substantially parallel to the rib surface and substantially orthogonal to the second rib length; and the second rib height is substantially orthogonal to the rib surface; and a third rib comprising:

a first third-rib endpoint;

a second third-rib endpoint; and a third rib axis intersecting the first and second third-rib endpoints;

the third rib length extends from the first third-rib endpoint to the second third-rib endpoint;

the third rib width is substantially parallel to the rib surface and substantially orthogonal to the third rib length; and the third rib height is substantially orthogonal to the rib surface; and with respect to a top view of the golf club head:

the first, second, and third rib axes intersect each other and are tangent to a locus defined by a conic section perimeter; and one or more of the first rib width, the second rib width, and the third rib width vary respectively across the first rib length, the second rib length, and the third rib length;

the first rib axis is tangent to the conic section perimeter at a first tangency point located towards a heelside end of the conic section perimeter;

the second rib axis is tangent to the conic section perimeter at a second tangency point located towards a toeside end of the conic section perimeter; and the third rib axis is tangent to the conic section perimeter at one of:

a third tangency point located between the first tangency point and a most rearward point of the conic section perimeter; or a fourth tangency point located between the second tangency point and the most rearward point of the conic section perimeter.

2. The golf club head of claim 1, wherein:

none of the ribs are intersected by any other ones of the ribs;

with respect to the top view of the golf club head, the first, second, and third rib axes intersect each other forward of the front wall of the body;

the conic section perimeter comprises a circle; and a maximum diameter of the circle is approximately 10 mm or less.

3. The golf club head of claim 1, wherein:
with respect to the top view of the golf club head, the first, second, and third rib axes intersect each other outside the locus and forward of the front wall of the body;
the conic section perimeter comprises a circle; and
a maximum diameter of the circle is approximately 5 mm or less.

4. The golf club head of claim 1, wherein:
the strikeface comprises:
a strikeface centerpoint; a strikeface heel end; a strikeface toe end;
a strikeface midheel point between the strikeface centerpoint and the strikeface heel end; and
a strikeface midtoe point between the strikeface centerpoint and the strikeface toe end;
when the golf club head is at address over a ground plane:
a center plane of the golf club head is orthogonal to the ground plane and comprises the strikeface centerpoint;
a midheel plane of the golf club head comprises the strikeface midheel point and is parallel to the center plane;
a midtoe plane of the golf club head comprises the strikeface midtoe point and is parallel to the center plane;
the conic section perimeter is circular and is centered at one of the center plane, the midheel plane, or the midtoe plane; and
with respect to the top view of the golf club head:
the conic section perimeter comprises a size of a golf ball perimeter forward of the strikeface.

5. The golf club head of claim 1, wherein:
the strikeface comprises:
a strikeface centerpoint; a strikeface heel end; a strikeface toe end;
a strikeface midheel point between the strikeface centerpoint and the strikeface heel end; and
a strikeface midtoe point between the strikeface centerpoint and the strikeface toe end;
when the golf club head is at address over a ground plane:
a center plane of the golf club head is orthogonal to the ground plane and comprises the strikeface centerpoint;
a midheel plane of the golf club head comprises the strikeface midheel point and is parallel to the center plane;
a midtoe plane of the golf club head comprises the strikeface midtoe point and is parallel to the center plane; and
the conic section perimeter is circular and is centered at one of the center plane, the midheel plane, or the midtoe plane.

6. The golf club head of claim 1, wherein:
the ribs comprise:
a fourth rib comprising:
a first fourth-rib endpoint;
a second fourth-rib endpoint; and
a fourth rib axis intersecting the first and second fourth-rib endpoints;
and
with respect to the top view of the golf club head:
the first, second, third, and fourth rib axes are tangent to the locus;
the conic section perimeter comprises a circle; and
a maximum diameter of the circle is approximately 3 mm to approximately 10 mm.

7. The golf club head of claim 1 wherein:
one or more of the first rib height, the second rib height, and the third rib height vary respectively across the first rib length, the second rib length, and the third rib length.

8. The golf club head of claim 1, further comprising:
a first side rib extending from the front wall to the rear side positioned on the heel end; and
a second side rib extending from the front wall to the rear side positioned on the toe end; wherein:
the strikeface has a centerpoint; and
the first side rib is asymmetric to the second side rib such that the first side rib and the second side rib are not equidistant, as measured from the strikeface centerpoint to a centerpoint of each rib.

9. The golf club head of claim 1, further comprising:
a first connecting rib extending between the first rib and the second rib, the first connecting rib comprises a first end and a second end, wherein the first end of the first connecting rib is integrally formed with the first rib, and the second end of the first connecting rib is integrally formed with the second rib.

10. The golf club head of claim 1, wherein:
the ribs comprise:
a fourth rib comprising
a first fourth-rib endpoint;
a second fourth-rib endpoint; and
a fourth rib axis intersecting the first and second fourth-rib endpoints;
and
with respect to the top view of the golf club head:
the first and second rib axes intersect each other forward of the conic section perimeter; and
the third and fourth rib axes intersect each other rearward of the conic section perimeter.

11. The golf club head of claim 5, wherein:
the ribs comprise:
the third and fourth ribs as outermost ribs, such that:
the third rib is located closest to the toe end than any of the first, second, or fourth ribs; and
the fourth rib is located closest to the heel end than any of the first, second, or third ribs; and
the first and second ribs as inner ribs, such that:
the first and second ribs are located between the third and fourth ribs.

12. The golf club head of claim 5, wherein:
one or more of the first, second, third, or fourth ribs is located at the crown; and
one or more of the first, second, third, or fourth ribs is located at the sole.

13. The golf club head of claim 5, wherein:
the first rib axis is tangent to the conic section perimeter at a first tangency point located towards a heelside end of the conic section perimeter;
the second rib axis is tangent to the conic section perimeter at a second tangency point located towards a toeside end of the conic section perimeter;
the third rib axis is tangent to the conic section perimeter at a third tangency point located between the first tangency point and a most rearward point of the conic section perimeter; and
the fourth rib axis is tangent to the conic section perimeter at a fourth tangency point located between the second tangency point and the most rearward point of the conic section perimeter.

14. The golf club head of claim 5, further comprising:
a first connecting rib extending between the first rib and the second rib, the first connecting rib comprises a first end and a second end, wherein the first end of the first connecting rib is integrally formed with the first rib, and the second end of the first connecting rib is integrally formed with the second rib.

15. The golf club head of claim 5, wherein:

a first side rib extending from the front wall to the rear side positioned on the heel end; and a second side rib extending from the front wall to the rear side positioned on the toe end; wherein:

the strikeface has a centerpoint; and the first side rib is asymmetric to the second side rib such that the first side rib and the second side rib are not equidistant, as measured from the strikeface centerpoint to a centerpoint of each rib.

* * * * *